US005642601A

United States Patent [19]

Thompson, Jr. et al.

[11] Patent Number: 5,642,601

[45] Date of Patent: Jul. 1, 1997

[54] METHOD OF FORMING THERMAL INSULATION

[75] Inventors: James Henry Thompson, Jr.; Michael Kinard Maffett, both of Greenwood, S.C.

[73] Assignee: Greenwood Mills, Inc., Greenwood, S.C.

[21] Appl. No.: 563,706

[22] Filed: Nov. 28, 1995

[51] Int. Cl.[6] ..... B65B 63/02; B65B 63/04; B65B 63/08

[52] U.S. Cl. ..... 53/431; 53/429; 53/430; 53/435; 53/438; 53/439; 53/440; 53/447; 53/459; 53/469; 524/34; 524/921; 442/58; 442/414

[58] Field of Search ..... 156/62.2, 62.4, 156/62.6, 62.8; 53/411, 428, 429, 430, 431, 435, 436, 438, 439, 440, 447, 449, 459, 469; 524/34; 428/288, 283, 920, 921, 74

[56] References Cited

U.S. PATENT DOCUMENTS

| | | | |
|---|---|---|---|
| 4,678,822 | 7/1987 | Lewellin | 524/12 |
| 5,057,168 | 10/1991 | Muncrief | 156/62.6 |
| 5,178,680 | 1/1993 | Tenney et al. | 118/315 |
| 5,188,896 | 2/1993 | Suh et al. | 428/397 |
| 5,418,031 | 5/1995 | English | 428/74 |
| 5,491,186 | 2/1996 | Kean et al. | 524/13 |
| 5,516,580 | 5/1996 | Frenette et al. | 428/288 |

*Primary Examiner*—Daniel Moon

*Attorney, Agent, or Firm*—Bell, Seltzer, Park & Gibson, P.A.

[57] ABSTRACT

A method of forming thermal insulation comprising forming recycled cotton fibers into a relatively loose mass, impregnating the cotton fibers with a liquid fire retardant, drying the impregnated cotton fibers, mixing the impregnated cotton fibers with the dry granules of fire retardant while causing the granules to adhere to the cotton fibers, blending the cotton fibers with synthetic springy fibers and with bi-component bonding fibers having core components and sheath components, forming the blended fibers into a composite web of predetermined thickness to provide a desired insulation value, heating the composite web to soften the sheath components of the bi-component fibers to cause the same to bond the fibers together into a bonded composite web, slitting the bonded composite web longitudinally into narrower strips of a predetermined width corresponding to the widths of individual batts of insulation, severing the strips into predetermined lengths to form individual batts, and packaging the individual batts in sealed plastic bags.

70 Claims, 44 Drawing Sheets

VAC. ON
VAC. OFF
FB
B

METHOD OF FORMING THERMAL INSULATION

FIELD OF THE INVENTION

This invention relates to thermal insulation and more particularly to a method of forming such insulation from mostly cotton fibers.

BACKGROUND OF THE INVENTION

Thermal insulation used in insulating buildings, particularly residential buildings, has heretofore been predominantly fiberglass. Such fiberglass insulation typically is used in both loose or blown form and in batts with and without a layer of paper or vinyl on one side. Because of certain concerns about fiberglass, there has developed a need for economically feasible alternatives to fiberglass insulation.

Examples of prior attempts to meet this need are disclosed in U.S. Pat. No. 4,678,822 to Lewellin and U.S. Pat. No. 5,057,168 to Muncrief. Lewellin describes a method of forming a bonded fiber insulation batt in which cotton fibers are bonded together by a RHOPLEX resin emulsion. While certainly a step in the right direction, Lewellin's batt was more dense than was desirable and the weight thereof was excessive.

Muncrief disclosed a low density, mainly cotton insulation bonded into batt form by polyester fibers mixed with the insulation fibers and heated to their softening temperature. Muncrief also discloses the addition of stilt fibers, in the form of gin motes and linters, short acrylic fibers or the like, and these stilt fibers are either mixed with the insulative fibers or spread between the layers of insulative fibers forming the batt. In addition, Muncrief discloses the addition of powdered, dry fire retardant chemicals to his insulation material in an attempt to provide the requisite fire retardancy. Such dry fire retardant chemicals have been found to be less than desirable to provide a high degree of fire retardancy.

While certainly an improvement over fiberglass insulation and the resin-bonded insulation of Lewellin, the process of Muncrief was still less than desirable from manufacturing and cost standpoints and from a product quality standpoint. Muncrief's process was somewhat labor intensive and lacked other processing features which would reduce the incremental cost of producing such insulation.

SUMMARY OF THE INVENTION

With the foregoing in mind, it is an object of the present invention to provide an insulation product and method of producing such an insulation product consisting mainly of cotton fibers in a low cost, substantially automated manner which overcomes the disadvantages and deficiencies of prior methods.

The foregoing object of the present invention is accomplished by forming the insulation mainly of cotton fibers that have been recycled from waste fabric from apparel manufacture and other sources. There is an abundant supply of such recycled fibers at a reasonable cost, i.e., less than virgin cotton fibers.

These recycled cotton fibers are processed by a substantially automated system that eliminates most, if not all, manual handling of the fibers, once the bales thereof have been loaded into the system. The method of this invention includes processing steps and procedures which produce an improved insulation product at very low cost. The bales of recycled cotton fibers are placed on a conveyor after having the strapping and any covers removed and, in one embodiment of this invention, the fibers are not manually handled until the packaged and palletized insulation is ready to be placed in storage in a warehouse by a fork lift and its operator or by automated handling equipment.

The bales of recycled cotton fibers are fed through a bale breaker which breaks the compacted fibers into clumps. These clumps of fibers are fed from the bale breaker through a pre-opener which breaks apart the clumps and forms the cotton fibers into a loose mass. The loose mass is fed pneumatically through a conduit to a distributer in which a liquid fire retardant is sprayed onto the loose stream of fibers.

The stream of fibers is then fed into a press which compresses the fibers under very high compressive force to drive the liquid fire retardant as uniformly as possible into and throughout the cotton fibers. From the press, the compressed fibers are placed on a very slow moving conveyor for a sufficient time, e.g., approximately 8 hours, to permit the liquid fire retardant to migrate throughout the mass of cotton fibers and to be absorbed thereby.

The wet compressed fibers are fed through a second opener to separate the fibers into a loose mass. The loose fibers are then fed through a hot box into a vertical dryer wherein most of the moisture is removed and the fibers are fed from the dryer into a reserve hopper. The discharge end of the reserve hopper includes worker rolls that further loosen the fibers as they are discharged from the reserve hopper.

Fibers discharged from the reserve hopper are fed pneumatically to a willow. In the willow, a small amount of moisture is added to the fibers and the fibers are mixed with granules of a dry flame retardant, with the moisture causing the granules to adhere to the fibers. From the willow, the cotton fibers are fed to a blender.

Simultaneously, bales of springy fibers or filaments, preferably comprising a blend of nylon and polyester, are fed to bale breakers which separate and loosen the fibers or filaments. These loose springy fibers or filaments are subsequently blended with the cotton fibers.

Also simultaneously, bales of bi-component fibers or filaments, preferably either a polyester core with a polyester sheath or a polyester core with a polyethylene sheath, are fed through a bale breaker for blending with the cotton fibers. The cotton fibers, springy fibers or filaments and bi-component fibers or filaments are separately deposited on a conveyor and fed to a picker where the mixture is mixed and blended and formed into a loose stream of fibers. This stream of fibers is fed pneumatically to volumetric reserves. Preferably, waste material from downstream operations in the method of this invention are recovered, processed and added to the mixture of fibers being fed to the picker.

The mixture of fibers is fed from the volumetric reserves through carding machines which card the fibers and deliver carded webs of fibers onto the in-feed of cross-lapping machines which cross-lap the carded webs to form a loose batt of the cotton fibers, the springy fibers and the bi-component fibers. The loose batt is fed through an oven in which the fibers are heated to a temperature above the softening temperature of the sheath component of the bi-component fibers, but below the softening temperature of the core component thereof and of the springy fibers. The softened sheaths of the bi-component fibers adhere to the other fibers and when cooled bind the batt of fibers into a stable batt with the requisite structural integrity for use as insulation.

Subsequently, the batt can be cut into strips of insulation of standard widths and rolled into rolls or folded into a folded form for ready packaging and subsequent handling. Preferably, a web of paper or vinyl is glued to one face of the batt after or before the batt is cut into the standard width strips as is common in such insulation.

A parallel processing line processes the recycled cotton fibers into loose or blown-type insulation which has fire retardant chemicals impregnated therein and, preferably, dry fire retardant chemicals adhered thereto. The treated cotton fibers are then packaged, unitized and stored for subsequent shipment.

BRIEF DESCRIPTION OF THE DRAWING

Some of the objects have been stated, other objects will appear as the description proceeds, when taken in connection with the accompanying drawings which FIGS. 1A, 1B and 1C, collectively, are schematic views illustrating the method of the present invention.

DETAILED DESCRIPTION OF THE PREFERRED EMBODIMENTS

Figure 1A:
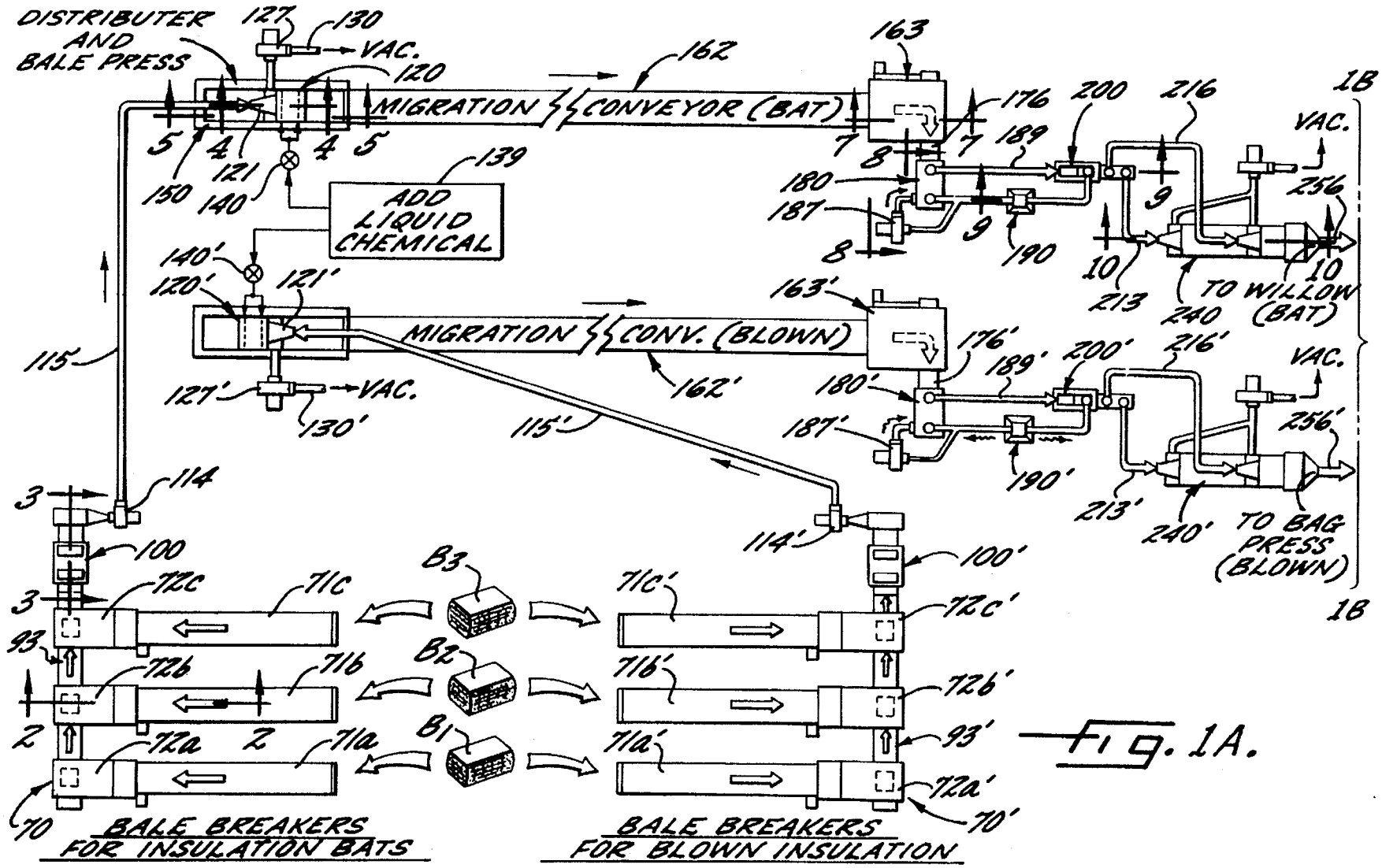
FIG. 1D is a view similar to FIG. 1B of an alternative embodiment utilizing an air lay batt forming machine in place of the cards and cross-lapping machines of FIG. 1B.
Figure 1B:
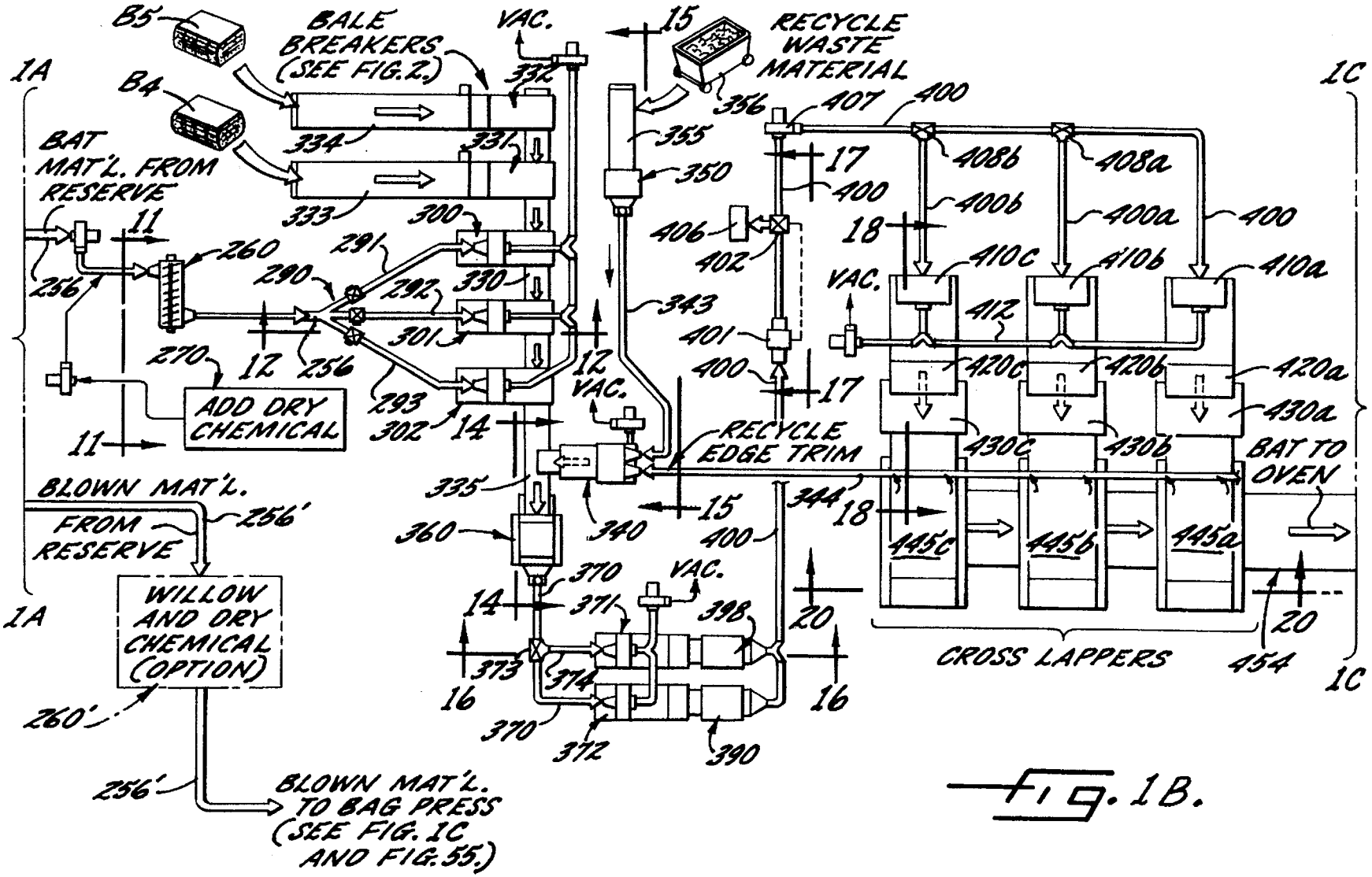
Figure 1C:
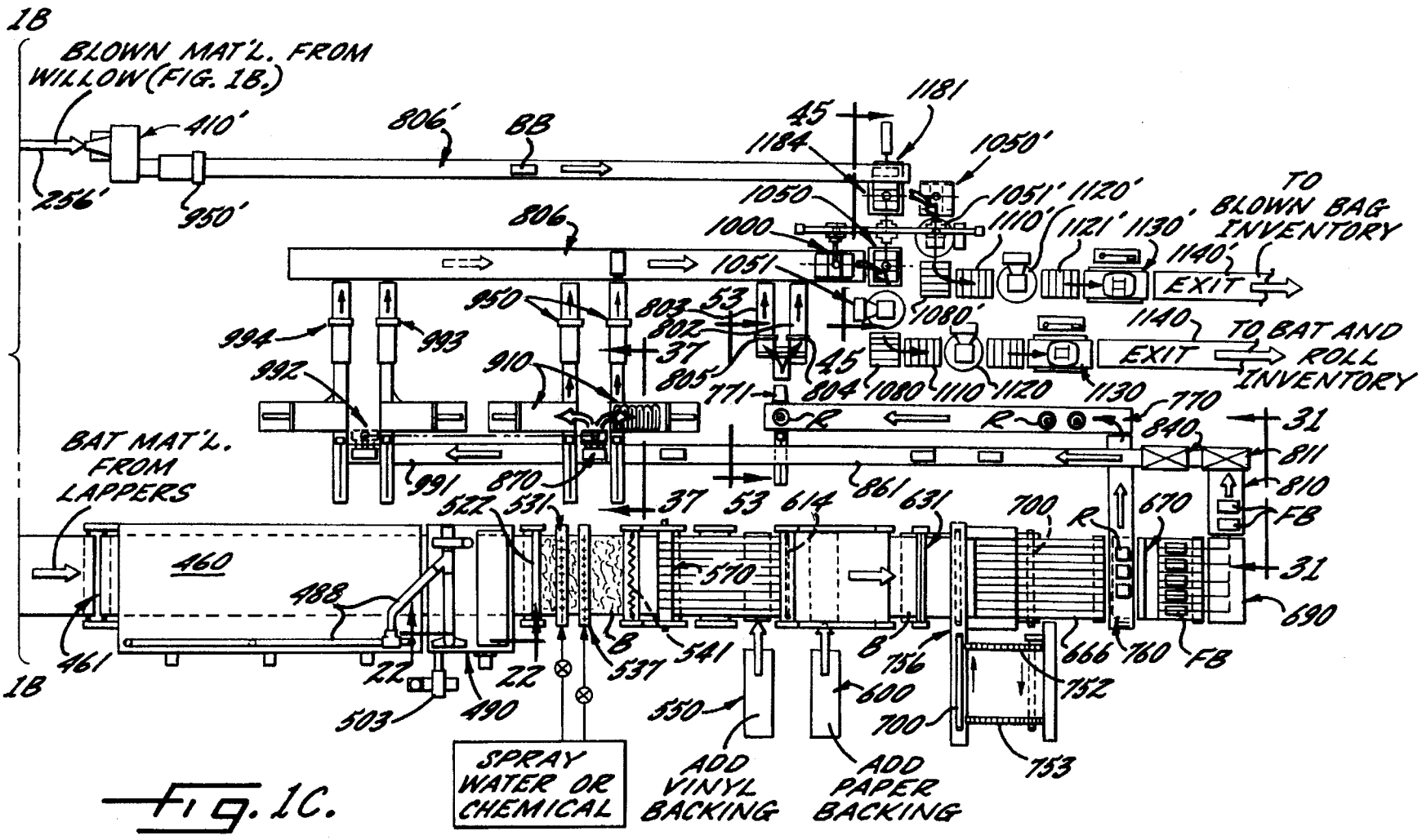
Figure 1D:
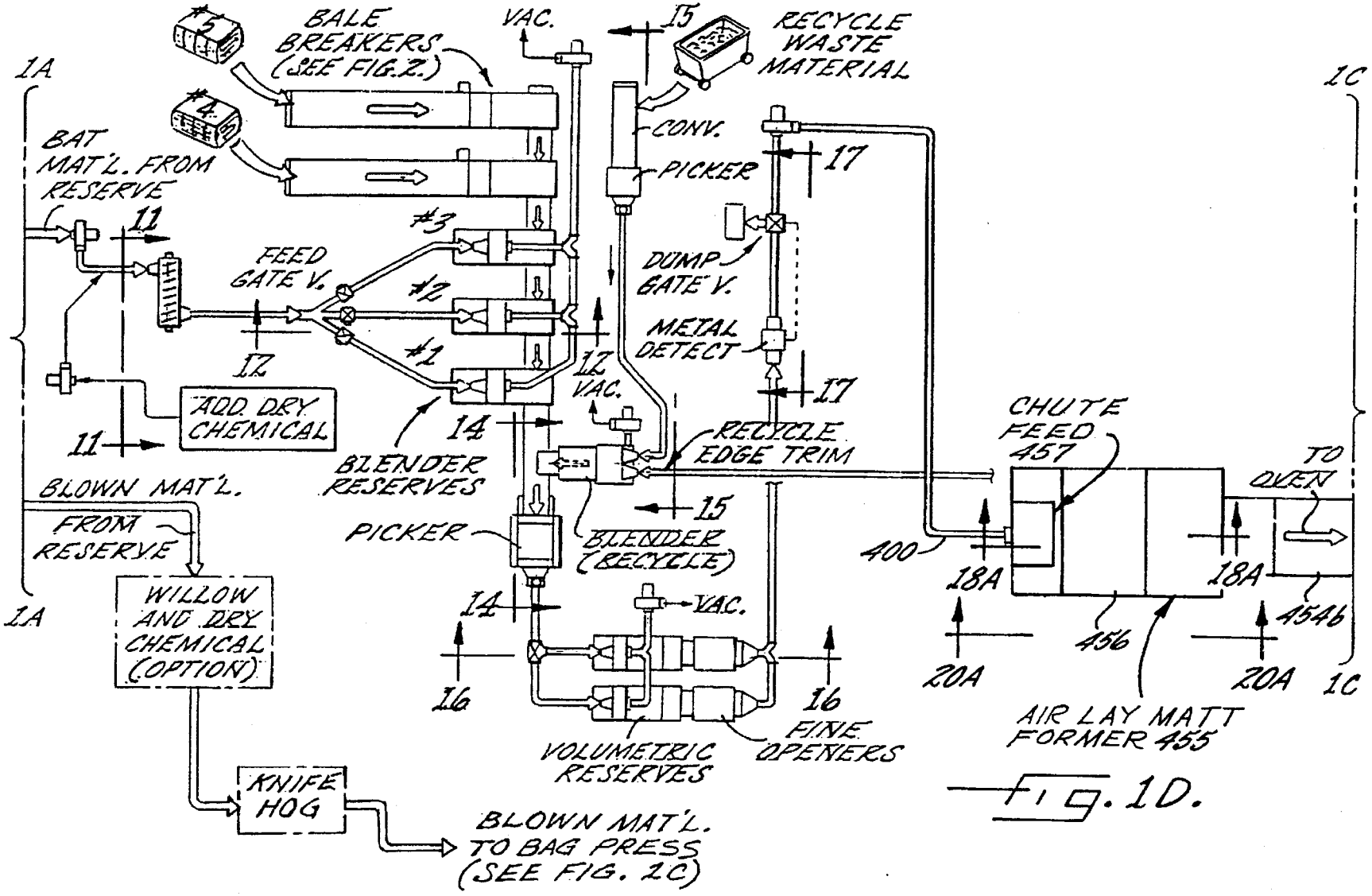

Referring now specifically to the drawings, and particularly to FIGS. 1A, 1B and 1C, taken collectively, there is illustrated one embodiment of the process of the present invention in which fibers are blended and treated and formed into either a batt-type of insulation material or into a loose form of insulation, usually applied by being blown into areas to be insulated. The process of the present invention includes parallel processing lines in which both the batt-type insulation and the blown-type insulation are simultaneously formed. Preferably, the process of the present invention is a substantially automated process forming both types of insulation material.

The major fibrous constituent of the insulation material produced by the process of the present invention is cotton fibers, and preferably is recycled or recovered cotton fibers previously used in prior manufacturing processes. Several processors, one of which is Leigh Fibers, Inc., currently recover and recycle cotton fibers previously used in the production of fabrics and other fibrous products, and supply those fibers for remanufacture in the form of bales of highly compressed recycled cotton fibers.

The batt-type of insulation processing method of the present invention will be described first and the blown-type insulation processing method will be described thereafter. Referring to FIG. 1A, the bales of recycled cotton fibers are referred to as B1, B2, and B3. Such bales B1, B2, B3 of recycled cotton fibers are received at the manufacturing plant from the processors and stored in a suitable area (not shown) until needed for use in the process of the present invention. When needed, bales B1, B2 and B3 are removed from storage by suitable means, such as a forklift, and the bands and covering material (not shown) are removed therefrom, and successive bales B1, B2 or B3 are then delivered to a suitable one of a plurality of bale breakers generally indicated at 70 in FIG. 1A.

The number of bale breakers 70 utilized can vary depending upon the volume of material which the insulation material processing line can accommodate. For illustrative purposes only, FIG. 1A illustrates three bale breakers **70*a*, 70*b*, and 70*c*. Obviously, a greater or lesser number of bale breakers 70** can be employed.

The bale breakers **70*a*, 70*b*, 70*c* include infeed conveyors 71*a*, 71*b* and 71*c*, which feed respective bales B1, B2, B3 to bale breakers 72*a*, 72*b*, 72*c*. The bale breakers 72*a*, 72*b*, 72*c* are substantially identical and therefore only the bale breaker 72*a*** will be described in detail.

Figure 2:
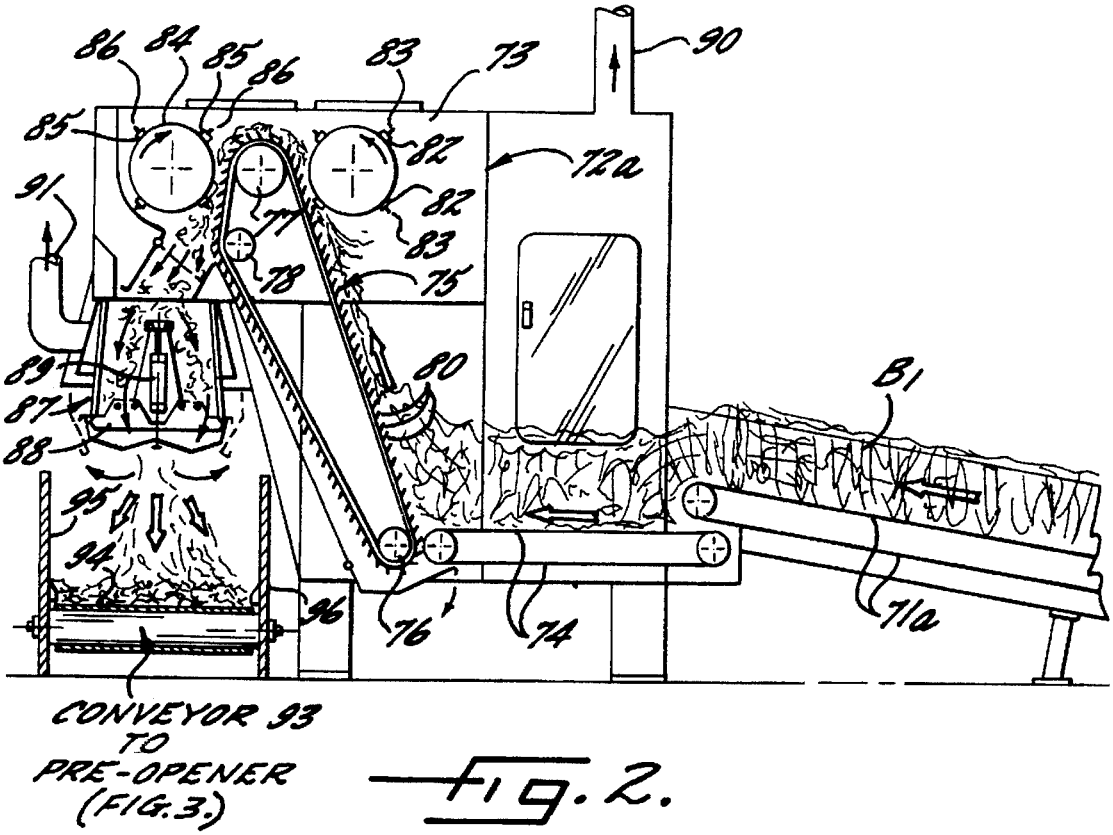
FIG. 2 is a fragmentary, somewhat schematic, vertical sectional view taken substantially along line 2—2 in FIG. 1A.

The bale breaker **72*a* is best illustrated in FIG. 2 and includes a housing 73 having a belt conveyor 74 in the lower portion thereof immediately adjacent and beneath the in-feed conveyor 71*a*. Conveyor 74 receives the bales B1 of recycled cotton fibers from the in-feed conveyor 71*a* and feeds the mass of fibers into the bale breaker 72*a*. The exit end of conveyor 74 is closely adjacent the lower end of a worker belt 75 which is trained about a lower idler roller 76, an upper driven roller 77 and another idler roller 78. Worker belt 75 has a multiplicity of teeth 80 covering the surface thereof, which teeth are angled outwardly in the direction of rotation of the belt at a predetermined angle. The teeth 80 of worker belt 75 are moved against the leading end of the mass of fibers being conveyed inside the bale breaker 72*a* by conveyor 74 and tear clumps of such fibers loose form the mass and carry such clumps upwardly with the teeth 80 on worker belt 75**.

Closely adjacent the upper end portion of worker belt 75 is a first worker roller 81 which has four toothed bars 82 running longitudinally thereof at equally spaced points around the periphery of the first worker roller 81. The toothed bars 82 have projecting spikes or teeth 83 thereon closely spaced apart along the length of the bars. Worker roller 82 is rotated in a counter direction to the direction of movement of the worker belt 75 such that the teeth 80 on worker belt 75 and the spikes or teeth 83 on the worker roller 81 move in opposition to each other and further serve to tear apart the clumps of fibers removed from the leading end of the bales of fibers by the teeth 80 on belt 75.

A second worker roller 84 is mounted on the opposite side of the upper end portion of worker belt 75 from the first worker roller 81 and is of the same construction as worker roller 81 having four toothed bars 85 equally spaced around the periphery thereof. Bars 85 have teeth 86 extending longitudinally in spaced relation throughout the length of the bar. Worker roller 84 differs from roller 81 in that it rotates in the same direction as the direction of movement of worker belt 75 and assists in removing the fibers from the teeth 80 of the worker belt 75. Fibers removed from belt 75 are directed into a discharge chute 87. The bottom end of chute 87 has a weight-sensitive discharge means 88 which collects a predetermined amount of fibers (by weight) therein and then discharges that amount by means of the cylinder 89.

To ensure a clean and acceptable end product, the interior of the housing 73 is substantially enclosed and has a conduit 90 extending upwardly from the in-feed end thereof and a conduit 91 extending outwardly and upwardly from the discharge chute 87. Opposite ends of conduits 90 and 91 are connected to a suitable dust collection system (not shown). In this manner, any dust, airborne lint or the like, is removed from the bale breakers 70 through the conduits 90 and 91 and are separated from the air in a suitable dust collection system.

The chute 87 and discharge means 88 direct the weighed fibers removed from the bales of fibers downwardly onto a conveyor 93 which is common to all of the bale breakers 70 and receives fibers from each bale breaker 72*a*, 72*b* or 72*c* disposed therealong. Conveyor 93 includes an endless belt 94 and stationary side panels 95 and 96 which confine the fibers to the belt and prevent the same from falling from the belt onto the floor. The conveyor 93 conveys the fibers from the bale breakers 72*a*, 72*b* and 72*c* to a pre-opener generally referred to at 100. Any suitable bale breakers 70 and pre-openers 100 may be utilized in carrying out the process of the present invention, examples of which are manufactured by LaRoche Textile Machinery Company.

Figure 3:
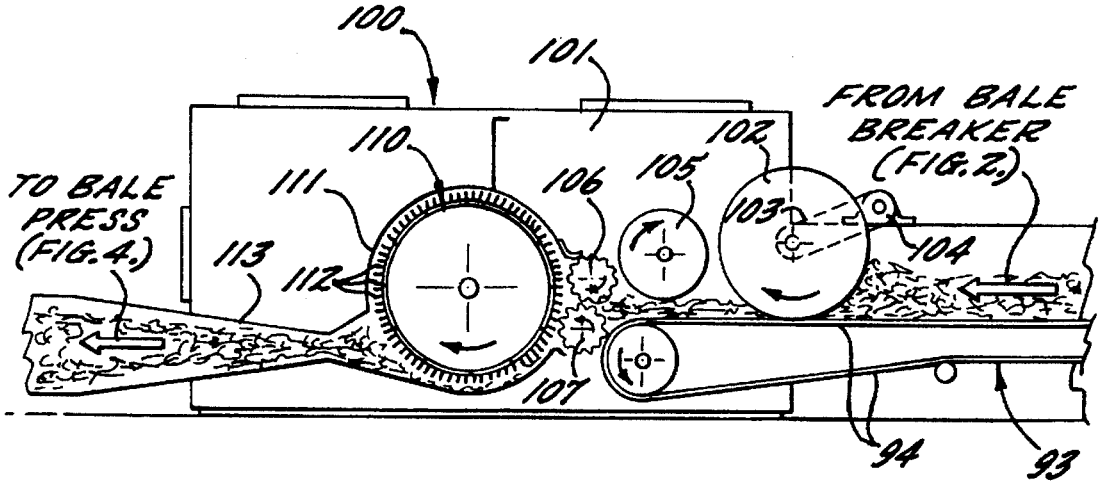
FIG. 3 is a fragmentary, somewhat schematic, vertical sectional view taken substantially along line 3—3 in FIG. 1A.

As illustrated in FIG. 3, the conveyor 93 has its discharge end located within the pre-opener 100 which includes a housing 101 and a compaction roller 102 mounted at its opposite ends on pivot arms Pivot arms 103 are pivoted at their other end in bearings 104 such that the weight of the roller presses the same against the upper surface of conveyor belt 94 to compact the fibers being fed along the conveyor belt 94. The roller 102 is an idler roller and the conveyor belt 94 delivers the compacted fibers from the roller 102 to a feed roller 105 which is driven in rotation such that its periphery is moving in the same direction as the upper run of the conveyor belt 94. Feed roller 105 assists the delivery end of the conveyor belt 94 in feeding the fibers to the worker elements of the pre-opener 100. These worker elements include a pair of fluted rollers 106, 107, which receive the mass of fibers from the conveyor 94 and feed roller 105 and compress and grip the fibers very tightly therebetween.

Rollers 106, 107 feed the fibers to a picker roll 110 which is housed in a housing 111 that is spaced fairly closely to the outer periphery of the picker roll 110. The picker roll 110 has teeth or wire 112 over the outer periphery with the individual teeth or wires being relatively closely spaced. The picker roll 110 rotates in a clockwise direction as illustrated in FIG. 3 with the teeth 112 thereof closely adjacent to the in-feed rollers 106, 107. In this manner, the teeth of the picker roll 110 tears the clumps of fibers apart and separates the fibers into a looser form. Picker roll 110 delivers the loose fibers through a discharge section 113 of picker roll housing 111. The discharge section 113 of the pre-opener 100 delivers the fibers to a centrifugal suction/blowing fan 114 (FIG. 1A), which in turn blows the fibers through a conduit 115.

Figure 4:
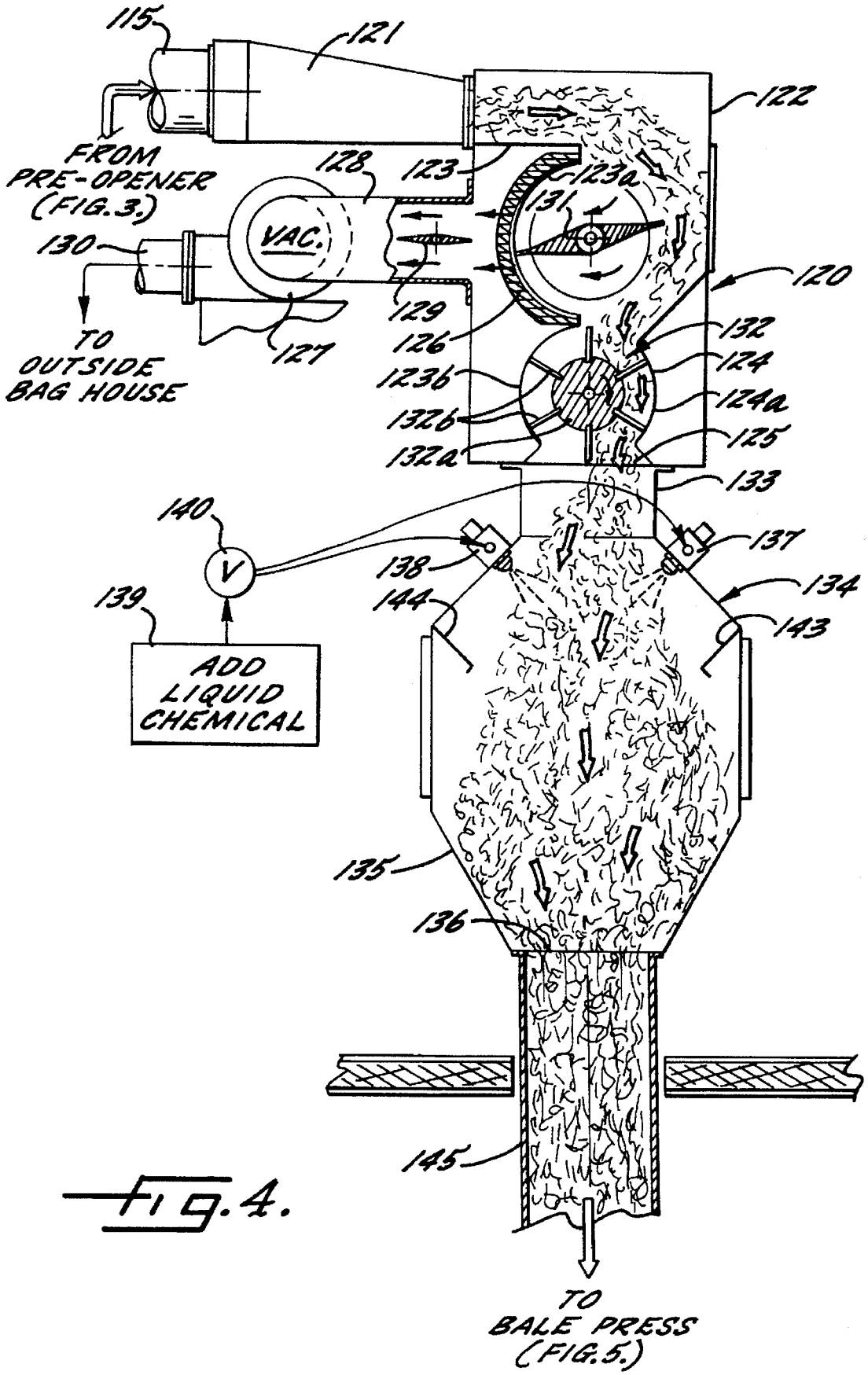
FIG. 4 is a fragmentary, somewhat schematic, vertical sectional view taken substantially along line 4—4 in FIG. 1A.

The fibers from the pre-opener 100 are delivered by conduit 115 to a pneumatic distributor 120 (FIGS. 1A and 4). Pneumatic distributor 120 includes an intake manifold 121 communicating with the discharge end of conduit 115 at one end and with a housing 122 at the opposite end thereof for delivering fibers from the conduit 115 into the interior of the housing 122. Housing 122 includes a first partition 123 therein and a second partition 124 which cooperate with each other and the remainder of housing 122 to define a somewhat restricted fiber passageway through the housing 122. Partition 123 has a concave curved first portion 123*a* which is perforate so as to permit air to pass therethrough. Partition 123 has a second concave curved portion 123*b* which is imperforate and is located adjacent the discharge end 125 of the fiber passageway through the housing 122.

A filter 126 is mounted on the outside of the curved portion 123*a* of partition 123 to filter air passing therethrough and to confine the fibers to the inner surface of the perforate portion 123*a* of partition 123. A vacuum pump or blower 127 has the intake thereof connected to the portion of the housing 122 externally of the partition 123 by a conduit 128. Conduit 128 has a suitable butterfly valve 129 mounted therein to control the airflow from the housing 122 into the conduit 128 under the impetus of the vacuum pump or vacuum blower 127. The discharge side of the vacuum pump 127 is connected by a conduit 130 to a dust removal system which may the same dust removal system as referred to above.

Mounted within the fiber passageway within housing 122 is a filter cleaning member 131 which has the outer tips thereof closely adjacent or in contact with the concave curved portion 123*a* of partition 123. Cleaning member 131 performs a wiping action on the surface of the partition portion 123*a* as member 131 is rotated in a clockwise direction which is counter to the flow of air and fibers through the fiber passageway within housing 122.

Partition 124 has a curved portion 124*a* corresponding to curved portion 123*b* of partition 123 to define a fiber metering portion and air-lock within the pneumatic distributor 120. A rotary metering valve 132 is mounted within the fiber metering chamber defined by the curved portions 123*b* of partition 123 and 124*a* of partition 124. Metering valve 132 includes a hub 132*a* and six vanes 132*b* mounted in the hub and extending radially outwardly therefrom into sealing engagement with the curved portions 123*b* of partition 123 and 124*a* of partition 124. Metering valve 132 is rotated in a clockwise direction to meter and control the delivery of fibers from the distribution housing 122 into an upper inlet end 133 of a fire retardant chemical application means 134. Fire retardant chemical application means 134 includes a housing 135 having an inlet end 133 and an outlet end 136 and defines therewithin a chamber for receipt of the fibers from the pneumatic distributor 120 for application of fire retardant chemicals thereto.

The fire retardant chemical is applied in liquid form through a pair of spray nozzles 137 and 138 which are connected to a source of fire retardant chemical liquid 139 through a control valve 140 which controls the delivery of liquid fire retardant from the source 139 to the nozzles 137 and 138.

Any suitable fire retardant chemical that can be applied in liquid form may be utilized. One example of such a fire retardant chemical is a boron composition available commercially from a variety of sources. The concentrations of the boron composition in the aqueous solution are well-known and are contained in the directions for use from the suppliers of such flame retardant chemicals. The amount of the aqueous dispersion applied may vary depending upon the concentrations used. It is preferred that a sufficient amount of the aqueous dispersion be sprayed onto the cotton fibers to raise the moisture content thereof to between 30% and 50% by weight.

Figures 5, 6:
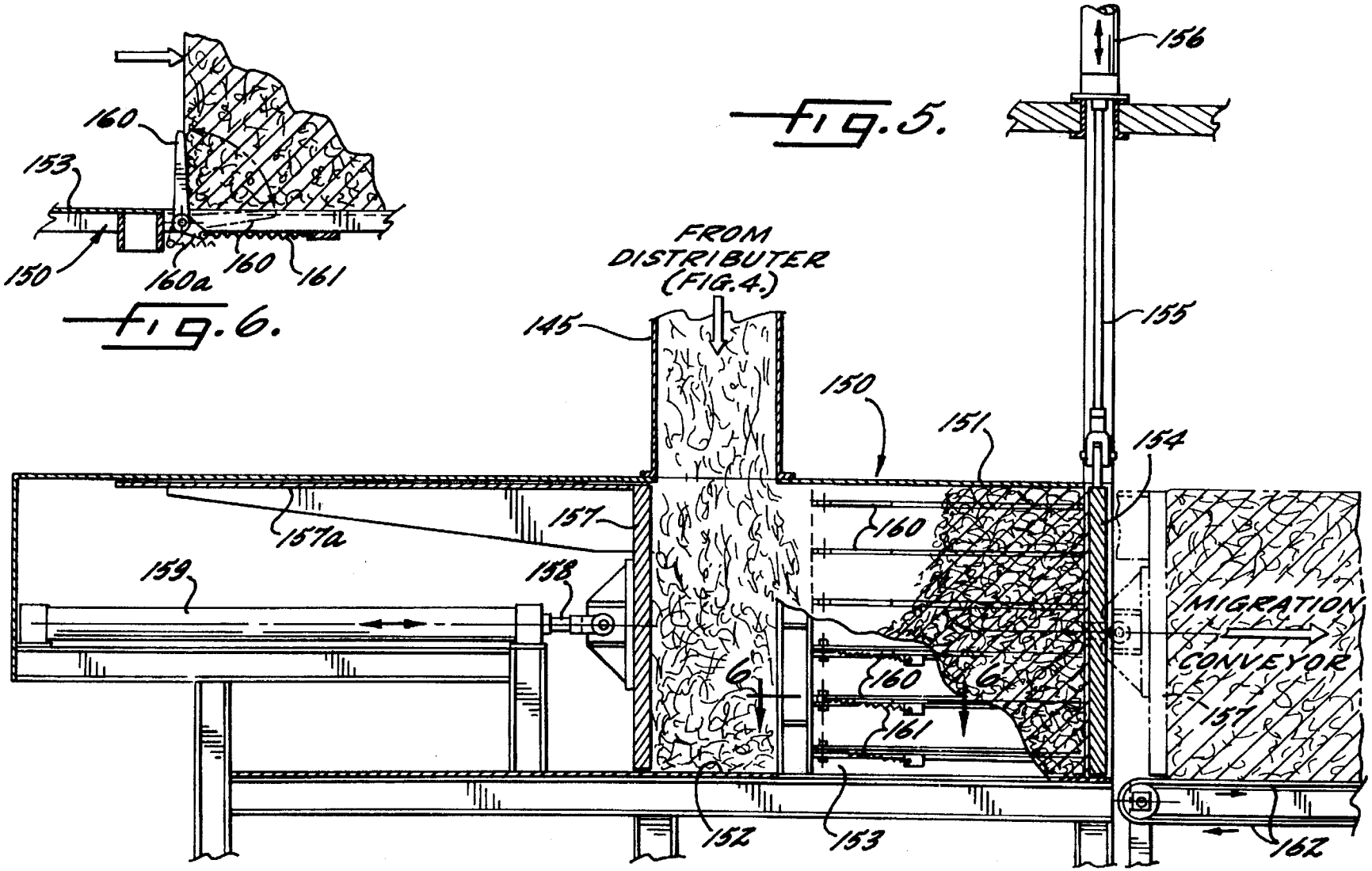
FIG. 5 is a fragmentary, somewhat schematic, vertical sectional view taken substantially along line 5—5 in FIG. 1A.
FIG. 6 is a sectional detail taken substantially along line 6—6 in FIG. 5.

The housing 135 includes partitions 143, 144 which direct and confine the sprayed fibers to a relatively narrow path through the housing 135. The sprayed fibers drop downwardly into the lower portion of the housing 135 and outwardly through the discharge end 136 thereof. A conduit 145 is connected at its upper end to the discharge end 136 of housing 135 and at its lower discharge end to a bale press 150. (FIGS. 1*a*, 4 and 5).

Bale press 150 comprises an upper wall 151, a bottom wall or floor 152 and respective sidewalls 153, only one of which is shown. At one end of the bale press 150 is a moveable end wall 154 which is vertically reciprocable to open or close that end of the bale press 150 (FIG. 5). To move the end wall 154, the upper end thereof is connected to a piston rod 155 of a pneumatic piston 156. Pneumatic piston 156 may be single acting to raise the end wall 154 while permitting the end wall to move downwardly by gravity or the cylinder 156 may be double acting to positively move the end wall 154 in both directions. Mounted in the other end of bale press 150 is a ram 157 for sliding horizontal movement. Ram 157 is carried by the outer end of a piston rod 158 of a cylinder 159 mounted on the frame of the bale press 150.

While any suitable bale press 150 may be used, a bale press manufactured by Randall K. Walters, Incorporated has been found to be suitable. When ram 157 moves to compress the fibers within the bale press housing, the ram 157 carries a horizontal plate 157*a* at its upper end and extending rearwardly therefrom. This horizontal plate 157*a* serves to close off the discharge end of the conduit 145 to prevent fibers from falling into the bale press behind the ram 157.

In operation, the end wall member 154 is lowered to close off the discharge end of the bale press 150 and ram 157 is retracted to its inoperative position. Thereupon, fibers may fall by gravity out of the discharge end of conduit 145 into the bale press housing. When a sufficient amount of fibers have collected in the bale press housing, the ram 157 is activated and moves laterally to compress the fibers which have fallen into the bale press 150 against the end wall 154 and then retracts to its inoperative position. Mounted on the sidewalls 153 of the bale press are retaining members 160 (FIG. 6) which are pivotally mounted on the sidewalls 153 for limited pivotal movement from an operative position in which the members 160 project into the space interiorly of the bale press housing, and a retracted position in which the members 160 pivot into suitable openings in the sidewalls 153 such that the fibers being compressed and the ram 157 may readily pass thereby. Upon retraction of the ram 157, the members 160 are returned to their operative position by tension springs connected to bell-crank portions 160*a* on each of the levers. Thereby, the retaining fingers 160 retain the compressed fibrous mass in the discharge end of the bale press 150 so that the fibers in the bale press will not interfere with additional fibers falling into the bale press from the conduit 145.

Upon the collection of a suitable amount of compressed fibers in the bale press 150, the cylinder 156 is activated to lift the end wall 157 upwardly until the discharge end of the bale press is open. Thereupon, the ram 157 is activated to move to its fully extended position to push the compressed fibrous mass from the bale press onto a migration conveyor 162. Once the fibrous mass has been ejected from the bale press onto the migration conveyor 162, the ram 157 commences to retract and the end wall 154 is lowered into its operative position closing the discharge end of the bale press and the compressing operation in the bale press is repeated on a continuous basis. The extreme compression of the fibrous mass in the bale press serves to force the liquid fire retardant throughout the fibrous mass and to provide for a substantially uniform penetration of the fire retardant into the cotton fibers.

The migration conveyor 162 is of such length and is driven by a drive means (not shown) so that the dwell time of the highly compacted liquid flame retardant treated cotton fibers is sufficient for the liquid flame retardant to migrate thoroughly and substantially, uniformly throughout the mass of cotton fibers (FIG. 1A). In this regard, the migration conveyor 162 is operated at such a slow speed that it is barely perceptible. One example of the dwell time of liquid fire retardant treated fibers on the migration conveyor 162 is eight hours for a 30% moisture content.

Figure 7:
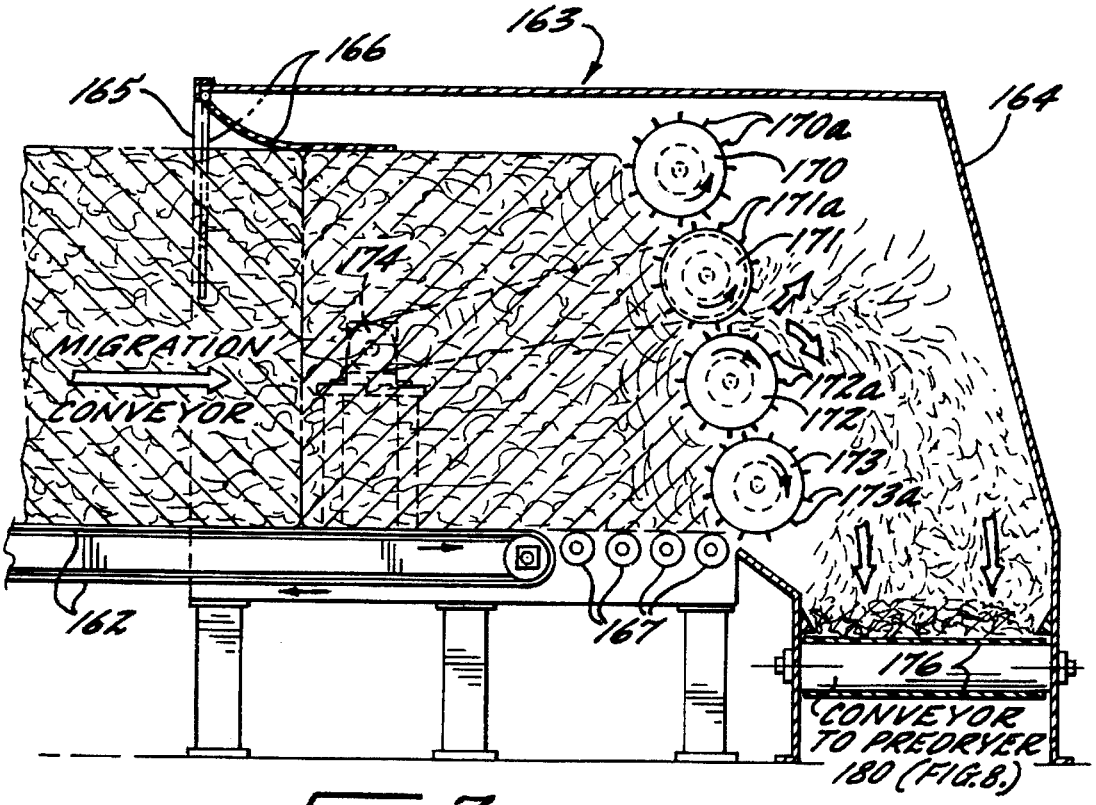
FIG. 7 is a fragmentary, somewhat schematic, sectional view taken substantially along line 7—7 in FIG. 1A.

At the opposite end of the migration conveyor 162 is an opener, generally indicated at 163 (FIGS. 1A and 7). The opener 163 includes a housing 164 that has an inlet end 165 into which the discharge end of migration conveyor 162 extends. The inlet end of opener housing 164 includes a resilient flexible curtain member 166 which is secured across the top of the inlet end 165 and flexes inwardly and upwardly when the migration conveyor 162 moves compacted fibers into the opener housing 164. When no fibers are being moved into the opener housing 164, curtain member 165 will flex and move downwardly into the dash line position shown in FIG. 7 to partially close the inlet end 165.

Opener 163 includes a plurality of rollers 167 which form a roller conveyor with one end of the roller conveyor being adjacent the delivery end of the migration conveyor 162 and the other end thereof being adjacent and beneath a plurality of stacked worker rollers 170, 171, 172 and 173 (FIG. 7). Worker rollers 170–173 are generally vertically stacked one above the other and are driven by a drive means 174 such that rollers 170 and 171 rotate in a counterclockwise direction as shown in FIG. 7 while rollers 172 and 173 rotate in a clockwise direction.

The worker rollers 170–173 include spaced apart teeth or spikes on the periphery thereof and extending radially outwardly from such periphery, such teeth being referred to at 170*a*, 171*a*, 172*a* and 173*a*. Upon rotation of the worker rollers 170–173 and the slow forward movement of the mass of compressed fibers, the teeth 170*a*–173*a* of the worker rollers 170–173 tear into the leading end of the mass of compressed fibers pulling individual clumps of such fibers from the compressed mass and opening the compressed mass into a relatively loose form. Because the mass is moving very slowly, the worker rollers can pull small clumps of fibers from the mass without damage to individual fibers therein. The fibers discharged by the worker rollers 170–173 fall downwardly within housing 164 onto a discharge conveyor 176 which extends transversely of the migration conveyor 162 and longitudinally of the worker rollers 170–173.

Figure 8:
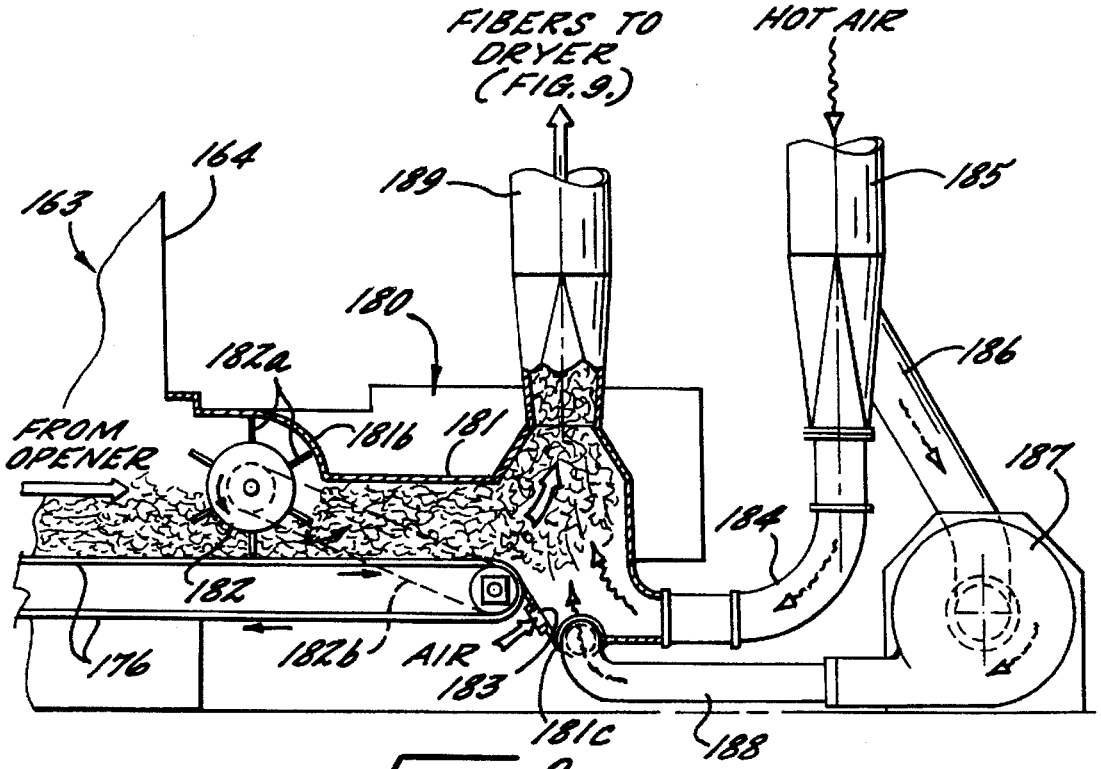
FIG. 8 is a fragmentary, somewhat schematic, sectional view taken substantially along line 8—8 in FIG. 1A.

The opener discharge conveyor 176 delivers the opened, still wet fibers to a hot box or predryer, generally indicated at 180 (FIGS. 1A and 8). The hot box or predryer 180 includes a housing 181 into which the discharge end of the opener conveyor 176 extends. The inlet end of the housing 181 joins to and abuts against the housing 164 of the opener 163 and includes a curved concave portion 181*b* in which is mounted a metering and air-lock roller 182. Metering roller 182 has vanes 182*a* extending radially, outwardly therefrom with the outer ends of the vanes 182*a* being in very close proximity or touching the upper run of opener conveyor 176 on one side and the curved portion 181*b* of housing 181 on the other side. Metering roller 182, therefore, serves as an air lock maintaining most, if not substantially all, of the hot air within the hot box or predryer 180 and isolating the predryer from the opener 163. The roller 182 is rotated by a suitable drive belt 182*b* from conveyor 176 such that the outer periphery of the vanes 182*a* are traveling at the same linear speed as the opener conveyor 176.

Figure 9:
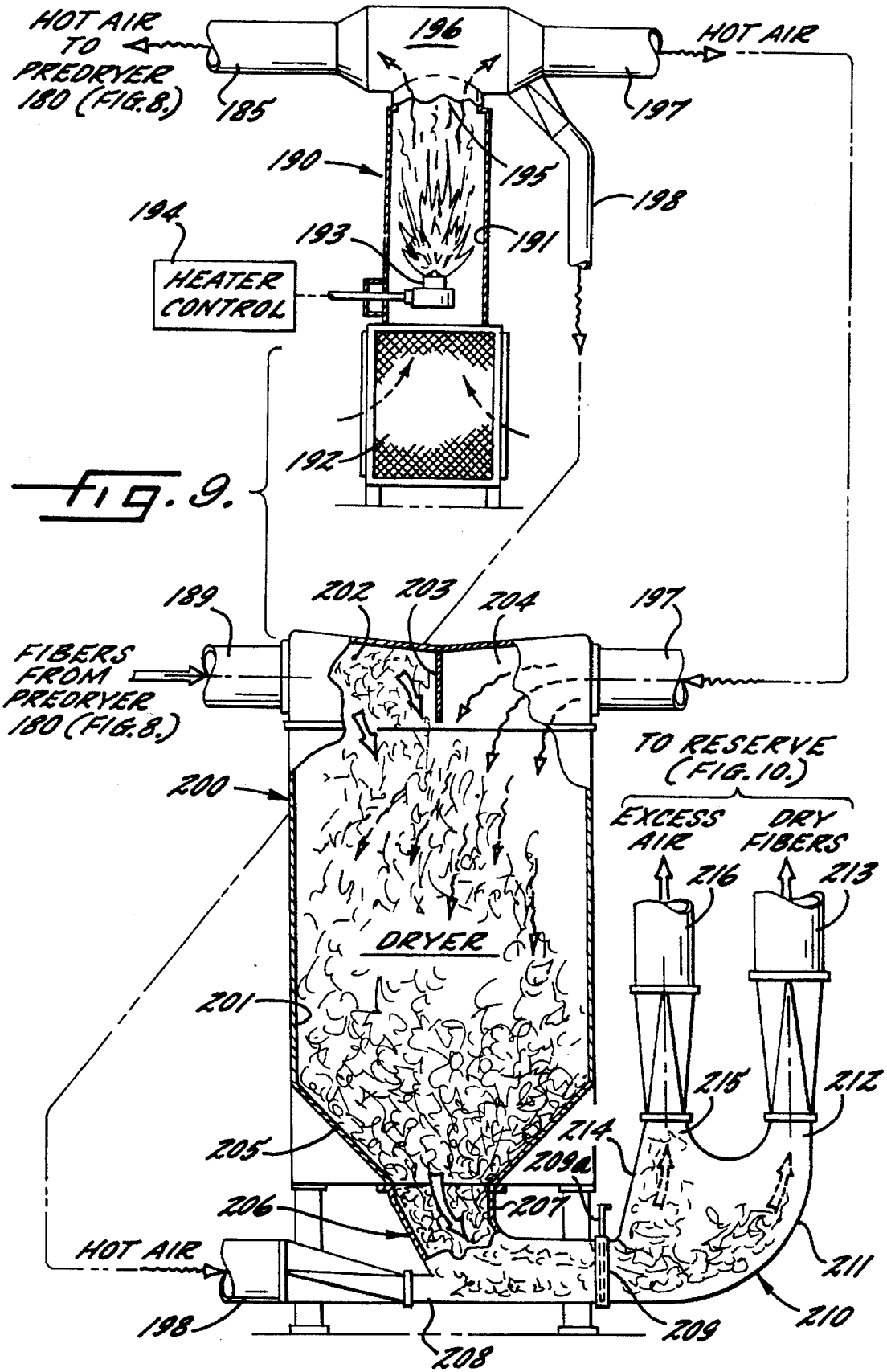
FIG. 9 is a fragmentary, somewhat schematic, sectional view taken substantially along line 9—9 in FIG. 1A.

The predryer housing 181 includes a portion 181*c* that is in substantial air-tight engagement with the end portion of the opener conveyor 176 and has an ambient air inlet opening 183 therein to allow for a small amount of ambient air to be drawn into the predryer 180. Also connected to housing 181 is a conduit 184 which is, in turn, connected to another conduit 185. The opposite end of conduit 185 is connected to an air heater 190 (FIG. 9). Adjacent to the first end of conduit 185 connected to conduit 184, a branch conduit 186 is connected at one end to conduit 185 and at its other end to a booster blower 187, the discharge end of which is connected by a conduit 188 to the lower portion of housing 181 adjacent housing portion 181*c*. In this manner, booster blower 187 supplies a portion of the hot air from conduit 185 into housing 181 of predryer 180 at substantially increased velocity so as to boost the flow rate of hot air through the housing 181 and into a discharge conduit 189 connected to the discharge opening in housing 181 for receiving and pneumatically conveying the fibers received from the opener 163 through conduit 189 to a dryer 200 (FIG. 9). It is noted that since the moist or wet fibers received in predryer 180 from opener 163 are entrained within a hot air stream within housing 181 and in conduit 189, drying of the fibers occurs not only within the housing 181 but continuously in the conduit 189 as the fibers are being conveyed from the predryer 180 into dryer 200.

The air heater 190 comprises a housing 191 having an air intake 192 at the bottom thereof and a burner 193 mounted in the medial portion thereof and connected to a heater control 194 which includes a source of fuel for the burner 193 and suitable control means for controlling the rate of fuel supplied to burner 193. Air heater 190 has a hot air discharge 195 at the upper end thereof which is connected to a plenum 196, one end of which is connected to the conduit 185, to supply hot air to the predryer 180, and the other end of which is connected to one end of a conduit 197. Conduit 197 is connected at its other end to the top portion of the dryer 200. Plenum 196 is also connected to one end of another conduit 198 which has the other end thereof connected to the bottom, discharge portion of the dryer 200 in a manner to be described hereinafter.

Dryer 200 includes a housing 201 which includes an upper, fiber intake portion 202 connected to the conduit 189 supplying fibers from the predryer 180 to the dryer 200. Housing portion 202 is divided by a partial partition 203 extending from the top of dryer housing 201 downwardly for a predetermined distance to separate the fiber intake portion 202 from a hot air intake portion 204 to which the conduit 197 is connected. The lower end of dryer housing 201 includes a conical portion 205 into which the fibers fall by gravity and also are carried into this lower portion by the two separate air streams entering the upper portions of dryer housing 201 from conduits 189 and 197. The conical portion 205 of dryer housing 201 is connected to a venturi 206 having a fiber conduit portion 207 and a hot air venturi portion 208. By passing the fibers through the venturi 206 the rate of travel of the fibers is increased and the venturi section 206 terminates at a manually controlled, gate valve 209 which has a slideable valve member 209*a* which may be manually moved to close off the discharge end of the venturi conduit 207 or withdrawn to the position shown in FIG. 9 which opens the discharge end of the conduit 207.

The discharge end of conduit 207 and the valve 209 are connected to a centrifugal separator 210 through an inlet end thereof. The centrifugal separator 210 includes a curved portion 211 which terminates in one discharge portion 212 connected to a conduit 213 and a relatively straight housing portion 214 which terminates in a discharge portion connected to a conduit 216. By the configuration of the separator 210, two paths of travel for the fibers and excess air through the separator 210 are provided. Because of the difference in the weight of the dry fibers from the excess air, the dry fibers will tend to be carried by the air stream exiting the venturi section 216 to the outside of the separator 210 closer to the curved section 211 and therefore through the discharge portion 212 into the conduit 213. The excess air will follow the shorter path of travel through the separator 210 through the discharge portion 215 into conduit 216.

Figure 10:
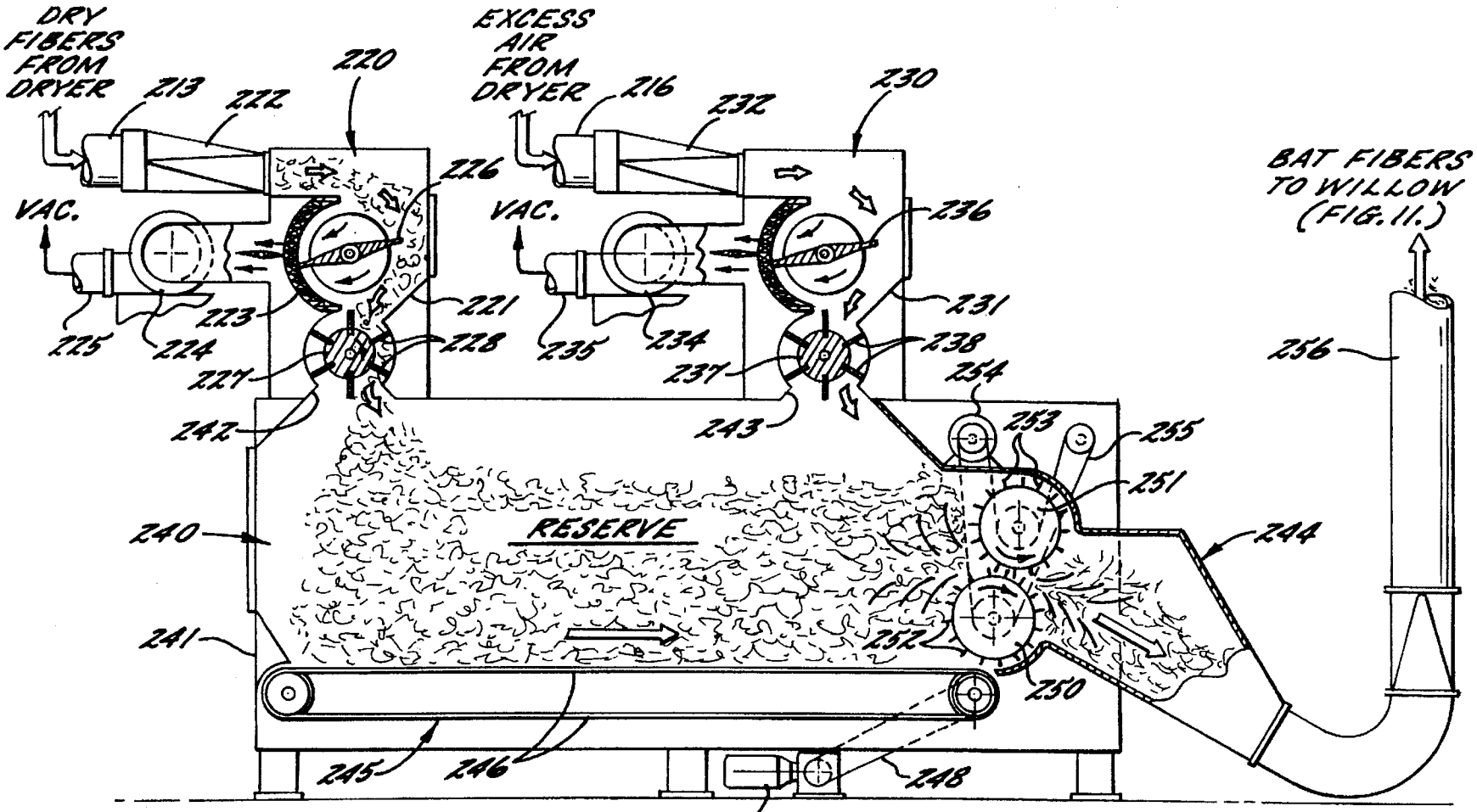
FIG. 10 is a fragmentary, somewhat schematic, sectional view taken substantially along line 10—10 in FIG. 1A.

The conduits 213 and 216 respectively deliver the fibers and excess air from the dryer 200 to respective distributors 220, 230 (FIG. 10). Distributors 220 and 230 are identical in construction to distributor 120 connected to the flame retardant application means 134.

Distributors 220 and 230 respectively include housings 221, 231 with intake manifold 222, 232. Filters 223, 233 have vacuum blower 224, 234 connected thereto, which in turn are connected on the discharge side thereof by conduits 225, 235 to the outside dust collector means (not shown). The distributors 220, 230 have filter cleaning rotors 226, 236 for removing the fibers from the inside surface of the filters 223 and 233. Finally, the distributors 220 and 230 include rotary metering valves 227, 237 having vanes 228, 238 on the outer periphery thereof for serving as an air lock.

The rotating metering valves 227 and 237 have the discharge side thereof connected to a reserve 240 which includes a housing 241 having a first inlet 242 and a second inlet 243 and a discharge manifold 244. The inlet 242 in housing 241 is at the distal end of the housing from the discharge manifold 244 while the inlet 243 is at the proximate end thereof to the discharge manifold 244.

The conduit 213 is connected to distributor 220 and delivers the dry fibers to distributor 220, which in turn delivers those fibers into reserve 240 at the distal end, while conduit 216 is connected to distributor 230 and delivers the excess air through distributor 230 into the reserve 240 through inlet 243 proximate to the discharge manifold 244. In this manner, the distributor 230 functions as a filter to remove any fibers from the excess air.

The reserve 240 includes a conveyor 245 in the bottom portion of housing 241 which comprises an endless conveyor belt 246 driven by a motor and transmission 247 by means a drive belt 248. Preferably, conveyor 245 operates at a relatively slow speed and the speed thereof is dictated by the demand for fibers at later steps in this process. A pair of worker rolls 250, 251 are mounted within the discharge end of housing 241 closely adjacent to the discharge manifold 244. Worker rolls 250 and 251 have radially projecting teeth 252, 253 on the outer periphery thereof which intermesh at the nip of the rolls and are closely adjacent to curved portions of the housing 241. Rolls 250 and 251 are driven by a motor 254 and a drive belt 255. The worker rolls 250 and 251 breakup and open and separate any clumps of fibers that may have adhered together due to any moisture remaining in the relatively dry fibers when these fibers are delivered into the reserve. The worker rolls discharge the fibers into the discharge manifold 244 which is connected to a conduit 256 for pneumatic delivery of the fibers from the reserve to the next step in the process.

Figure 11:
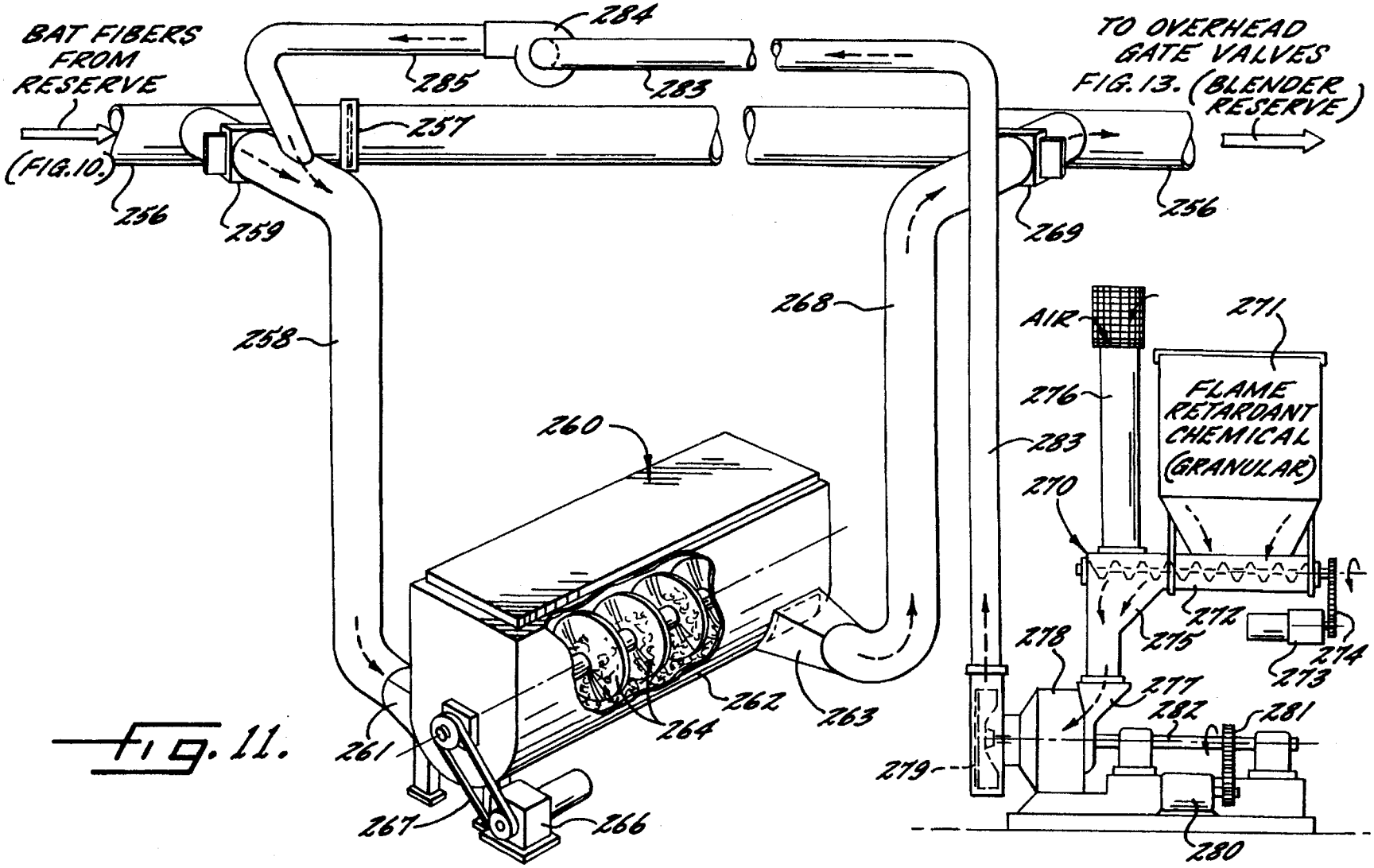
FIG. 11 is a fragmentary, somewhat schematic, perspective view, with portions broken away and looking substantially in the direction of the arrows 11—11 in the left-hand portion of FIG. 1B.

Conduit 256 has a gate valve 257 therein for closing the conduit 256 to the passage of the air stream and entrained fibers through the conduit or for selectively opening the conduit to permit the air stream and fibers to continue along conduit 256 (FIG. 11). Upstream of the gate valve 257, a branch conduit 258 is connected at one end to conduit 256 at an acute angle to the conduit 256 and is connected at its opposite end to a willow 260. Conduit 258 also has a gate valve 259 therein for selectively opening or closing the conduit 258.

The willow 260 has an inlet 261 at one end of a housing 262 thereof and an outlet 263 at the opposite end thereof. Housing 262 has mounted therein an auger 264 which conveys fibers received from conduit 258 through inlet 261 longitudinally from the inlet 261 to the outlet 263. Auger 264 is driven by a motor and gear box 266 by a drive belt 267. Outlet 263 has connected thereto one end of a conduit 268, the opposite end of which is connected to conduit 256 downstream of the gate valve 257. Conduit 268 also has a gate valve 269 mounted therein for selectively opening or closing the conduit 268.

A granular fire retardant chemical supply means 270 includes a hopper 271 which is adapted to receive and contain a dry, granular chemical fire retardant. The hopper 271 has a discharge opening in the bottom thereof which communicates with a feed auger 272 driven by a motor and gear box 273 through gearing 274 to receive and feed metered amounts of the granular chemical fire retardant and to deposit the same in a discharge portion 275 of the feed auger housing. The discharge portion 275 of the auger housing has an air inlet conduit 276 communicating with the top of the discharge potion 275 of the auger housing, the lower portion of which communicates with an inlet 277 of a centrifugal blower 278. The centrifugal blower 278 includes a fan 279 which is driven by a motor 280 and gearing 281 drivingly connecting the motor 280 to a drive shaft 282 of the blower 278. The centrifugal fan 279 discharges into a conduit 283 which extends upwardly to a booster fan 284. The discharge side of booster fan 284 is connected to a conduit 285 which is connected at its other end to the conduit 258 at an acute angle to conduit 258 to define an angled flow path into the conduit 258 to assist in feeding the fibers and air stream from conduit 256 to willow 260.

In this manner, the dry granular supply means 270 supplies metered amounts of the dry granular fire retardant into the conduit 258 which supplies the recycled cotton fibers and granular chemical flame retardant to the inlet 261 of willow 260. The auger 264 thoroughly mixes the fibers and dry granular fire retardant within the willow 260 and discharges the same into conduit 268 for return to the conduit 256.

A water spray nozzle (not shown) may be included in the willow 260 for spraying moisture and a surfactant onto the cotton fibers to cause the dry granular fire retardant chemical to adhere to the cotton fibers as the same are mixed together in willow 260.

If it is determined that the cotton fibers impregnated with the liquid fire retardant have sufficient fire retardancy, the willow 260 can be by-passed by opening gate valve 257 in conduit 256 and by closing gate valves 259 and 269 in conduits 258 and 268, respectively. Obviously, if willow 260 is by-passed, the willow 260 and dry, granular fire retardant supply means 270 will be shut down by stopping motors 266, 273 and 280.

Figure 13:
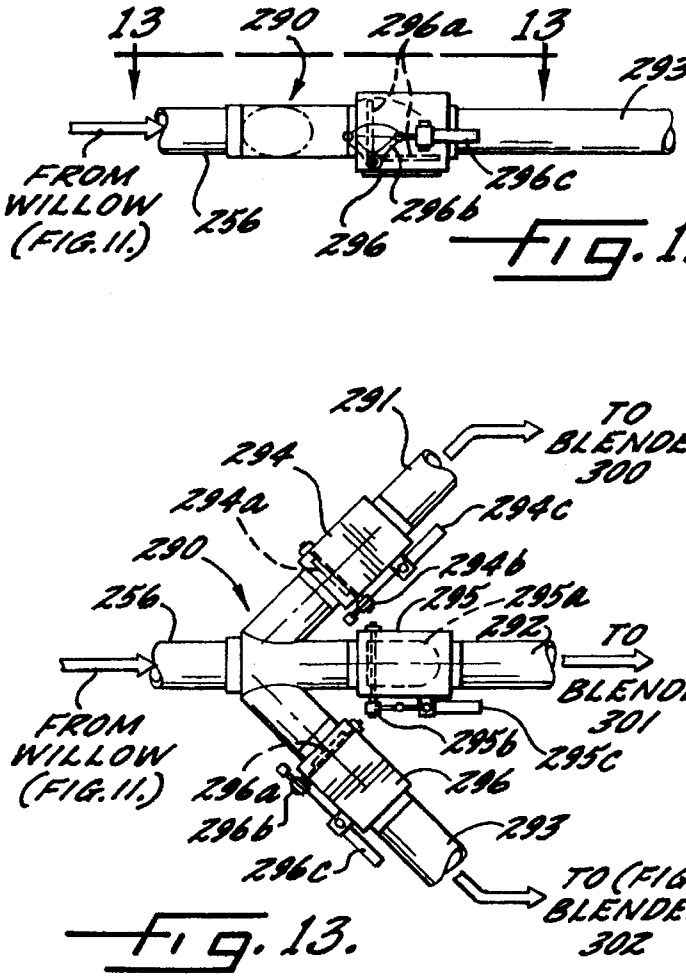
FIG. 13 is a fragmentary, somewhat schematic, plan view looking substantially in the direction of the arrows 13—13 in FIG. 12.

Conduit 256 supplies the mixture of cotton fibers and dry granular chemical fire retardant, or just the impregnated cotton fibers, to a distribution means 290 (FIG. 13) consisting of three conduits 291, 292 and 293. Conduits 291, 292 and 293 have pneumatically controlled flapper valves 294, 295 and 296 therein, respectively. The valves 294, 295 and 296 have flapper valve members **294*a*, 295*a*, 296*a* therein which are pivotally mounted and have crank arms 294*b*, 295*b*, 296*b* thereon. The crank arms 294*b*, 295*b* and 296*b* are operated by pneumatic cylinders 294c, 295c and 296*c*, respectively. The conduits 291, 292, and 293 are respectively connected to blender reserves 300, 301 and 302** for delivering treated cotton fibers into the blender reserves which collectively provide a continuous source of treated cotton fibers for subsequent processing.

Figure 12:
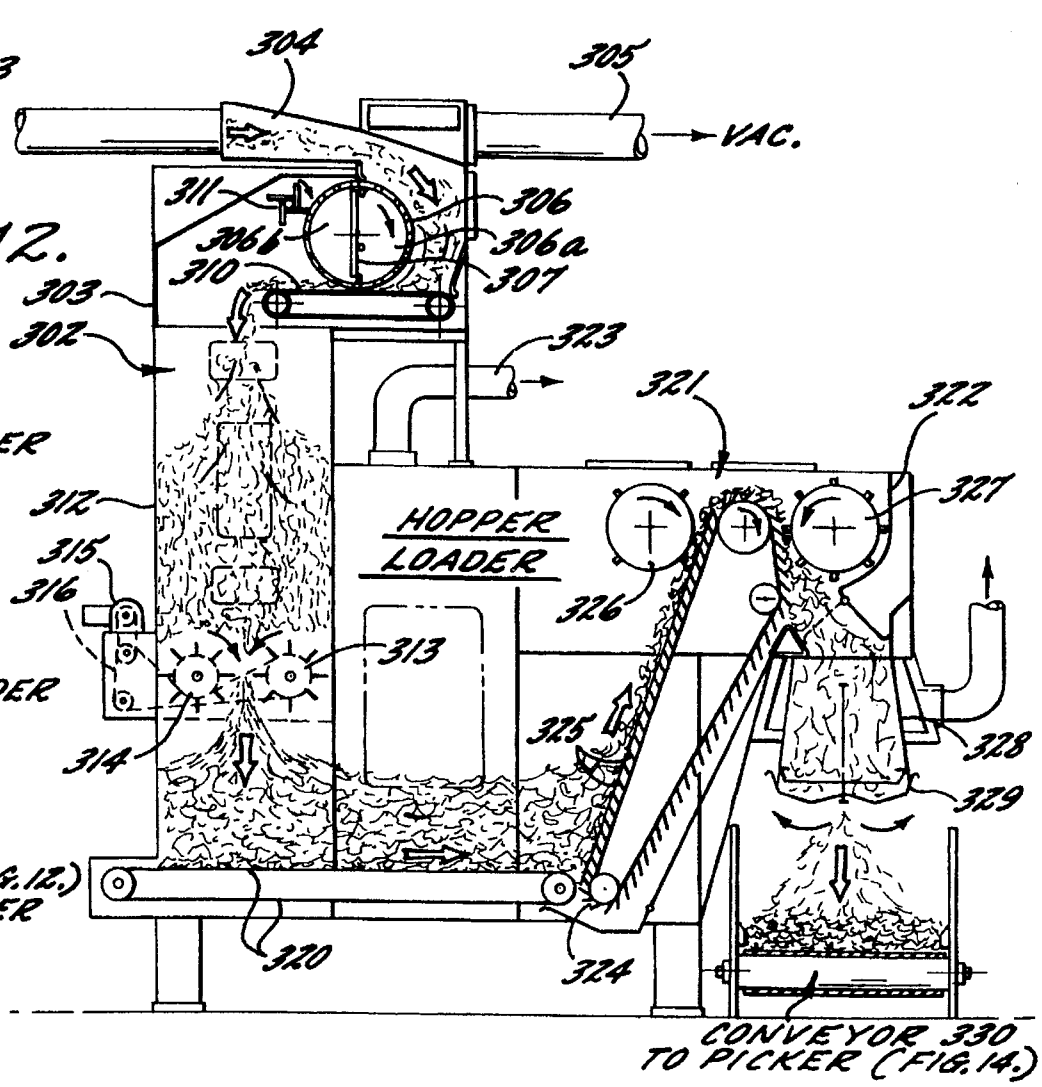
FIG. 12 is a fragmentary, somewhat schematic, sectional view taken substantially along line 12—12 in FIG. 1B.

The blenders 300, 301 and 302 are identical and therefore only blender 302 (FIG. 12) will be described in detail. Blender reserve 302 includes a housing 303 which includes an intake manifold 304 to which conduit 293 is connected. Also connected to the intake manifold 304 is a conduit 305 which is connected at its other end to a vacuum blower which feeds into the outside dust collector (not shown). Mounted inside the intake manifold 304 is a vacuum drum 306 having a perforated outer cylindrical surface which rotates in the direction of flow of the fibers passing into the manifold 304. A stationary separator member 307 is mounted inside the vacuum drum 306 with surface wipers on the opposite ends thereof for dividing the drum 306 into portions **306*a* and 306*b* and for isolating the portion 306*a* from the portion 306*b* thereof. Therefore, the vacuum is confined to portion 306*a* and portion 306*b* is at ambient pressure. The rotating vacuum drum 306 is connected in a manner not shown to the vacuum conduit 305**.

As the vacuum drum 306 rotates, the fibers entering the manifold 304 will collect on the surface of the vacuum drum 306 until the wiper member 307 shuts off the vacuum. At that time, the fibers will substantially release from the surface of the rotating vacuum drum 306 and drop onto a conveyor 310 disposed beneath the rotating vacuum drum 306. Should any fibers remain adhered to the surface of the rotating vacuum drum 306 as that surface forms a part of section **306*b*, a rotating doffer member 311 is disposed adjacent section 306*b* of the vacuum drum 306 to remove any residual fibers which may be adhered thereto and cause the same to drop onto conveyor 310. The fibers discharged by conveyor 310 fall by gravity into blender reserve 302 and collect in an upper portion 312 of housing 303. Mounted in the bottom of the upper housing portion 312 is a pair of worker rolls 313, 314 having vanes extending radially outwardly therefrom. Rolls 313, 314 are driven by a motor 315 and a drive belt 316 to remove fibers from the collected mass in upper housing portion 312 and cause the same to drop by gravity onto a discharge conveyor 320 mounted in the bottom of the volumetric reserve housing 303. Conveyor 320 extends out of the blender reserve 302 into a hopper loader 321 connected the blender reserve 302** and essentially forming an extension thereof.

The hopper loader 321 also includes a housing 322 to confine the fibers therein and has the upper portion of the housing 322 connected by a conduit 323 to the outside dust collection system (not shown). Conveyor 320 delivers the fibers from the volumetric reserve 302 to a worker belt 324 having teeth 325 on the outer surface thereof. Teeth 325 are disposed at an acute angle extending in the direction of travel of the worker belt 324. The teeth 325 on worker belt 324 pick up fibers from the end of conveyor 320 and carry the same upwardly to a worker roller 326. Roller 326 rotates counter to the direction of the worker belt 324 to ensure that the fibers carried pass the worker roller 326 by the worker belt 324 are opened and essentially are in nonclump form. A doffer roller 327 is disposed on the opposite side of the upper end of worker belt 324 to ensure removal of the fibers from the teeth 325 on worker belt 324 and to cause the same to fall by gravity into the discharge portion 328 of hopper loader 321. The discharge portion 328 includes a weight sensitive discharge means 329 for collecting therein a predetermined amount of fibers therein and then to dump the predetermined amount of fibers downwardly onto a conveyor 330 extending longitudinally beneath the three blender reserves 300, 301 and 302. Discharge means 329 is identical to discharge means 87 on bale breakers 72 heretofore described and will not, therefore, be described further.

Conveyor 330 extends rearwardly from the blender reserves 300, 301 and 302 beneath the discharges of two bale breakers 331 and 332 (FIG. 1*b*). Bale breakers 331 and 332 are identical to bale breaker 72*a* as shown in FIG. 2 and described hereinabove. Since bale breakers 331 and 332 are identical to bale breaker 72*a*, bale breakers 331 and 332 will not be described in detail again.

Bale breakers 331 and 332 include in-feed conveyors 333 and 334. In-feed conveyor 333 is supplied with bales B4 of springy fibers which have more resiliency and springiness than does the recycled cotton fibers to provide bulk or loft to the insulation material. Preferably, the springy fibers are a blend of nylon and polyester and are incorporated in the insulation material in an amount of about 15% by weight.

In-feed conveyor 334 supplying bale breaker 332 is provided with bales B5 of bonding fibers for bonding the insulation and springy fibers together into a batt of fibers which has sufficient structural integrity to maintain its batt form during handling and use. Preferably, the bonding fibers are bi-component with a polyester core and a polyester sheath. The polyester sheath has a lower melting point and therefore a lower bonding temperature than the polyester core. Other bi-component fibers may be employed such as, for example, a polyester core with a polyethylene sheath. Preferably, the bonding fibers are blended into the insulation material in an amount of about 10% by weight.

The weight sensitive discharge mechanisms on bale breakers 331 and 332 are adjusted to dump a sufficient quantity of the springy fibers and the bi-component fibers onto conveyor 330 which transports the bonding fibers and the springy fibers beneath the blender reserves 300, 301 and 302 where sufficient cotton insulation fibers are deposited by the weight sensitive discharge mechanisms on conveyor 330 to provide the preferred mix of 75% cotton fibers, 15% springy fibers and 10% bonding fibers.

The process of the present invention is sensitive to the volume of fire retardant impregnated cotton fibers that can be provided on a consistent and continual basis to the remainder of the process. In the embodiment of the present invention described hereinabove, the application of liquid fire retardant to the cotton fibers, the compression thereof in the bale press, the migration period, the drying of the wet cotton fibers and the mixing thereof with dry, granular fire retardant are time consuming and volume restrictive steps in this process.

Accordingly, in accordance with another embodiment of this invention, the steps of liquid fire retardant application, compression in the bale press, migration, drying and dry, granular fire retardant application are separated from the remainder of the process. In this other embodiment, the blender reserve 302 and hopper loader 321 are replaced by at least one bale press (not shown) which receives the fire retardant cotton fibers from conduit 256 and bales these cotton insulation fibers into bales. These bales may be stored for indeterminate time periods and used as needed to supply the remainder of the process with as much insulation fibers as can be processed by the remainder of the process. Additional shifts or duplicate processing lines may be employed for the impregnation and treatment of the recycled cotton fibers to provide a sufficient supply of the baled cotton insulation fibers. A sufficient number of the bale breakers (not shown) will be required to receive the bales of cotton insulation fibers and supply opened or loose cotton insulation fibers onto conveyor 330. Such bale breakers would be identical to bale breakers 72 and may be utilized with or without pre-openers 100.

Figure 14:
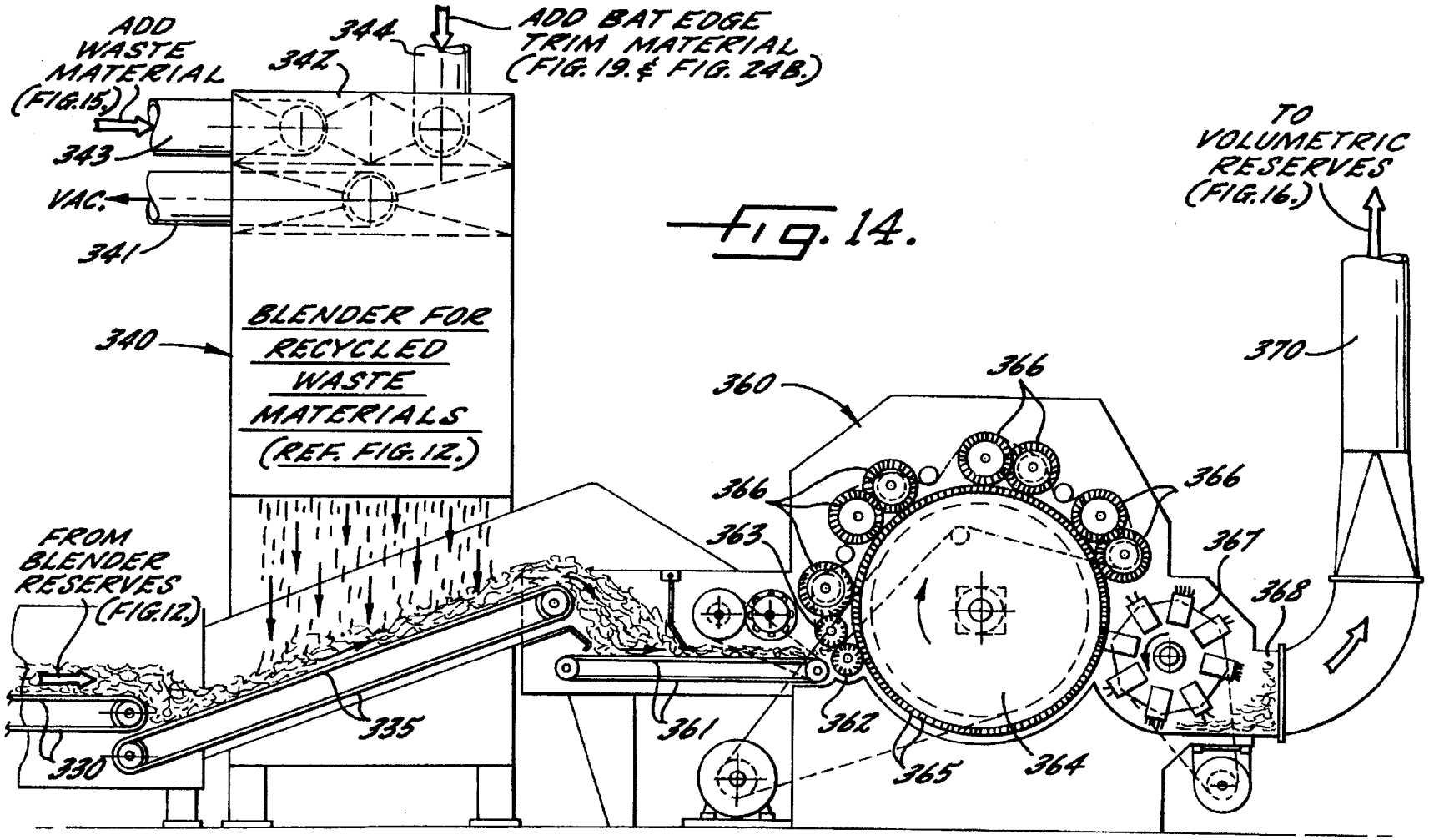
FIG. 14 is a fragmentary, somewhat schematic, sectional view taken substantially along line 14—14 in the lower medial portion of FIG. 1B.

Conveyor 330 extends forwardly from the blender reserve 302 or the bale breakers supplying the insulation fibers onto conveyor 330, and terminates above the rearward end of another conveyor 335 which receives the mixture of cotton insulation fibers, springy fibers and bonding fibers from the bale breakers 331, 332 and blender reserves 300, 301 and 302. Positioned above and discharging onto conveyor 335 is a waste blender reserve 340. Blender reserve 340 is substantially identical to blender reserve 302 and will not be described again in detail. Blender reserve 340 includes a vacuum conduit 341 which draws a vacuum on the in-feed portion 342 of the blender reserve 340. Blender reserve 340 includes two fiber intake conduits 343 and 344 also connected to the in-feed portion 342 of blender reserve 340 (FIG. 14).

Conveyor waste conduit 343 is connected at its other end to the discharge portion 345 of a fine opener 350. Opener 350 includes a picker cylinder 351 having wire clothing 352 on the outer periphery thereof and a pair of fluted in-feed rolls 353, 354. Waste fibrous material is dumped from suitable containers 356 in which the fibrous waste material is collected and deposited from various and sundry places within the plant and along the processing lines onto conveyor 355 which feeds the waste fibrous material to in-feed rollers 353, 354 which, in turn, feed the waste fibrous material to the picker cylinder 351 of opener 350. Picker cylinder 351 acting in conjunction with the in-feed rolls 353 and 354 open the waste fibrous material into a loose form which is discharged through the discharge portion 345 and into conduit 343. In this manner, substantially all of the fibrous waste material which will invariably occur from a fibrous processing line are recovered and recycled into the insulation material so that true waste is kept to a minimum.

Conduit 344 supplies blender reserve 340 with waste material that is recovered in the form of trimmings of the formed insulation material. Such trimmings are the result of processing steps which will be described hereinafter.

The waste fibrous material from both sources supplied to the blender reserve 340 by the conduits 343 and 344 are processed in the blender reserve in the same manner as described with respect to blender reserve 302 above. The processed fibers are then deposited by gravity onto the conveyor 335 which feeds the total mass of fibers including the recycled cotton insulation fibers treated with the two types of fire retardant, the springy fibers, the bonding fibers and the waste fibers from the discharge end thereof into a picker 360.

Picker 360 includes an in-feed conveyor 361 which receives the mixture of fibers from conveyor 335 and feeds the same to a pair of in-feed rolls 362, 363. Picker 360 includes a worker cylinder 364 having conventional wire clothing 365 on the periphery thereof. A plurality of rotating worker rolls 366 are provided around the upper periphery of cylinder 364 which co-act with the cylinder 364 to thoroughly comb and blend the mixture of fibers supplied to picker 360 by conveyer 335. A doffer roll 367 is provided on the opposite side of cylinder 364 from in-feed rolls 362, 363 for removing the fibers from the clothing 365 of cylinder 364 and feeding the same into a discharge portion 368. Picker 360 is of conventional construction and different forms of this textile machine are manufactured by different manufacturers well known to persons skilled in this art.

A pneumatic conveying conduit 370 is connected at one end to the discharge portion 368 of picker 360 for receiving the blended fiber mixture from the picker 360 and conveying the same to a pair of volumetric reserves 371, 372. (FIG. 1*b*). Conduit 370 includes a gate valve 373 therein and has connected thereto another conduit 374 which feeds the blended fiber mixture into volumetric reserve 371 when the gate valve 373 is closed. When the gate valve 373 is open, conduit 370 extends to volumetric reserve 372 and feeds fibers directly into volumetric reserve 372. When gate valve 373 is open, it closes the in-feed end of branch conduit 374.

Since volumetric reserves 371 and 372 are identical, only the volumetric reserve 372 will be described in detail. Volumetric reserve 372 includes an in-feed section 375 which receives fibers from conduit 370 when gate valve 373 is open. In-feed section 375 includes a vacuum cylinder 376 which is identical to vacuum cylinder 306 of the blender reserves 300, 301 and 302. Cylinder 376 has the outer periphery thereof perforated with an internal stationary wiper member 377 and a rotating wiper member 378. Vacuum is drawn on the cylinder 376 by means of a conduit 379 connected to a source of suction and to the outside dust collection system.

A conveyer 380 receives the fibers from the cylinder 376 and delivers the same into the main portion of the volumetric reserve 372 where the same drop downwardly by gravity and collect in the volumetric reserve in such manner that an ample supply of blended fiber mixture is held in reserve such that further processing will have an ample and adequate supply of fibers readily available for such further processing.

Volumetric reserve 372 includes a conveyor 381 in the bottom portion thereof for receiving and feeding the blended fiber mixture to an endless worker belt 382 having wire teeth 383 extending outwardly from the outer surface thereof and angled in the direction of rotation of the belt 382. The wire teeth 383 pick up and remove fibers from the mass of fibers held in the volumetric reserve 372 and carry the same upwardly to a worker roll 384 rotating counter to the direction of movement of the belt 382. A doffer roll 385 is disposed on the opposite side of belt 382 to remove the fibers from the teeth 383. The removed fibers drop by gravity through the discharge portion 386 of volumetric reserve 372. The fibers discharged from the discharge portion 386 of volumetric reserve 372 fall into a fine opener 390.

Fine opener 390 includes an in-feed conveyor 391 which receives the fibers from the discharge portion 386 of volumetric reserve 372 and delivers the same in co-action with a presser roll 392 to a pair of in-feed rollers 393, 394. In-feed rollers 393, 394 feed the fibers to a picker cylinder 395 having wire clothing 396 on the outer periphery thereof. The fibers from the volumetric reserve are thus opened within fine opener 390 which discharges the fibers through a discharge portion 397 into a pneumatic conveying conduit 400.

Volumetric reserve 371 also includes a fine opener 398 which is identical in construction to fine opener 390 and delivers fibers from the volumetric reserve 371 into conduit 400 (FIG. 1B).

Figures 15, 17:
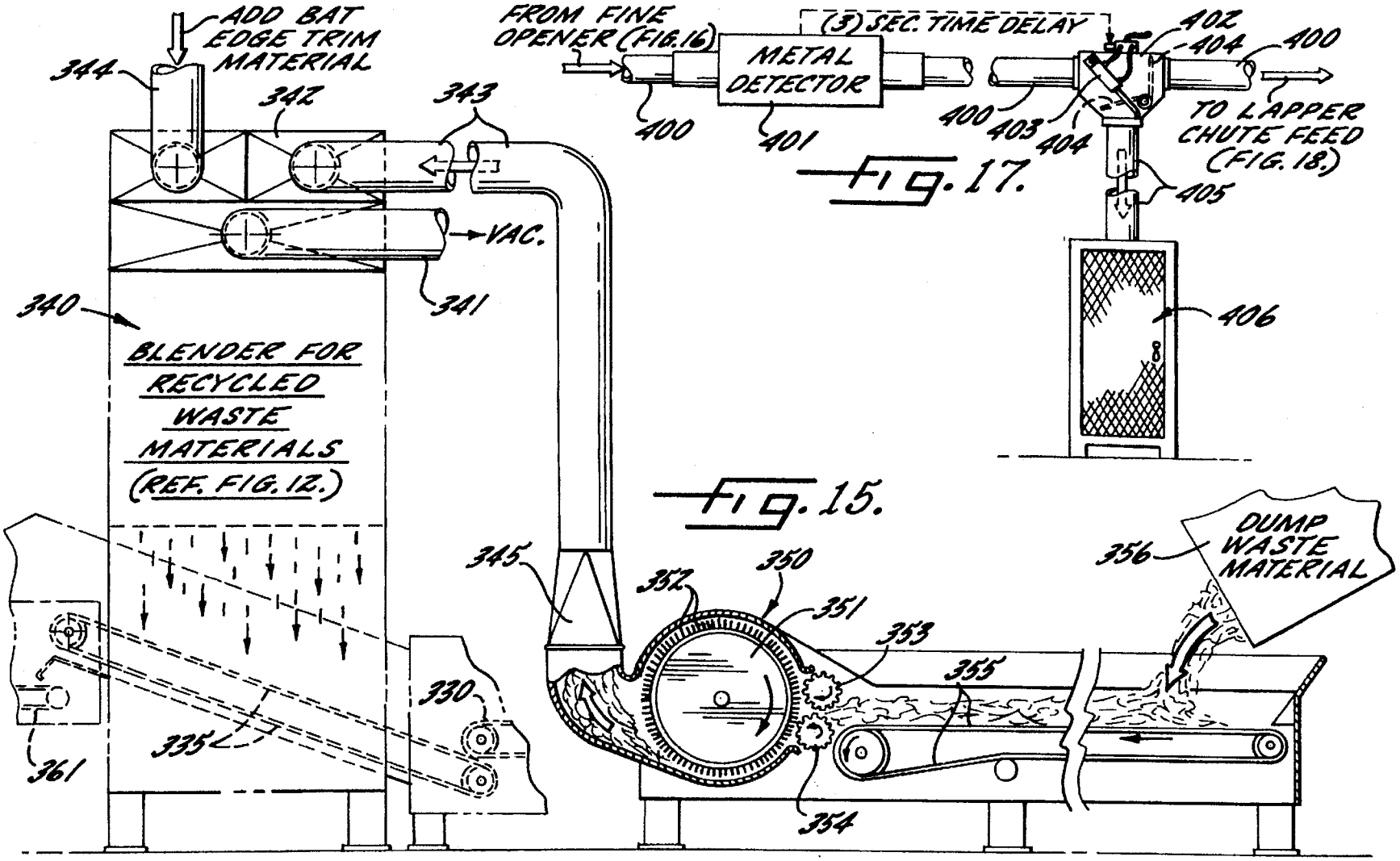
FIG. 15 is a fragmentary, somewhat schematic, sectional view taken substantially along line 15—15 in FIG. 1B.
FIG. 17 is a fragmentary, somewhat schematic, elevational view looking in the direction of the arrows 17—17 in the medial portion of FIG. 1B.
Figure 16:
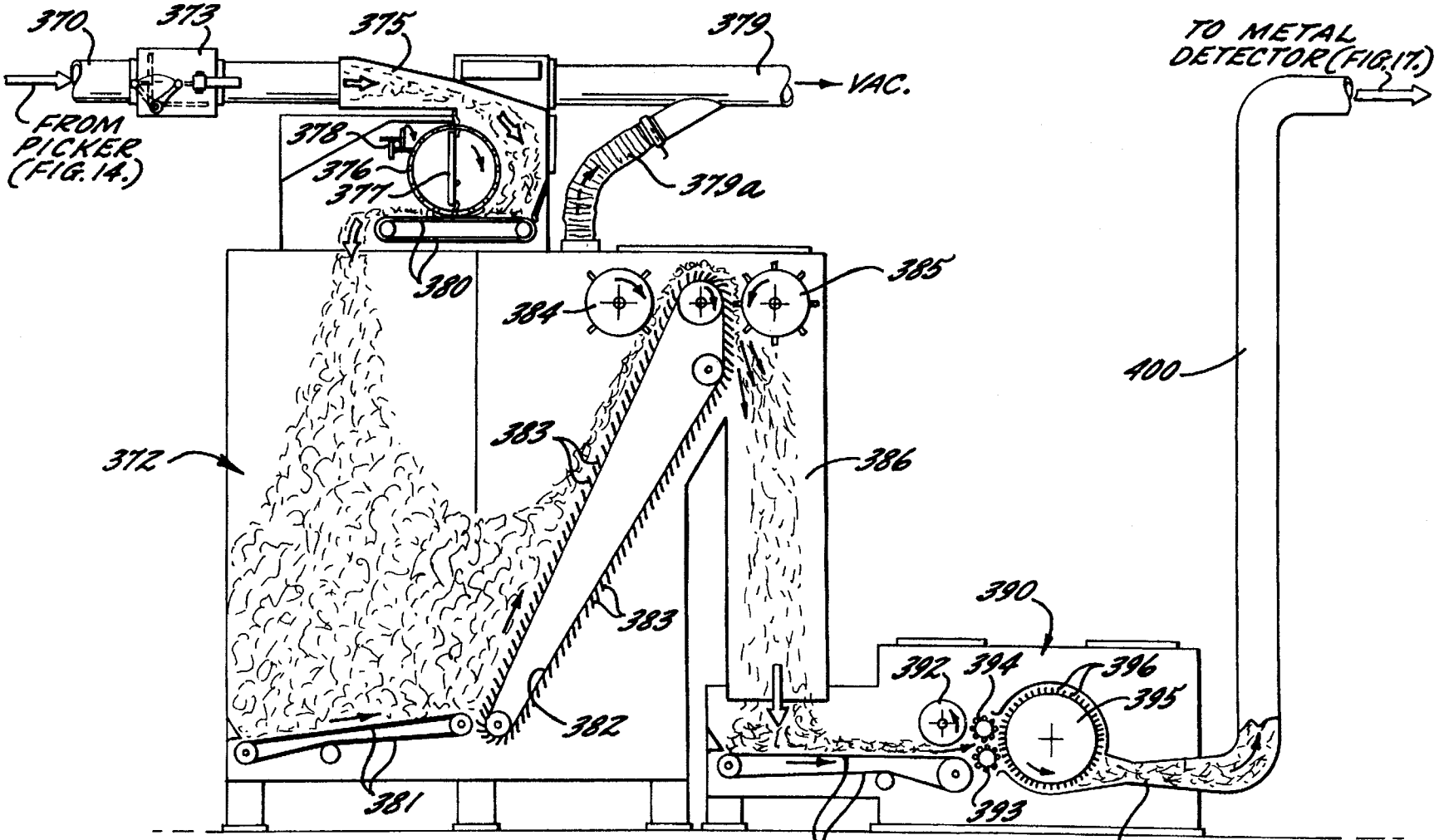
FIG. 16 is a fragmentary, somewhat schematic, sectional view taken substantially along lines 16—16 in FIG. 1B.

Conduit 400 extends through a metal detector 401 which detects whether or not the mass of fibers being pneumatically conveyed through conduit 400 has any metal particles or the like therein (FIGS. 1B and 17). Metal detector 400 is connected to a gate valve 402 which is mounted in conduit 400 downstream of metal detector 401 and is controlled by metal detector 401. Upon activation, a pneumatic cylinder 403 is actuated to pivot a gate 404 of gate valve 402 to close conduit 400. A branch conduit 405 is connected to gate valve 402 to receive the stream of fibers and any metallic particles from conduit 400 when gate valve 402 is closed. The opposite end of conduit 405 is connected to a dump box or repository 406 for the fibrous material containing the metal particles. The metal particles are subsequently removed from the material within the dump box 406 and the fibrous material is returned through the waste fine opener 350 and reserve 340 to the stream of fibers. Preferably, there is a three second delay during which the gate valve 402 is closed which is sufficient for any detected metal particles to be diverted to dump box 406, and thereafter the gate valve 402 is again opened by reversal of the pneumatic cylinder 403 to permit the stream of blended fibrous material to continue being conveyed through conduit 400.

Conduit 400 is connected through a booster fan 407 and gate valves **408*a* and 408*b* to chute feeds 410*a*, 410*b* and 410*c*. Conduit 400 extends through the gate valves 408*a* and 408*b* to the chute feed 410*a*. Branch conduits 400*a* and 400*b* extend from gate valves 408*a* and 408*b* to chute feeds 410*b* and 410*c***, respectively.

Figure 18:
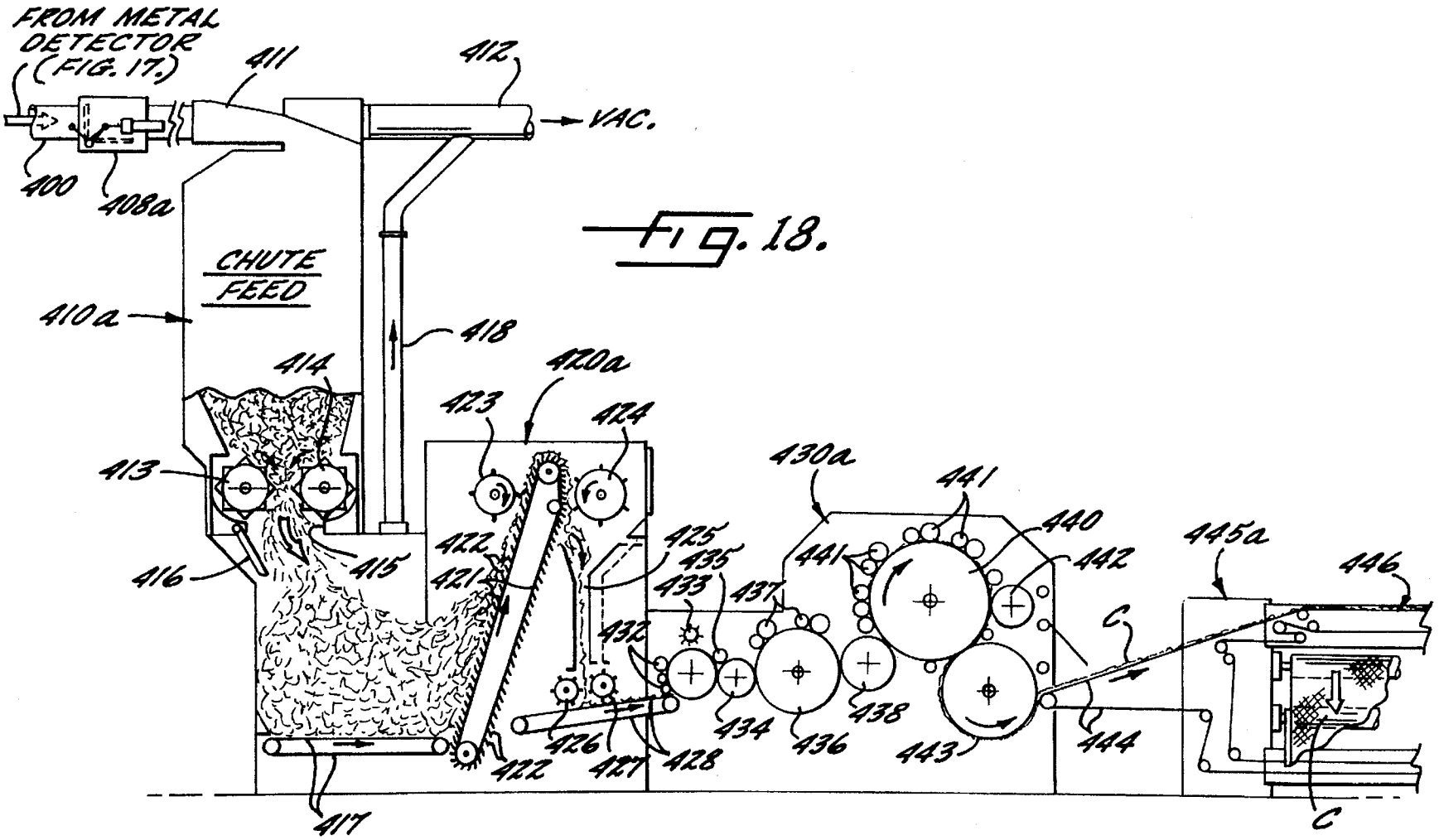
FIG. 18 is a fragmentary, somewhat schematic, elevational view, with portions broken away, looking substantially in the direction of the arrows 18—18 in the right-hand medial portion of FIG. 1B.

The chute feeds **410*a*, 410*b* and 410*c* are identical and therefore only chute feed 410*a* will be described. Chute feed 410*a* has an in-feed section 411 which is similar in construction to the inlet section 375 of volumetric reserve 372 (FIG. 18). Since the in-feed section 411 of chute feed 410*a* is like that of volumetric reserve 372, it will not be described in detail herein. The in-feed section 411 has a vacuum conduit 412 connected thereto which draws a vacuum on the in-feed section 411. The in-feed section 411 feeds the blended fiber mixture into the main portion of chute feed 410*a* where the same moves downwardly by gravity to a pair of star delivery rolls 413, 414 which assist in delivering the fibers from a discharge opening 415 in the chute feed housing past a closure member 416 downwardly onto a discharge conveyor 417. A vacuum conduit 418 is connected to chute feed 410*a* for removing dust and the like from the discharge section of the chute feed 410*a*. Conduit 418 is connected to the vacuum conduit 412** and delivers the air stream to the dust collection system (not shown).

Discharge conveyor 417 delivers the fibers into a hopper loader **420*a* which includes a endless worker belt 421 having wire teeth 422 on the periphery thereof. A worker roller 423 is mounted adjacent the upper end of worker belt 421 and is rotated counter to the direction of travel of the conveyor belt 421. A doffer roller 424 is disposed on the opposite side of conveyor belt 421 from worker roller 423 and serves to doff the fibers from the wire clothing 422 on belt 421. The removed fibers drop by gravity into a discharge chute 425. A pair of delivery rolls 426, 427 are mounted at the bottom of discharge chute 425 for feeding the fibers from the lower end of discharge chute 425 onto a discharge conveyor 428**.

Chute feeds 410*b* and 410*c* have hopper loaders 420*b* and 420*c* (FIG. 1B) to which the chute feeds 410*b*, 410*c* deliver the insulation fibers. The hopper loaders 420*a* , 420*b* and 420*c* are connected to roller card machines 430*a*, 430*b* and 430*c* to which the hopper loaders deliver the insulation fibers. The roller cards are identical and therefore only card 430*a* will be described in detail.

Card 430*a* includes a licker-in cylinder 431 having worker rolls 432 associated therewith for feeding the fibers from the conveyor 428 into the card 430*a*. A spline roller 433 is mounted above licker-in cylinder 431 and co-acts therewith to feed forwardly the fibers received from the conveyor 428 to a first worker cylinder 434 having a worker roll 435 associated therewith. A second worker cylinder 436 receives the fibers from the first worker cylinder 434 and has worker rollers 437 associated therewith. A third worker cylinder 438 is positioned between the second worker cylinder 436 and the main worker cylinder 440. Main worker cylinder 440 has a series of worker rolls 441 spaced around the periphery thereof and including a final worker cylinder 442 that is disposed immediately upstream of the doffer cylinder 443 which doffs the carded fibrous web from the main cylinder 440. The doffer 443 delivers the carded web C from the card 430*a* onto a conveyor belt 444 of a cross-lapper machine 445*a* (FIG. 1B).

As there are three cards 430*a*, 430*b* and 430*c* there are three cross-lappers 445*a*, 445*b* and 445*c*. The cross-lappers are identical and therefore only the cross-lapper 445*a* will be described.

Figure 19:
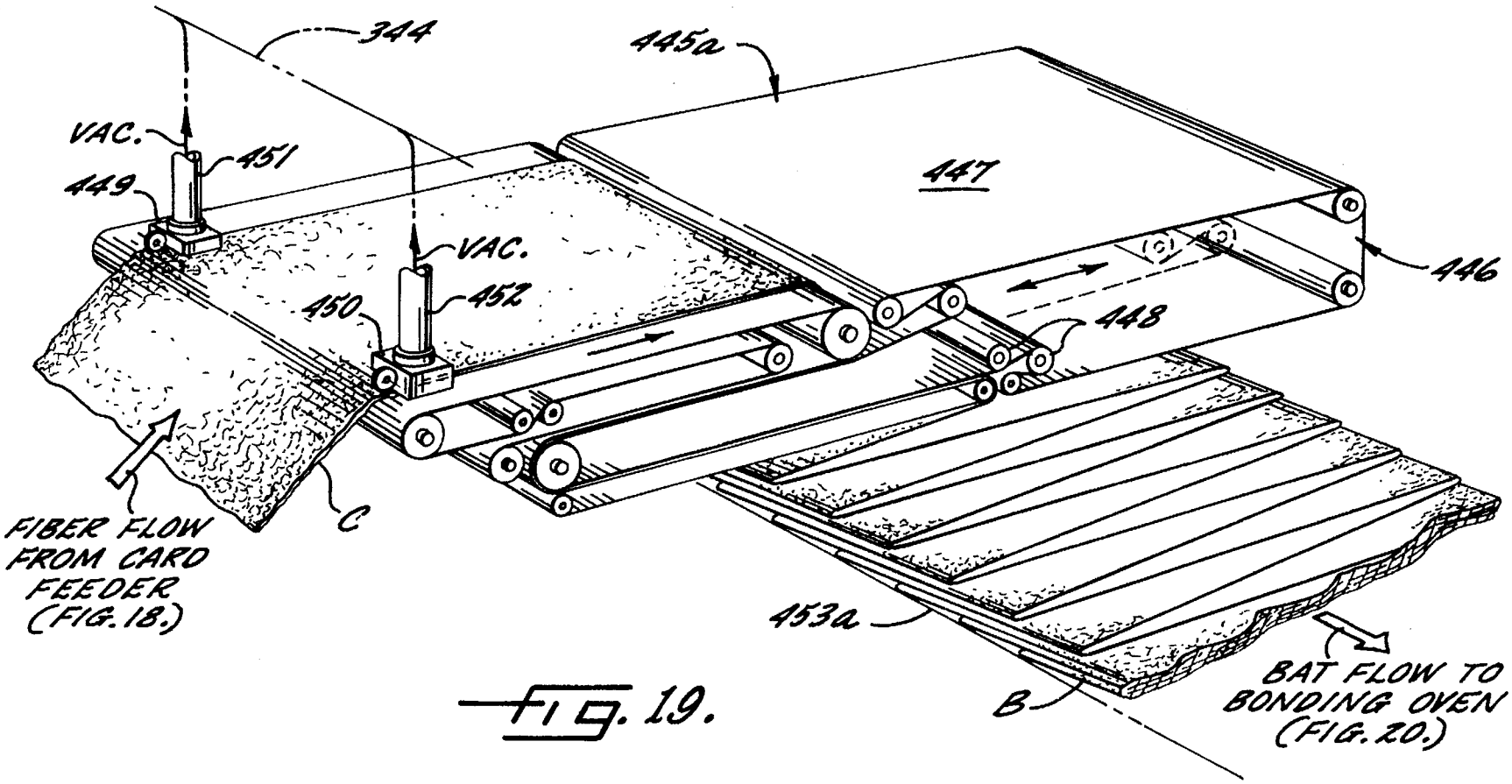
FIG. 19 is an enlarged fragmentary perspective view illustrating the operation of the cross-lappers shown in the right-hand portion of FIG. 1B.
Figure 20:
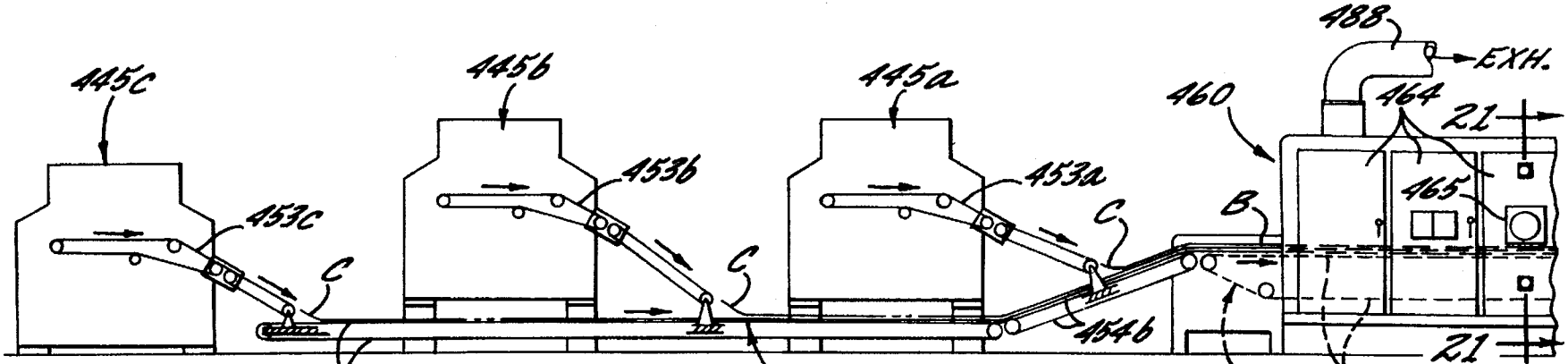
FIG. 20 is a fragmentary, somewhat schematic, side elevational view looking substantially in the direction of the arrows 20—20 in the right-hand portion of FIG. 1B.
Figure 21:
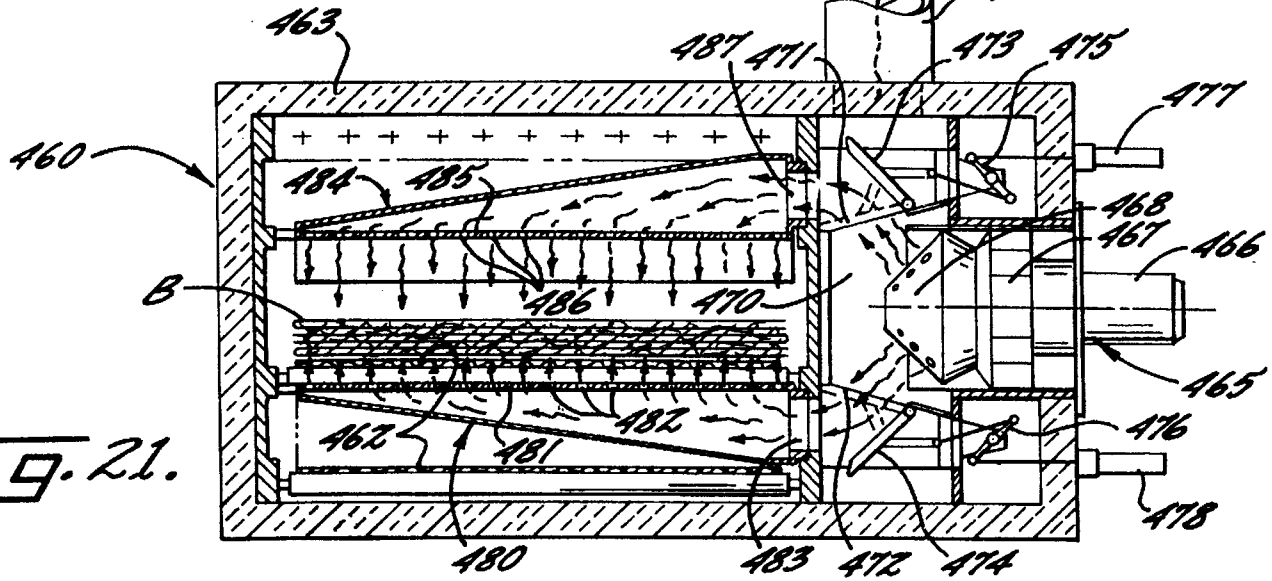
FIG. 21 is an enlarged fragmentary, somewhat schematic, sectional view taken substantially along line 21—21 in FIG. 1C.
Figure 20A:
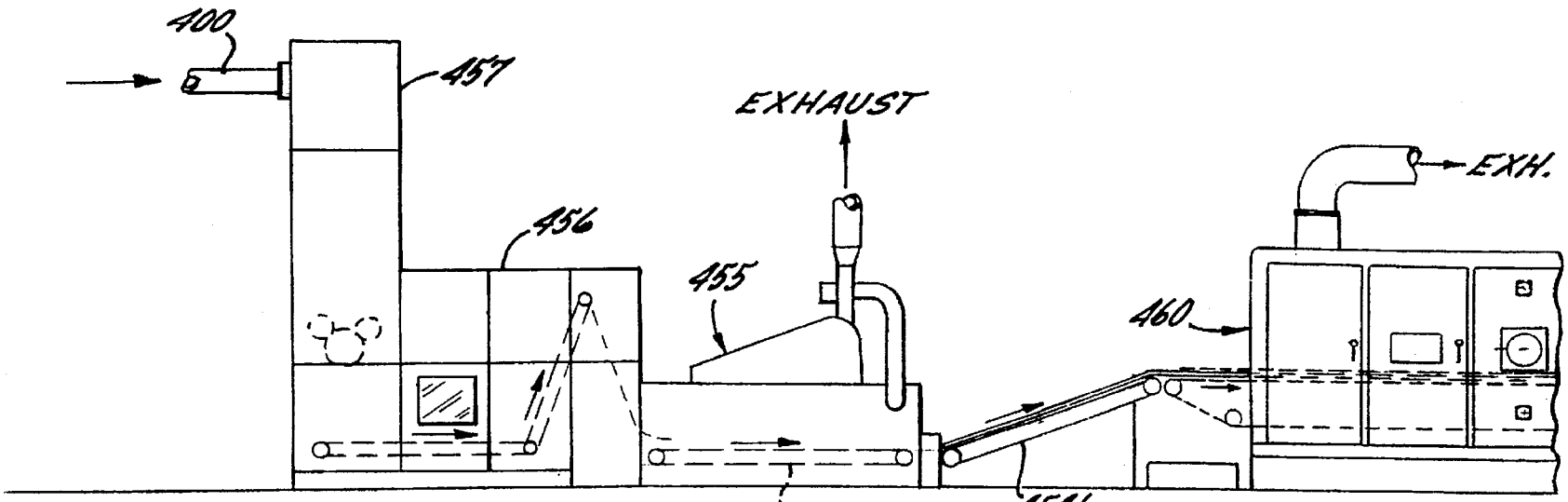
FIG. 20A is a view similar to FIG. 20 of the alternative embodiment shown in FIG. 1D.
Figure 22:
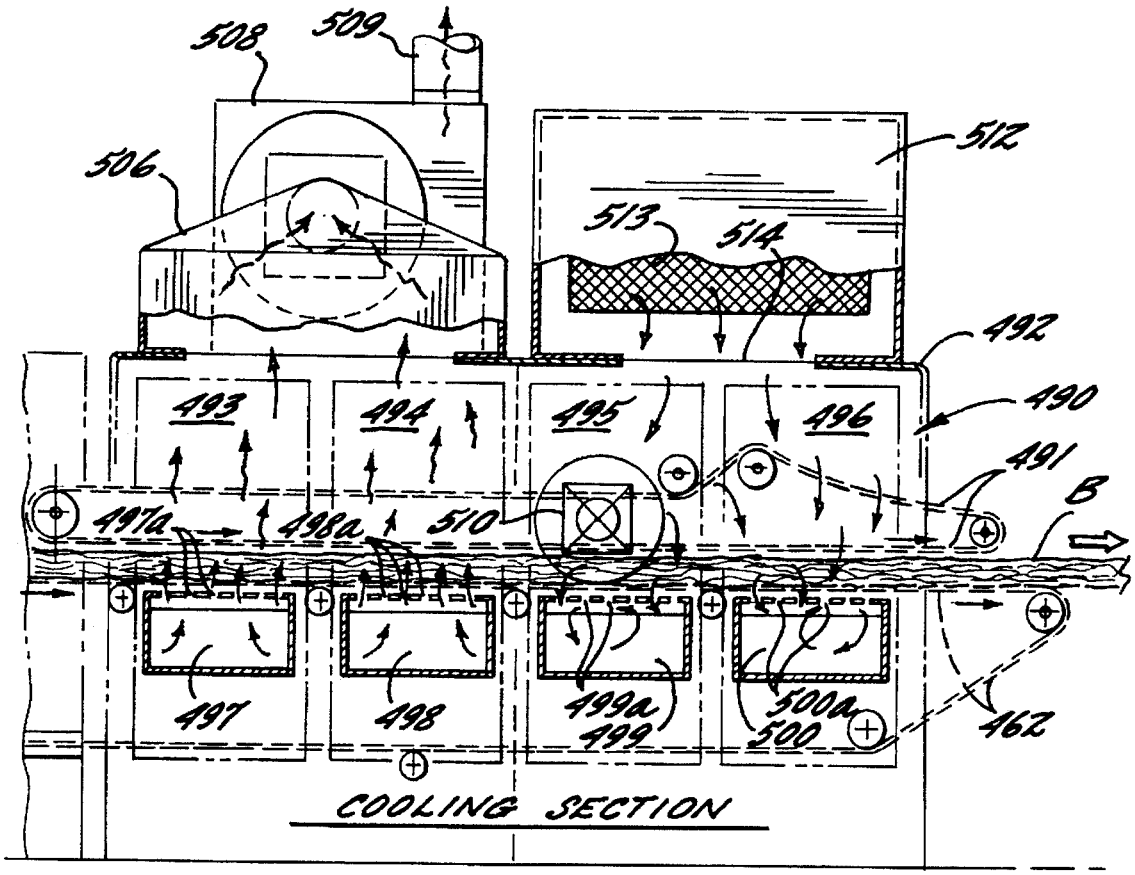
FIG. 22 is a fragmentary, somewhat schematic, sectional view taken substantially along line 22—22 in FIG. 1C.

Cross-lapper 445*a* includes a conveyor system 446 including an endless belt 447 and a reciprocating roll arrangement 448 (FIG. 19). A pair of edge trimmers 449, 450 are provided at opposite sides of the conveyor 446 to trim the edges of the card web C being delivered by the card 430*a* to the cross-lapper 445*a*. Edge trimmers 449, 450 include vacuum conduits 451, 452 for capturing the trimmings from the edges of the card web and recycling these trimmings back through conduit 344 to the waste blender reserve 340. The conveyor 446 of each cross-lapper 445*a*, 445*b* and 445*c* receives the card web C, as trimmed by the edge trimmers 449 and 450, and delivers the same to the reciprocating roll arrangement 448 which reciprocates back and forth across a batt conveyor 453*a*, 453*b* or 453*c* (FIG. 20).

The batt conveyors 453*a*, 453*b* and 453*c* have a composite web conveyor 454 extending beneath each of the batt conveyors 453*a*, 453*b* and 453*c* to receive the cross-laps in superposed relation thereon. The speed of travel of the composite web conveyor 454 can be adjusted relative to the speed of the batt conveyors 453*a*, 453*b* and 453*c* such that a multilayer cross-lapped web of the desired thickness to provide the requisite R value (insulating value) for the particular insulation material being formed is produced. These insulating R values can vary from relatively low, such as R3, to relatively high, such as R30 or higher.

Composite web conveyor 454 is formed in two sections, the first section being referred to as 454*a* and the second section being referred to as 454*b*. The cross-lapper 445*c* delivers its cross-lapped web of blended fibers onto the rear end portion of conveyor section 454*a* and cross-lapper 445*b* delivers its cross-lapped web onto conveyor section 454*a* in the medial portion thereof on top of the cross-lapped web from cross-lapper 445*c*. The superposed cross-lapped webs from cross-lappers 445*c* and 445*b* are delivered by conveyor section 454*a* onto conveyor section 454*b* where cross-lapper 445*a* delivers its cross-lapped web into superposed relation to the previously superposed cross-lapped webs. The three cross-lapped webs together form a composite web of a thickness to provide the desired R value and a width sufficient to form a plurality of individual insulation batts. One example of the thickness of the composite web is five and three quarters (5 ¾) inches to provide a R19 value and an example of the width is approximately twelve (12) feet.

Figure 18A:
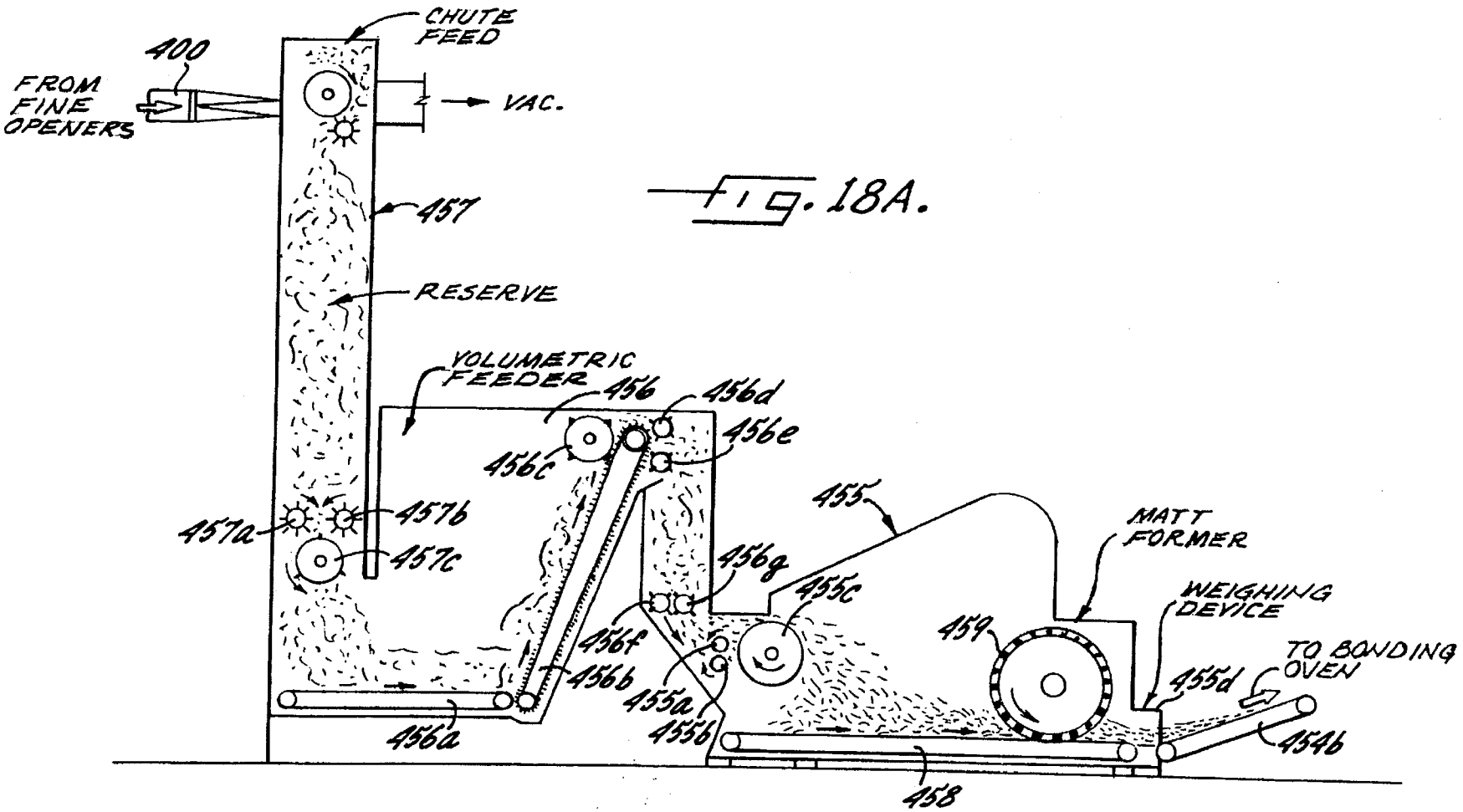
FIG. 18A is a view similar to FIG. 18 of the alternative embodiment of FIG. 1D taken substantially along line 18A—18A in FIG. 1D.

In accordance with a further embodiment of the present invention, alternate composite web forming means may be used. Such an alternate composite web forming means is an air lay matt former 455, which is connected to the discharge of a volumetric feeder 456, which in turn is connected to a chute feed 457 (FIG. 18A). Chute feed 457 is connected to conduit 400 and receives fibers therefrom. Chute feed 457 delivers the fibers from the bottom end thereof past metering rolls 457*a*, 457*b* and 457*c*. A conveyor belt 456*a* feeds the fibers from the chute feed 457 to a worker belt 456*b* and past worker rolls 456*c*, 456*d* and 456*e* . The fibers fall by gravity to a pair of discharge rolls 456*f* and 456*g* which discharge the fibers into the intake section of the air lay matt former 455.

Air lay matt former 455 includes a pair of feed rolls 455*a* and 455*b* and a feeding drum 455*c* which feeds the fibers upwardly into an air stream flowing through the air lay matt former 455. A conveyor belt 458 in the bottom of the air lay matt former 455 receives some of the fibers which fall thereon by gravity. The remainder of the fibers are attracted to and form on the periphery of a matt forming drum 459. Drum 459 is hollow and has the outer periphery perforated. A vacuum is drawn on the interior of the drum 459 in a manner not shown to attract and cause the fibers to form on the periphery thereof. Drum 459 is vertically adjustable relative to conveyor belt 458 in a manner not shown to vary and control the thickness of the matt of fibers being formed. The discharge side of the drum 459 has the perforations in the periphery thereof masked in a manner not shown to release the fibers therefrom. The formed matt or batt of insulation material is discharged through a weighing device 455*d* which weighs the batt of insulation material to ensure that it is properly formed. Housing 456 has a pair of perforate drums 457 in the lower portion of the housing 456. The conveyor belt 458 delivers the thus formed composite web for further processing.

In this embodiment, the air lay matt former 455 replaces the cross-lappers 445*a*, 445*b*, 445*c*; the cards 430*a*, 430*b*, 430*c*; the hopper loaders 420*a*, 420*b*, 420*c* and the chute feeds 410*a*, 410*b*, 410*c*. Accordingly, the air lay matt former 455 is more economical and requires less edge trimming than do the cards 430*a*, 430*b*, 430*c* and the cross-lappers 445*a*, 445*b*, 445*c*.

The composite web of insulation material on conveyor belt 454*b* or 457 is then delivered to an oven generally indicated at 460. Oven 460 includes a conveyor 461 which receives the composite web from conveyor section 454*b* or conveyor 457 and conveys the same through the bonding oven 460. The conveyor 461 comprises an endless conveyor belt 462 which is perforate to permit the flow of heated air therethrough. Bonding oven 460 includes an insulated housing 463 having a plurality of access doors 464 in one side thereof. Medially disposed in one side of the bonding oven 460 is a hot air blower 465. Hot air blower 465 includes a motor 466 driving a fan 467. 0n the outlet side of fan 467 is a heater 468 which receives the air from the fan 467 and heats the same to the requisite temperature. The heated air exits the heater 468 through suitable openings in the housing thereof.

The blower 465 and heater 468 are confined in a chamber 470 which has outlet openings 471 and 472 therein through which the heated air escapes. Suitable dampers 473 and 474 are pivotably mounted adjacent the openings 471, 472 for controlling the delivery of hot air from the chamber 470 through the openings 471, 472. The damper members 473, 474 are connected to pivoted linkages 475, 476 which in turn are connected to push-pull operating members 477, 478 for manual control of the dampers 473, 474.

A bottom plenum 480 is provided beneath the upper run of conveyor belt 462 and is hollow with an upper wall 481 which has perforations 482 throughout the upper wall to permit hot air to escape through the upper wall 481 upwardly against and through the upper run of conveyor belt 462. Bottom plenum 480 has an inlet opening 483 communicating with opening 472 to receive hot air from opening 472 for distribution across the entire upper run of conveyor belt 462 carrying the composite web of insulation material.

Bonding oven 460 also includes an upper plenum 484 disposed above the upper run of conveyer belt 462 a sufficient distance such that the composite web can pass therebeneath. Upper plenum 484 has a bottom wall 485 which has perforations 486 therein for directing heated air downwardly onto the composite web of insulation material. To that end, upper plenum 484 has an inlet opening 487 which communicates with opening 471 to receive heated air from the chamber 470 and to transmit the heated air across the full width and length of conveyor belt 462 in the bonding oven 460.

Bonding oven 460 has an exhaust conduit 488 which removes the used heated air from the bonding oven 460. The exhaust conduit 488 may be reconnected to the inlet for the heater 465 or it can be connected to the dryers upstream of the bonding oven 460 such that the residual heat in the air removed from the bonding oven 460 is not lost.

The temperature in the bonding oven 460 is sufficient to soften or melt the sheaths of the bi-component fibers and cause the bi-component fibers to bond to adjacent springy and cotton fibers. However, the temperature in bonding oven 460 is not so high as to soften or melt the core of the bi-component fibers or the polyester or nylon springy fibers. Due to the bonding of the bi-component fibers with the other fibers in the composite web, the composite web is converted into a self sustaining, wide batt of insulation material.

From the bonding oven 460, conveyor 462 extends into and through a cooling section 490. A top conveyor 491 extends through cooling section 490 above conveyor 462 so as to compress the batt of insulation material between the upper run of conveyor 462 and the lower run of conveyor 491. Conveyor 491 is also perforate such that air can readily pass therethrough.

Figure 23:
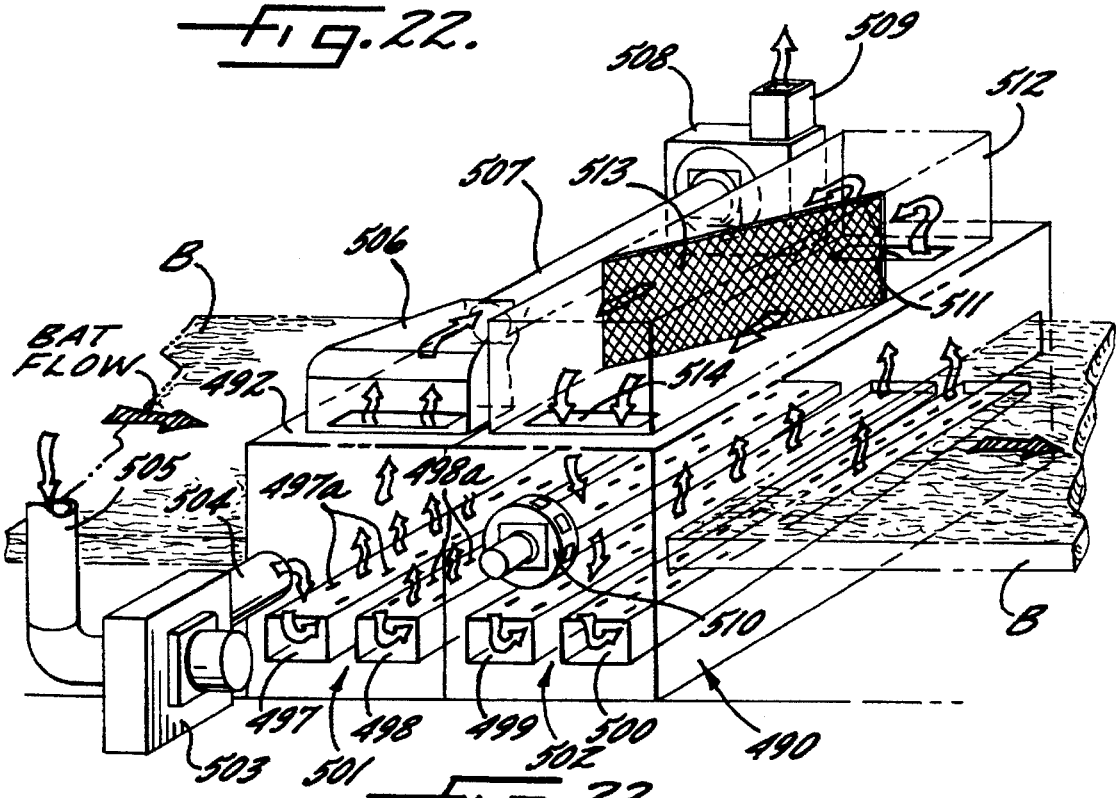
FIG. 23 is a fragmentary, somewhat schematic, perspective view of the cooling section shown in FIG. 22.

Cooling section 490 includes a housing 492 having a plurality of internal sections 493, 494, 495 and 496 through which the conveyors 462 and 491 pass. The sections 493–496 include plenums 497, 498, 499 and 500 running the full width of the conveyors 462 and 491. The upper walls **497*a*, 498*a*, 499*a* and 500*a* of plenums 497–500 are perforated for directing an air stream upwardly from the plenums against the upper run of lower conveyor 462. Plenums 497 and 498 communicate through one-end thereof with an air intake section 501 at one end of the cooling section 490 and plenums 499 and 500 communicate with a second air intake section 502 at that same end of cooling section 490. Air intake section 501 is connected to an air blower 503 by a conduit 504. The intake side of blower 503 has an air supply conduit 505 connected thereto for supplying ambient air from outside the plant to the blower 503 which in turn forces such air into the intake section 501. The air entering the intake section 501 is forced into the plenums 497, 498 and travels along the plenums 497, 498 to the opposite ends thereof, while some of the air is forced upwardly through the perforations in upper walls 497*a*, 498*a* and passes through the conveyors 462 and 491 and the composite web of insulating material. The air passing through the composite web from plenums 497 and 498 travels along the sections 493, 494 of cooling section 490 to the end thereof proximate the intake section 501 where the same pass upwardly into a collection manifold or plenum 506 (FIG. 23). A conduit 507 connects manifold 506 to an exhaust blower 508. Exhaust blower 508 delivers the air into a conduit 509** which is connected to the dust collection system (now shown)

Section 492 of cooling section 490 has the intake section 502 thereof connected to one end of plenums 499 and 500. An air blower 510 provides for air circulation through intake section 502, plenums 499 and 500 and upwardly through the perforate upper walls **499*a*, 500*a* and through the perforate conveyors 462 and 491. The air in section 492 passes upwardly through an exhaust opening 511 at the opposite end of section 492 from intake section 502 into a manifold or plenum 512. A filter 513 is disposed laterally across plenum 512**, preferably at an angle.

When reaching the end of the manifold or plenum 512 above the intake section 502, the air stream enters the intake section 502 through an inlet opening 514. The blower 510 creates a suction in the plenum 512 such that air is drawn along the plenum 512 from opening 511 and is forced downwardly into the plenums 499 and 500.

In this manner, cooling air is forced through the foraminous conveyors 462 and 492 and the batt of insulating material to lower the temperature thereof to cause the sheaths of the bi-component fibers to solidify and bond the various fibers together into a wide batt. The batt exits the cooling section 490 at a sufficiently low temperature that the same may be readily further processed and handled without concern for the integrity of the bonded together fibers.

The wide batt of bonded insulation material is fed from the cooling section 490 by the conveyors 462 and 491 and is delivered to a conveyor 520 by a pair of feed rolls 521 and 522. A support plate 523 extends from the delivery end of conveyer 462 to closely adjacent to the feed roll 521 beneath the wide batt to support the batt between the conveyor 462 and the feed roll 521.

A secondary applicator of liquid fire retardant is generally indicated at 524 and includes a trough 525 containing the liquid fire retardant. Trough 525 is mounted on pneumatic cylinders 526 and 527 beneath the roll 521. In this manner, trough 525 may be raised to its operative position in which the lower portion of feed roll 521 is immersed in the liquid fire retardant and to a lowered position where the trough 525 is spaced downwardly from the feed roll 521 so that the feed roll 521 does not contact the liquid fire retardant within trough 524. An excess liquid wiper member 528 is provided on trough 525 along one side thereof and is in contact with the periphery of feed roll 521, when trough 525 is in the raised, operative position, to wipe excess liquid fire retardant from the surface of the roll 521 before feed roll 521 contacts the bottom surface of the wide batt of insulation.

Secondary fire retardant application means 524 is preferably used to add liquid fire retardant to the bottom surface of the wide batt when no backing material is to be applied to the batt. Such additional fire retardant chemicals will provide an extra measure of fire retardancy to the insulation material. If a backing member is to be applied to the batt, the trough 525 should be lowered to the inactive position and no additional fire retardant chemical will be applied to that surface of the batt.

The feed rolls 521 and 522 deliver the wide batt to conveyor 520 which feeds the batt along its path of travel. Adjacent the upstream end of conveyor 520, a stanchion 530 supports another secondary liquid fire retardant applying means 531 which includes a plurality of spray nozzles 532, a control valve 533, an air supply 534 and a supply of liquid fire retardant chemicals 535. When activated, the nozzle 532 sprays liquid fire retardant chemicals downwardly onto the upper surface of the wide batt of insulation material in similar manner to the application of the liquid fire retardant by means 524. It is noted that a sufficient number of spray nozzles 532 are provided to spray the entire width of the wide batt with liquid fire retardant chemicals.

Mounted adjacent the medial portion of conveyor 520 is another stanchion 536 which carries a moisture spraying means 537 including a plurality of spray nozzles 538, an air supply 539 and a water supply 540. The application of additional moisture to the material downstream of the fire retardant chemical applying means 531 is optional and is activated when additional penetration of the liquid fire retardant chemical is needed.

Above the delivery end of conveyor 520 is a heating means 541, which is suspended from a suitable support (not shown). Heating means 541 includes a plurality of radiant heating rods 542, 543 and 544 supported within a hood 545 and having individual reflectors 546, 547 and 548 thereabove. Heating means 541 serves to dry the liquid flame retardant and any additional moisture applied by the means 524, 531 and 537.

Depending upon the particular end use to which the insulating material is to be put, either no backing material is added to the wide batt or a backing material of one of a plurality of different materials is added. The process and apparatus of the present invention make provision for applying different types of backing material to the batt of insulation material to accommodate such end-use requirements.

Conveyor 520 delivers the wide batt to a conveyor 549 which is preferably angled upwardly from its entry end to its discharge end. A vinyl backing supply means 550 is disposed beneath the conveying line and comprises a vinyl roll supply stand 551. Stand includes a base member 552 supported on rollers 553 which in turn are supported by track members 554 for lateral rolling movement of the support stand 551 from an operative position beneath the conveyor line to a loading position laterally of the conveying line. Base member 552 also includes a brake means 555 for anchoring the support stand 551 in position during loading and during unwinding of the vinyl backing. Base member 552 supports two stands 556, 557 which, in turn, support two rolls of vinyl backing 558, 559. The rolls of vinyl backing 558 and 559 contain webs of vinyl material having a width equal to one-half the trimmed width of the wide batt. Accordingly, the stands 556 and 557 are offset with respect to one another such that the vinyl backing from roll 558 is beneath one-half of the trimmed width of the batt and the roll 559 is positioned beneath the other half of the trimmed width of the batt.

Suitable guide rolls 560, 561, 562, 563 and 564 guide the vinyl backing webs from the rolls 558 and 559 to the entry end of conveyor 549 and onto the upper run of conveyor 549 beneath the wide batt of insulation material. An adhesive applying means 565 is provided beneath the entry end of conveyor 549 and includes a trough 566 for containing a liquid adhesive and a driven application roll 567 the lower portion of which is within the trough 566 and immersed in the liquid adhesive contained therein. An excess liquid adhesive wiper member 568 is carried by trough 566 and contacts the surface of application roll 567 to remove excess liquid adhesive from the surface of the roll before that surface contacts the vinyl backing material. In this manner, an adhesive is applied to one surface of the two vinyl backing webs immediately prior to such surface contacting the batt. Such adhesive will bond the vinyl backing webs to the bottom surface of the wide batt.

Conveyor 549 delivers the wide batt with the vinyl backing thereon to a batt-slitting means 570. Slitting means 570 includes a supporting beam 571 from which a plurality of slitters 572 are suspended. Preferably, there are at least thirteen slitters **572*a*–572*m* carried by beam 571** for slitting the wide batt into individual strips or batts as will be presently described. If desired, the vinyl backing may be supplied pre-slit to the width of individual batts and applied after the wide batt is slit into individual batts.

Each of the slitters 572 includes a rotary slitting blade 573 rotatably carried by a shaft 574 which is journaled at its opposite ends in a housing 575 which covers all of slitter blade 573 except the portion which contacts the batt. Housing 575 is pivotably mounted by a pivot pin 576 on a slitter blade support member 577. Support member 577 is slideably supported by beam 571 by a mounting means 578. Mounting 578 carries a motor 579 which drives a pinion 580 which in turn meshes with a rack 581 carried on the support beam 571. Accordingly, upon energization of the motor 579, the pinion will rotate and move each of the slitters 572 along the support beam 571 to position each individual slitter in the proper position to provide the correct width of insulation batt dictated for end use requirements.

Each slitter **572*a*–572*m* also includes a pneumatic cylinder 582 which has its piston rod 582*a* connected at its lower end to the housing 575 and the upper end of the cylinder 582*b* is connected to a support extension 583 slideably carried by guide rods 584*a* and 584*b* mounted on the beam 571 for sliding movement therealong. The cylinder 582 moves the housing 575 and the slitter blade 573 either upwardly or downwardly about the pivot 576** from a downward active position in which the slitter is in operative position to slit the wide batt or an inactive upper position in which the slitter blade is positioned above the batt.

A rotatable anvil roll 584 is positioned beneath the slitter blades 573 and beneath the wide batt and vinyl backing thereon. The anvil roll 584 is rotatably supported by an anvil roll support means 585 for rotation with the slitter blades 573 as the same rotate against the surface of the anvil roll 584.

Typically, vinyl backing is used on insulation material for commercial buildings and not for residential buildings. When vinyl backing is applied, the edges of wide batt are trimmed by the outer two of the slitters 572 being positioned a predetermined small distance inwardly from the outer edges of the wide batt so as to ensure that the subsequently narrower batts of insulation material will have true square cut edges on both sides. The interior slitters 572 are spaced the desired distance apart, which typically is 15 or 24 inches for commercial building purposes. Since the wide batt is typically 12 feet wide, six interior slitters will be employed and two edge slitters will be positioned approximately four and one-half or three inches inside the outer side edges of the wide batt. Therefore, when individual batts of insulation of twenty-four inch width are being formed, five of the individual slitters 572 will be moved to inactive positions and will not be in use during slitting of the wide batt into the narrower batts and three-inch edge trims will be removed from opposite side edges of the wide batt. Further, the vinyl webs for commercial insulation purposes will each be 69 inches wide and will be applied to the wide batt in such manner that none of the vinyl backing material is adhered to the wide batt in the outer three inches on opposite sides of the wide batt. Of course, if narrow vinyl webs are applied after slitting of the wide batt, such vinyl webs will be approximately twenty-four inches in width.

Figure 24A:
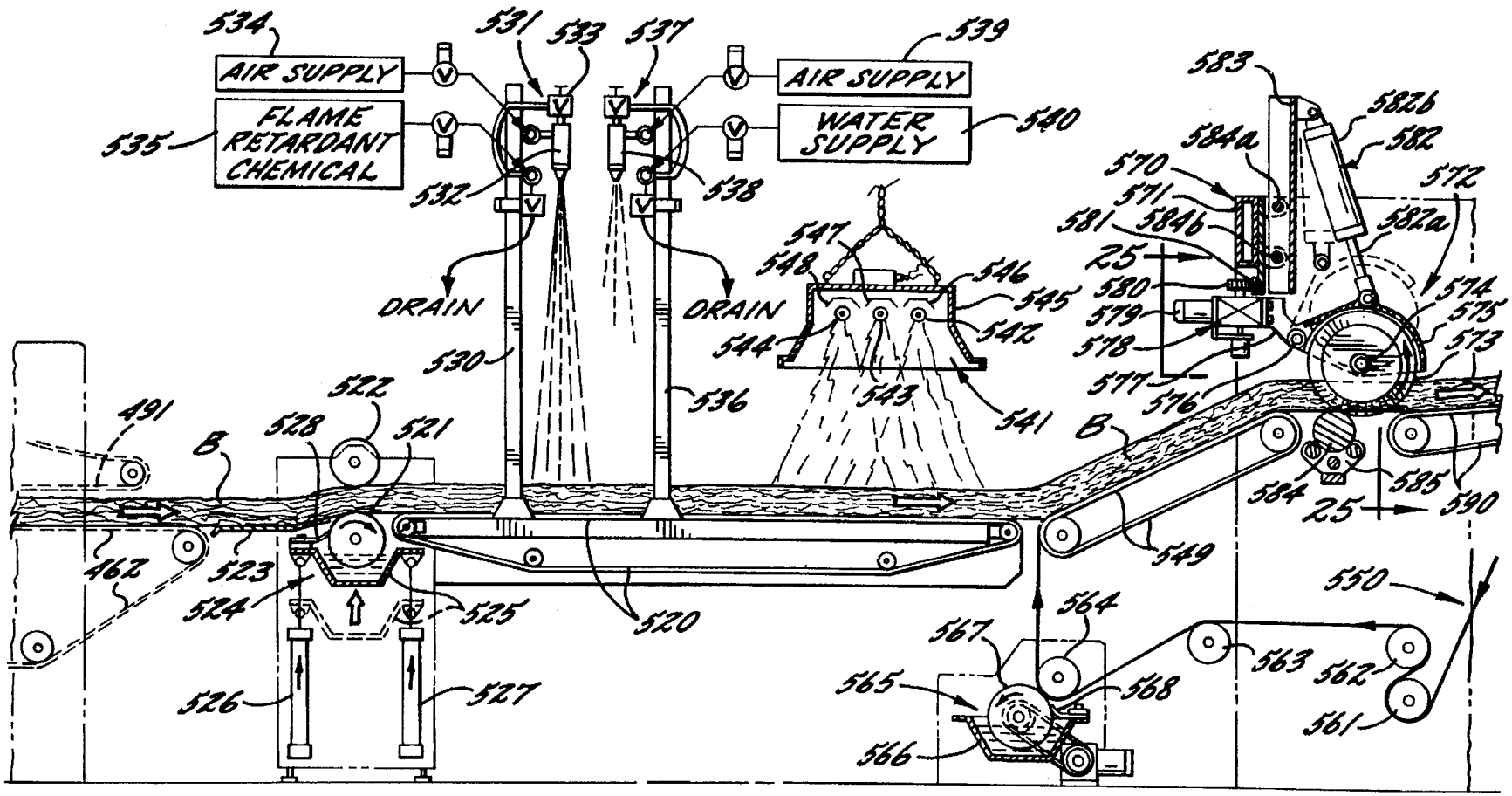
FIG. 24A is a sectional view taken substantially along line 24A—24A in FIG. 1C.
Figure 24B:
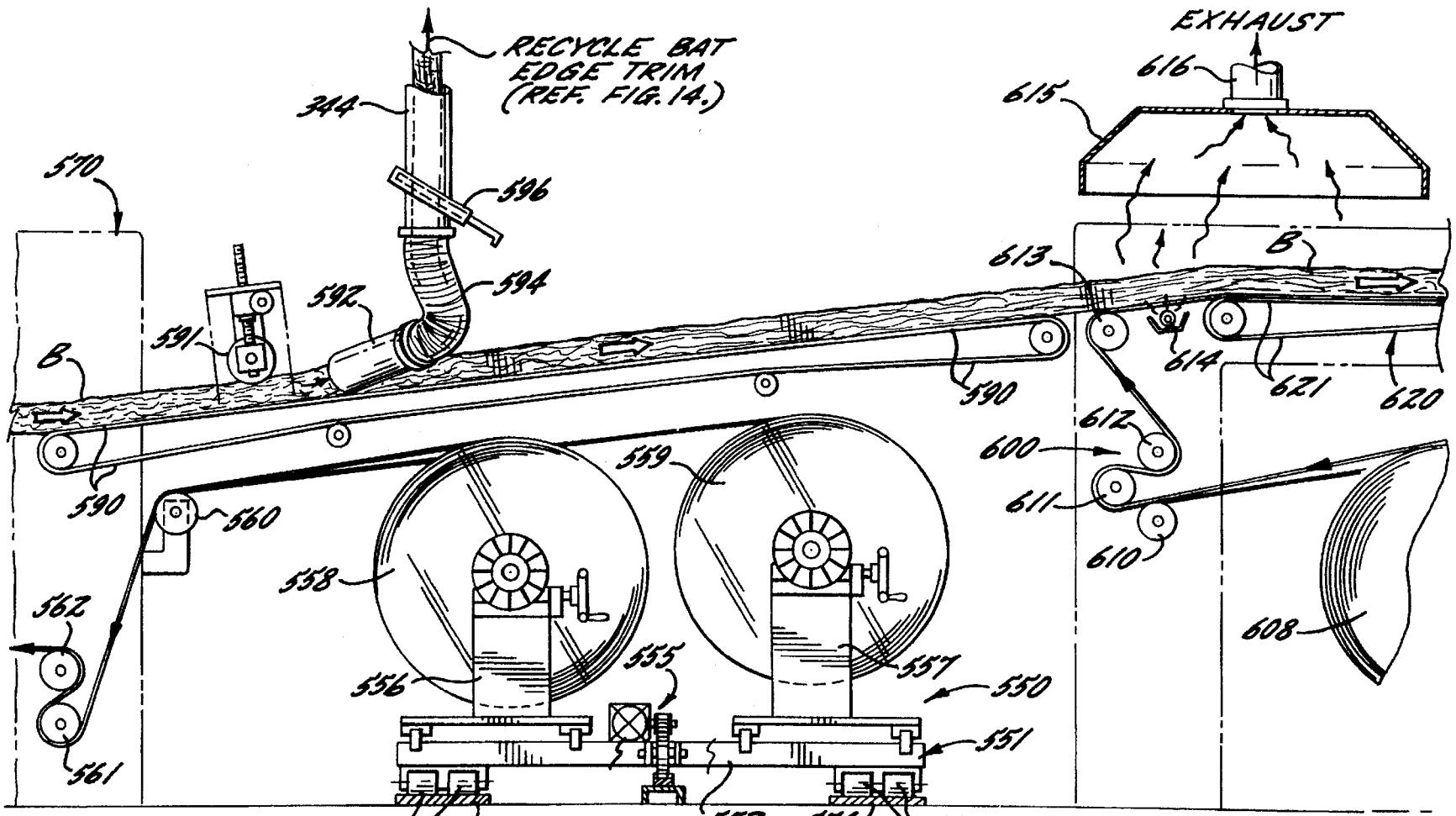
FIG. 24B is a view similar to FIG. 24A taken substantially along line 24B—24B in FIG. 1C.

Closely adjacent to the anvil roll 584 and the slitter blades 573 is a conveyor 590 which receives the slit batt segments from the slitters 572 (FIG. 24B). A pressure roll 591 is mounted above conveyor 590 in spaced relation to the slitters 572*a*–572*m* to hold the slit batts against the conveyor 590 to prevent the individual slit segments from attempting to wrap around the slitters 572 as blades 573 rotate.

Immediately downstream from the pressure roll 591 is a pair of edge trim vacuum nozzles 592, 593 connected to conduits 594, 595 which are, in turn, connected to a source of vacuum and deliver the edge trimmings from the batt upstream to the waste blender reserve 340. Conduits 594 and 595 have manually operable gate valves 596 therein for shutting off the conduit 594 or 595 to inactivate the edge trim nozzles 592 and 593 (FIG. 24B).

Figure 24C:
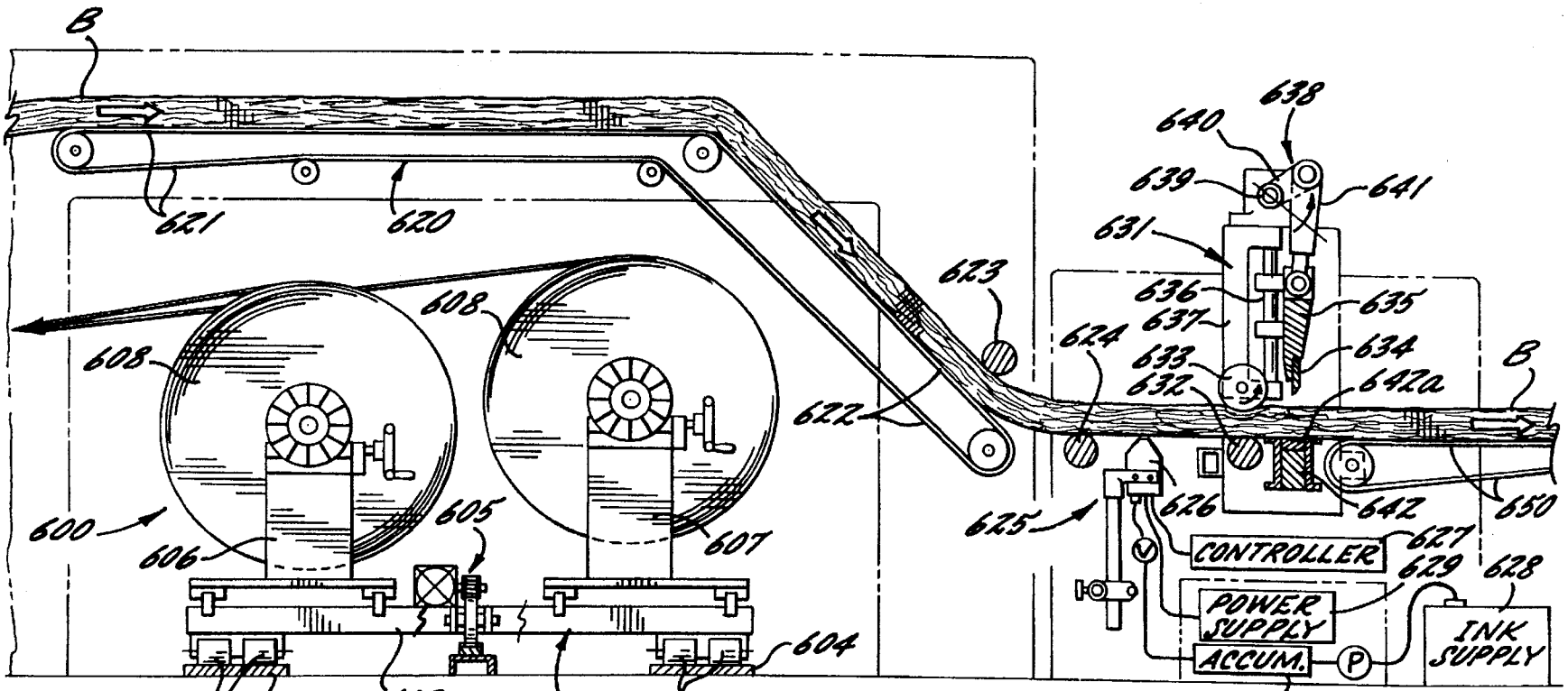
FIG. 24C is a sectional view similar to FIGS. 24A and 24B taken substantially along line 24C—24C in FIG. 1C.

For residential insulation, the vinyl backing is omitted and no backing material is applied to the wide batt prior to slitting thereof. Instead, a paper backing applying means generally indicated at 600. (FIGS. 24*b* and 24*c*) is provided adjacent the discharge end of conveyor 590 for applying a coated paper backing to each of the individual narrow batts following slitting and edge trimming removal. Paper backing supply means 600 includes a paper roll supply stand 601 including a base member 602 mounted on rollers 603 which in turn are received on tracks 604 supported by the floor of the processing plant (FIG. 24C). A suitable brake means 605 is provided for holding the base plate 602 in proper position once it is in the unwinding position. A plurality of roll stands 606, 607 for supporting rolls 608 of paper backing material are mounted on base member 602. The roll stands 606 and 607 are equal in number to the number of 15-inch or 24-inch wide individual batts into which the overall wide batt is slit by the slitting means 570. As illustrated, there are nine of the rolls 608, with five rolls supported by roll stand 606 and four rolls supported by roll stand 607.

Suitable guide rollers 610, 611 and 612 guide the paper webs from the rolls 608 to the under side of the narrow batts of insulation material. An applicator roll 613 receives the webs of paper backing from the guide roll 612 and presses the paper backing webs against the underneath side of the juxtaposed, narrow batts of insulating material. The paper backing webs come with an adhesive coating on the upper surface thereof, which is a heat sensitive adhesive coating such as an asphaltic based coating, as is conventional with residential type insulation material. Such heat sensitive adhesives are normally dry and non-tacky but are made liquid and tacky upon the application of heat thereto. To this end, an infrared heater 614 (FIGS. 24*b* and 26) is disposed beneath the paper backing webs downstream of the pressure roll 613 to apply sufficient heat to the paper backing webs to activate the adhesive coating thereon which is in contact with the lower surface of the narrow batts of insulation material. To remove the fumes liberated from the adhesive coating and to remove residual heat, an exhaust hood 615 is mounted above the application roll 613 and heater 614 and is connected to a source of vacuum by a conduit 616.

A conveyor 620 has its inlet end disposed adjacent to heater 614 to receive the narrow batts of insulation material having the paper backing webs applied thereto. The conveyor 620 has a first portion 621 which is substantially horizontal at an elevation sufficiently high above the floor of the processing plant to permit the roll stand 601 to be positioned thereunder (FIG. 24C). Conveyor 620 includes a second portion 622 which extends downwardly to the discharge end thereof at a substantially lower elevation than portion 621. A pressure roll 623 is provided adjacent the delivery end of conveyor 620 to control the narrow batts of insulation material and maintain the same in contact with conveyor 620 until closely adjacent the discharge end of conveyor portion 622.

Figures 25, 26:
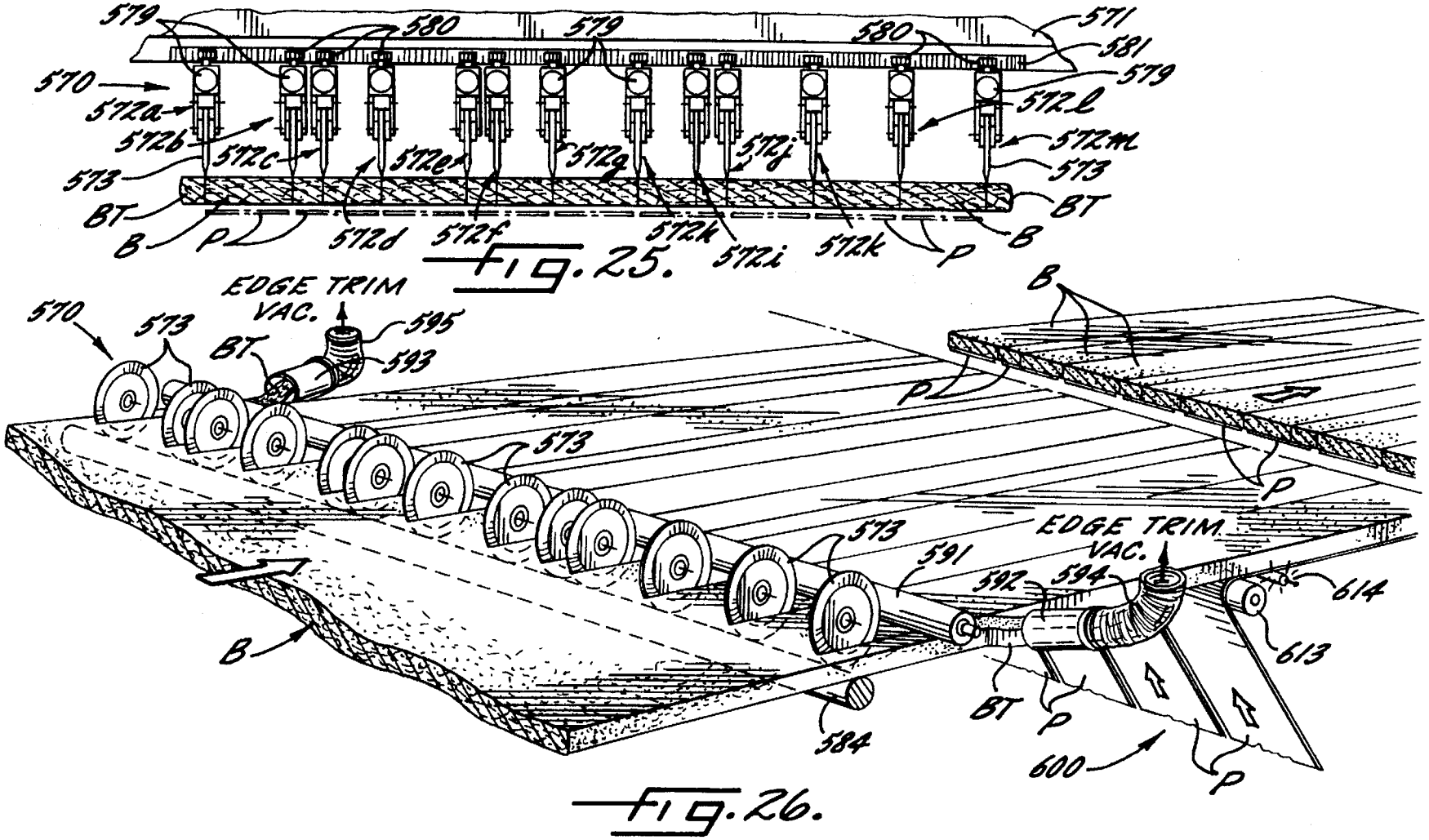
FIG. 25 is a transverse elevational of the slitting mechanism taken substantially along line 25—25 in FIG. 24A.
FIG. 26 is a fragmentary, enlarged, somewhat schematic, perspective view of the slitting and cut-off portion of the process illustrated in FIGS. 24A—24C with portions thereof removed for clarity.

Reference is now made to FIGS. 25 and 26 of the drawings which illustrate the slitting of the wide batt into residential-type, narrow insulation batts. The wide batt is preferably approximately 12 feet wide and it is desired for residential purposes to prepare narrow batts of 15-inch and 24-inch widths with 15-inch widths, the edges of the wide batt are trimmed approximately 4 ½ inches inwardly from the side edges of the wide batt by the two outside slitters 572*a* and 572*m*. The interior slitters 572*b*, 572*c*, 572*d*, 572*e*, 572*f*, 572*g*, 572*h*, 572*i*, 572*j*, 572*k*, and 572*l* are spaced apart substantially to produce batts of 15-inch width or combinations of adjacent batts which total 15-inch widths.

In residential construction, it is frequently desirable to have insulation material which can be readily formed into widths of less than 15 inches for use in insulating spaces that are between studs that are less than 16 inches on center, such as around doors, windows and in corners. Therefore, in accordance with the present invention, the wide batt may be slit into narrower widths than 15 inches. As illustrated in FIGS. 25 and 26, slitters 572*a* and 572*b*; 572*d* and 572*e*; 572*g* and 572*h*; 572*j* and 572*k*; and 572*l* and 572*m* are spaced apart 15 inches to provide normal width residential insulating batts. The slitters 572*b* and 572*c*; 572*e* and 572*f*; and 572*i* and 572*j* are spaced apart a distance of six inches while slitters 572*c* and 572*d*; 572*f* and 572*g*; and 572*j* and 572*k* are spaced apart a distance equal to nine inches. In this manner, three batts of six inches wide and three batts of nine inches wide are thus slit from the wide batt. Since the paper backing webs are normally 14⅞ inches wide, each of the 15-inch wide batts and each combination of the six and nine-inch wide batts will be adhesively adhered to a paper backing web. In this manner, the six and nine-inch combination batts may be used as a 15-inch batt or as narrower batts simply by severing the paper backing web along the slit between the six and nine-inch batts.

Referring back to FIG. 24*c*, a feed roll 624 is provided closely adjacent the discharge end 622 of conveyor 620 and beneath the narrow insulating batts for supporting the same as they are discharged from the conveyor 620. Positioned downstream from feed roll 624 but adjacent thereto is an ink jet printer 625 disposed beneath the webs of insulation material for printing suitable indicia, such as R values, on the paper backing webs thereof. The ink jet printer 625 includes a printing head 626, a controller 627, which controls the indicia printed by the printing head 626, ink supply 628, a power supply 629 and an accumulator 630, respectively. Such ink jet printing devices are common and can be obtained from a number of different sources, one example of which is Diagraph Corporation.

A cutoff mechanism 631 is positioned downstream of the ink jet printer 625. Cutoff mechanism 631 includes a pair of feed rolls 632, 633 for feeding the individual webs or batts of insulation material and for controlling these webs during the cutoff operation.

Figure 24D:
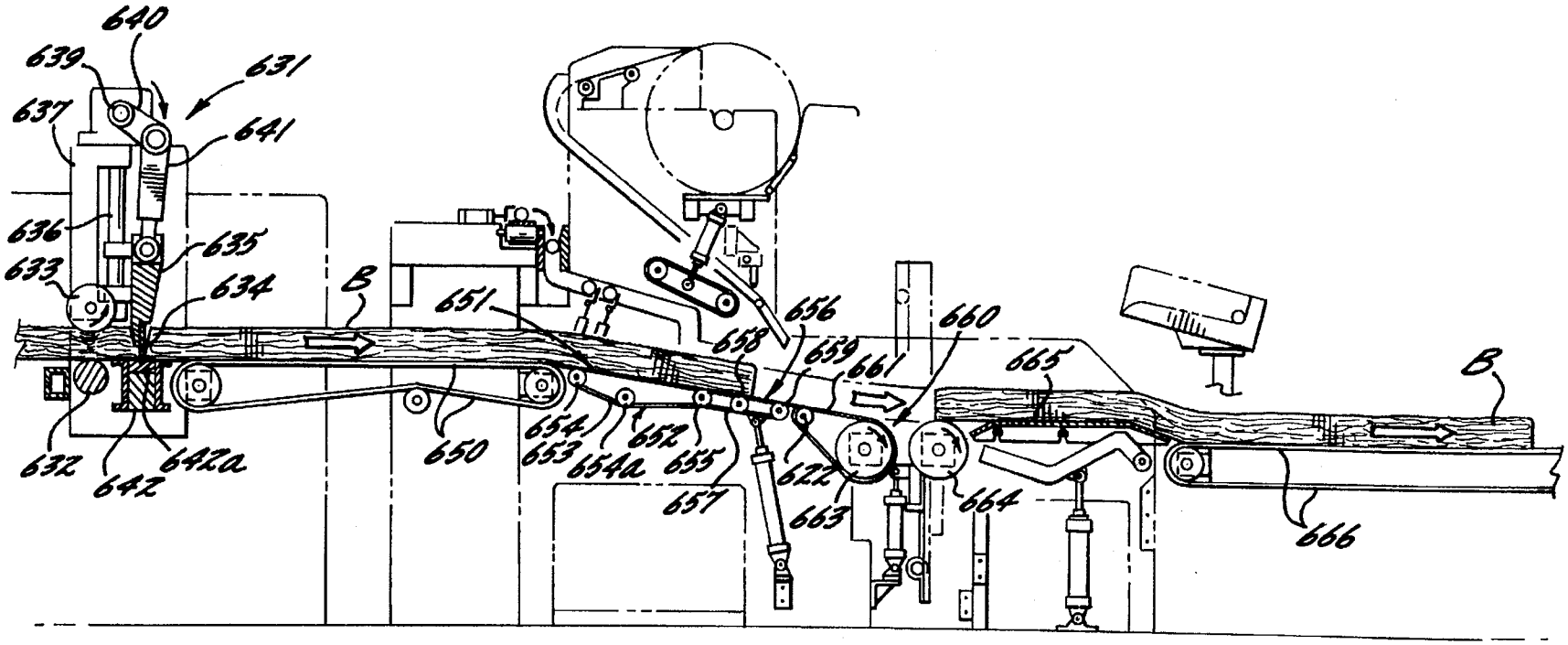
FIG. 24D is a view similar to FIGS. 24A—24C taken substantially along line 24D—24D in FIG. 1C.

Cutoff mechanism 631 further includes a cutting blade 634 carried by a mounting member 635. Mounting member 635 is mounted for vertical reciprocation on guide members 636 which are stationarily mounted in support members 637. An operating crank mechanism 638 includes a driven shaft 639, a first crank arm 640 and a second crank arm 641 connected to the blade mounting member 635. In this manner, upon rotation of the shaft 639, the blade 634 is moved downwardly from its raised inoperative position to its lower, operative position, to cut through the juxtaposed, narrow batts of insulation material and the paper backing webs thereon. A stationary anvil 642 is positioned beneath the narrow batts of insulating material and includes a grooved removable insert member 642*a* into which the cutting edge of the cutting blade 634 is received upon movement of the cutting blade to its lower, operative position. In this manner, as illustrated in FIGS. 24D and 26, the individual batts of insulation material are severed from the running webs of insulation material. For residential use, it is preferred that the individual batts of insulation material be cut to a predetermined length between about 94 and about 96 inches.

Immediately downstream from the cutoff mechanism 631 is a conveyor 650 for feeding the cut batts of insulation material away from the cutoff mechanism 631 (FIG. 24D). Preferably, conveyor 650 operates at a faster speed than conveyor 620 and the feed rolls 632 and 633 feeding the webs of insulation material to the cutoff mechanism 631 such that when the narrow batts are cut to length, the conveyor 650 will feed the same away from the cutoff mechanism 631 to provide increased spacing therebetween and the leading end of the narrow batts being fed to the cutoff mechanism In accordance with the present invention, the individual, narrow batts of insulation material may be folded medially along the length thereof to produce folded batts of two layers for subsequent packaging. Alternatively, the individual, narrow batts may be rolled into rolls and secured in roll form for subsequent packaging. The folded batt forming mechanism will be first described.

Conveyor 650 delivers the individual, narrow batts in juxtaposed relation to a conveyor means 651 (FIG. 24D) formed in two segments. The first conveyor segment 652 comprises a conveyor belt 653 trained about a rear roller 654, a medial idler roller 654*a* and a front roller 655. Front roller 655 comprises the rear roller of a second conveyor segment 656, which includes a conveyor belt 657 trained about the roller 655, a medial roller 658 and a front roller 659. Second conveyor segment 656 delivers the individual cutoff batts to another conveyor means 660 comprising a conveyor belt 661 trained about a rear idler roller 662 and a large front driven roller 663. A feed roll 664 is spaced downstream of but adjacent feed roll 663 and is driven in the same direction as feed roll 663.

Figures 24E, 24F:
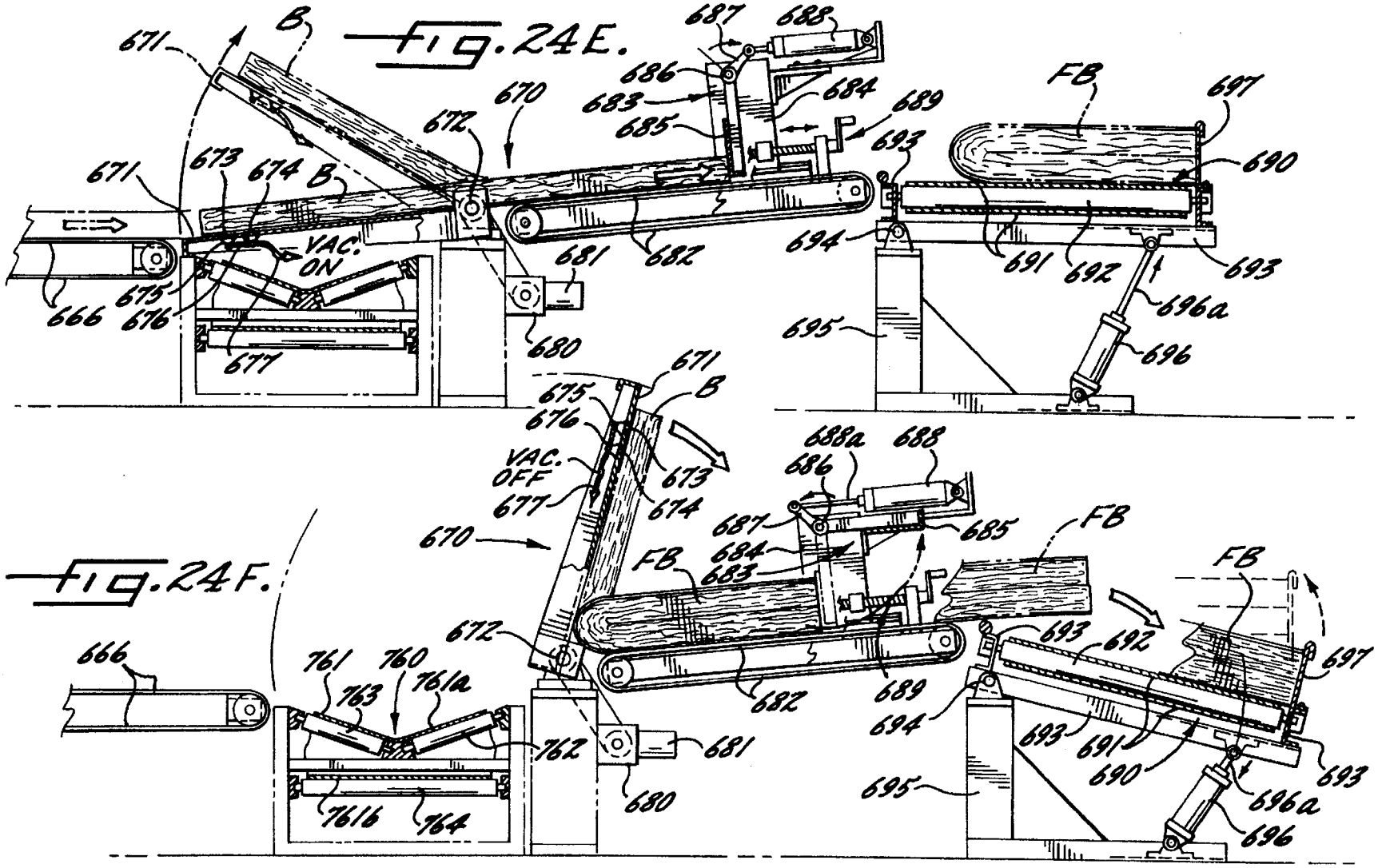
FIG. 24E is a view similar to FIGS. 24A—24D taken substantially along line 24E—24E in FIG. 1C.
FIG. 24F is a sectional view similar to FIG. 24E, but showing parts thereof in different operational positions.

Feed roll 664 feeds the individual, narrow batts across a removable cover plate 665 onto a conveyor 666. Conveyor 666 operates at the same surface speed as conveyors 660 and feed roll 664 to feed the individual, narrow batts to the folding mechanism, generally referred to at 670 (FIGS. 24E and 24F). Folding mechanism 670 includes a batt folding table 671 which is hinged at its forward or downstream end for pivotal movement about a shaft The upper surface of table 671 has two lines of perforations 673, 674 extending longitudinally thereof across the full length of that portion of the table 671 transversely of the individual, narrow batts. Vacuum nozzles 675, 676 are disposed on the bottom side of table 671 in communication with the lines of perforations 673 and 674, respectively. The vacuum nozzles 675 and 676 are connected by a hose 677 to a source of vacuum which, when activated, causes the trailing ends of the juxtaposed batts of insulation material to be held against the table 671.

The shaft 672, to which the table 671 is connected for rotation therewith, is driven by a drive belt 688 connected to a reversible motor 681. A conveyor belt 682 is disposed downstream of the folding table 671 to receive the leading portions of the juxtaposed, individual batts thereon. A stop means 683 is disposed medially of the conveyor 682 and includes an adjustable mounting member 684 on which a stop member 685 is pivotally mounted on a shaft 686. A crank arm 687 is connected to the shaft 686 at one end and to a pneumatic cylinder 688 at the other end. The double acting pneumatic cylinder 688, upon extension of the piston rod 688*a*, will retract the stop member 685 to its upper, inactive position and, upon retraction of the piston rod 688*a*, will move the stop member 685 into its downward, operative position. An adjustment means 689 is provided for manually adjusting the position of the support member 684 along the conveyor 682 to properly position the stop member 685 for batts of varying lengths such that each batt will be folded along its transverse center line.

When each set of juxtaposed, individual batts of insulation material are fed by conveyor 666 across the table 671 and onto conveyor belt 682, the stop member 685 is positioned in its downward operative position. The leading ends of the set of juxtaposed, individual batts will abut against the stop member 685 and further advance of the set of individual batts is prevented. Reversible motor 681 is then activated to rotate the table 671 about shaft 672 in a clockwise direction, as seen in FIGS. 24E and 24F, until the batts resting thereon are folded about their transverse center line as illustrated in FIGS. 24E and 24F. Upon the line of batts contacting the stop member 685, the vacuum is turned on to vacuum nozzle 675 and 676 such that the trailing end portion of the line of batts is firmly held against table 671 until the folding operation is completed. As soon as the batts are fully folded, the vacuum is turned off from nozzles 675 and 676 and motor 681 is reversed to return the table to its original position in which it is at the same level as conveyors 666 and 682.

With the set of individual batts fully folded, the stop member 685 is retracted upwardly to its inoperative position by the cylinder 688, piston 688*a* and crank arm 687 and conveyor 682 discharges the folded transverse line of batts from the downstream end thereof onto a transverse conveyor 690. Transverse conveyor 690 includes a conveyor belt 691 which extends perpendicular to conveyor 682. Conveyor belt 691 is mounted on rollers 692 which are journaled at opposite ends in a frame 693. Frame 693 is pivotally mounted for movement about pivot 694 mounted in stanchions 695. Pneumatic cylinders 696 are connected to frame 693 for moving the frame 693, and thus conveyor belt 691, about the pivots 694.

A stop member 697 is provided along the opposite side of conveyor belt 691 from the discharge end of conveyor belt 682. When the folded batts are to be received on conveyor belt 691 from conveyor belt 682, the pneumatic cylinders 696 are activated to retract the piston rods 696*a* thereof to lower the side of conveyor belt 691 opposite the delivery end of conveyor belt 682 such that conveyor belt 691 is tilted in a downward direction as illustrated in FIG. 24F. Conveyor belt 682 then discharges the folded batts onto the tilted conveyor belt 691 so that the batts will slide downwardly on conveyor belt 691 until the ends thereof contact the stop member 697. When the folded batts are loaded onto conveyor belt 691, the cylinders 696 are activated to return the conveyor belt 691 to a horizontal or raised position as illustrated in FIG. 24E.

Referring now to FIGS. 27–30, the roll forming mechanism of the present apparatus will now be described. Rolls of insulation material are formed about a mandrel 700 (FIG. 28) which will accommodate up to six commercial batts wound into rolls and nine rolls of residential insulation batts. The apparatus and process of the present invention utilizes a plurality of mandrels 700 so that the roll forming mechanism can operate substantially continuously.

The mandrels 700 are normally contained in a magazine 701 which includes a pair of guide slots 702 at opposite sides of the conveyors 650 and 651. A pair of solenoid operated stop members 703, 704 are provided at a medial portion of the magazine slots 702 to receive and hold mandrels 700 in spaced relation within the magazine 701 for delivery to the roll forming mechanism as needed.

When a series of rolls are to be formed, solenoid operated stop member 703 is activated to release the mandrel 700 being held thereby, which causes the mandrel to roll downwardly along the inclined portion of the guide slots 702 to the delivery end thereof which is substantially vertical. The mandrel 700 will then drop downwardly onto the leading end of the juxtaposed, individual batts to be formed into the rolls. At that time, pneumatic cylinders 705 raise the conveyor portion 656 upwardly to raise the leading end portion of the batts upwardly and to cause that leading end portion to be fed upwardly around the mandrel 700. At the same time, a roll forming conveyor 710, including a conveyor belt 711, trained at one end about a stationary roll 712 and at the other end about a moveable roll 713, is pivoted downwardly by a pneumatic cylinder 714, with the leading end of the juxtaposed batts to feed the same rearwardly over the top of the mandrel 700. Continued movement of the conveyor belt sections 652, 656 and the roll forming conveyor 710 causes the leading end portions of the juxtaposed batts to be wound about the mandrel 700. The conveyor 710 also exerts downward pressure on the end portions of the batt and the mandrel 700 to compress the batt as it is wound about the mandrel 700.

Once the leading end portions of the batts are firmly wound about the mandrel 700, the cylinder 714 is activated to raise the conveyor 710 out of contact with the batts and the cylinder 705 is activated to lower the conveyor section 656 back to its original position. At that time, the batts with the leading end portions thereof wound about the mandrel 700 are fed forwardly off of conveyor section 656 and onto conveyor 660 and onto the feed rolls 663 and 664. At the same time, opposite ends of the mandrel are received in guide members 715 on opposite sides of the conveyors 656 and 660 while the end portions of the mandrel 700 are fed forwardly by conveyors 716 having lugs 717 thereon which engage the rear surface of the end portions of the mandrel 700 to positively feed the mandrels forwardly until the mandrels are received in mandrel guides 720 disposed at opposite ends of the feed rolls 663 and 664. Mandrel guides 220 include vertical guide slots **720*a* therein which guide the mandrel 700 upwardly as the rolls of insulation material batts increase in diameter. A hold-down mechanism 721 receives the end portions of the mandrel 700 therein and is carried by a piston rod of a pneumatic cylinder 722 to exert a downward pressure on the end portions of the mandrel 700 to compress the insulation material batts as they are being wound about the mandrel 700**.

The rolls 663 and 664 rotate the rolls of insulation material and the mandrel 700 as the batts of insulation material are fed thereto by the conveyors 650, 651 and 660 until the cutoff insulation batts are completely wound about the mandrel 700. At that time, a tape mechanism 730 is activated and includes a tape supporting member 731 for supporting a roll 732 of tape. Guide rolls 733 and 734 are mounted on tape roll supporting member 731 and deliver tape T by a guide chute and guide member 735 to the roll taping station. A spring biased application member 736 is carried by the end of chute 735 to press the tape T against the formed rolls of insulation material at this roll taping station. A moistening spray head 737 is provided immediately above the application member 736 to spray the adhesive coated tape T with moisture to activate the adhesive on the tape immediately prior to its application to the rolls of insulation material. The rolls of insulation material continue to rotate once the tape T is applied thereto until at least one convolution of tape is applied to the roll to secure the insulation material in roll form. At that time, the tape T is severed by a severing mechanism (not shown).

When the rolls of insulation material are completely formed and taped, a cylinder 738 connected to the mandrel guides 720 is activated to pull the guides 720 downwardly until the mandrel 700 within the rolls of insulation material clears the top of the guides 720. At the same time, the hold-down members 721 are pulled downwardly by cylinder 722 so that the hold-down member 721 releases the ends of the mandrels. In this connection, it is noted that the under surface of the top portion of the hold-down member 721 will cam the mandrels rearwardly such that they will clear the hold-down member to permit the hold-down member 721 to move downwardly to its starting position.

Once the end portions of the mandrels clear the top of the mandrel guides 720, the feed rolls 663 and 664 will cause the rolls of insulation material and the mandrel 700 to be fed onto a roll transfer mechanism 740. The roll transfer mechanism 740 includes a cradle member 741 that has a V-shaped main portion **741*a* and an L-shaped end portion 741*b*. End portion 741*b* is pivotally mounted by a pivot 742 and a pneumatic cylinder 743 has the piston 743*a* thereof connected to the medial portion of the cradle member 741. Upon delivery of the formed and taped rolls of insulation material, R1, R2, R3, R4, R5 and R6 by the feed rolls 663 and 664 onto the cradle member 741, the rolls of insulation material are received and held on the cradle member 741 by the V-shape thereof. The pneumatic cylinder 743 is then activated to raise the cradle member upwardly about the pivot 742 to cause the rolls R1–R6 to roll off of the cradle member 741 and onto conveyor 666 previously described. At the same time, the ends of the mandrel 700 are received in a first guide member 744 and a second guide member 745 which have stop portions 744*a* and 745*a* thereon which engage the leading portion of the mandrel 700 to prevent movement of the mandrel and the rolls R1–R6 along the conveyor 666**.

Figure 29:
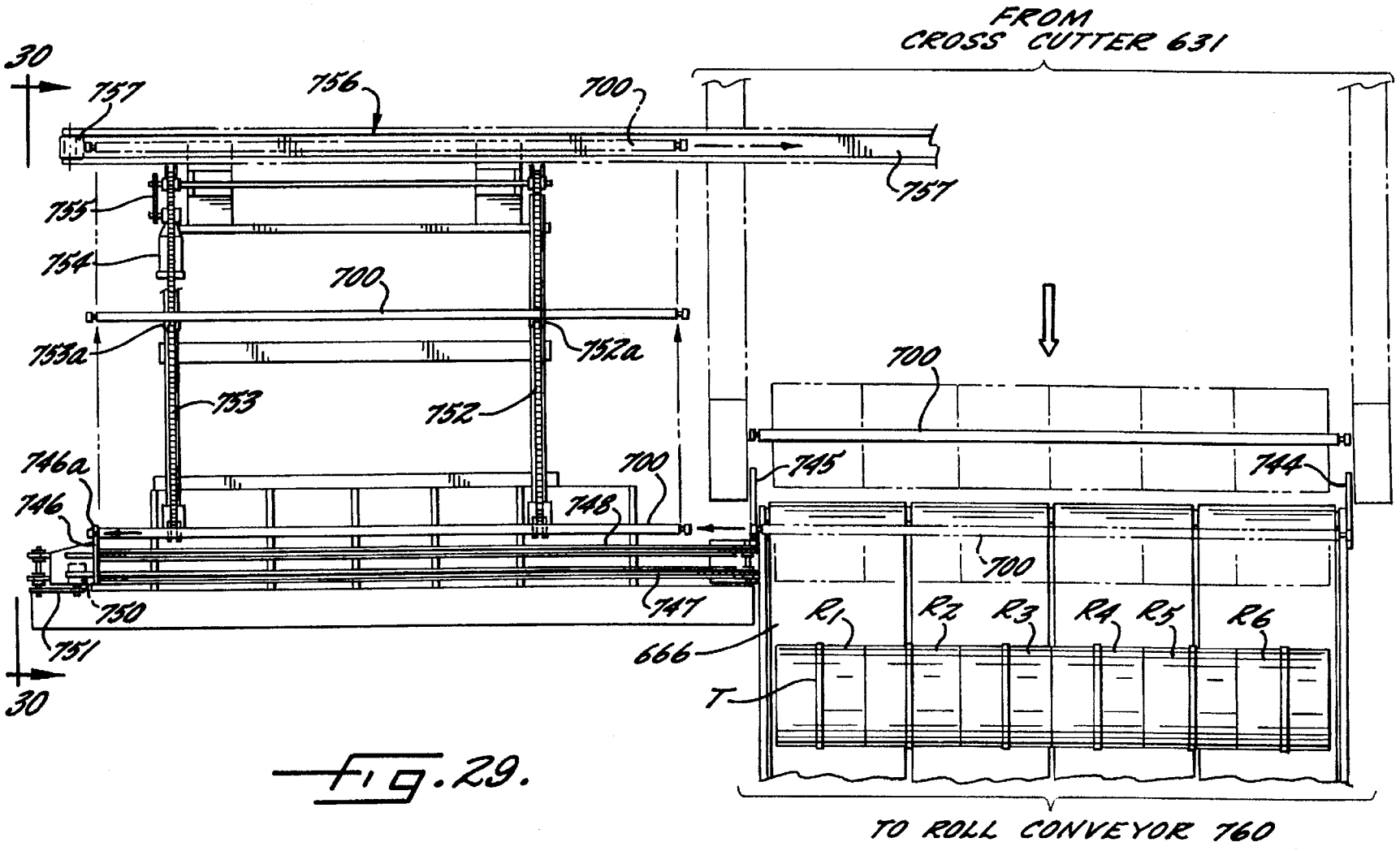
FIG. 29 is a top plan view of the portion of the process and apparatus illustrated in FIG. 7, and illustrating with particularity the mandrel handling portion of that apparatus.
Figure 30:
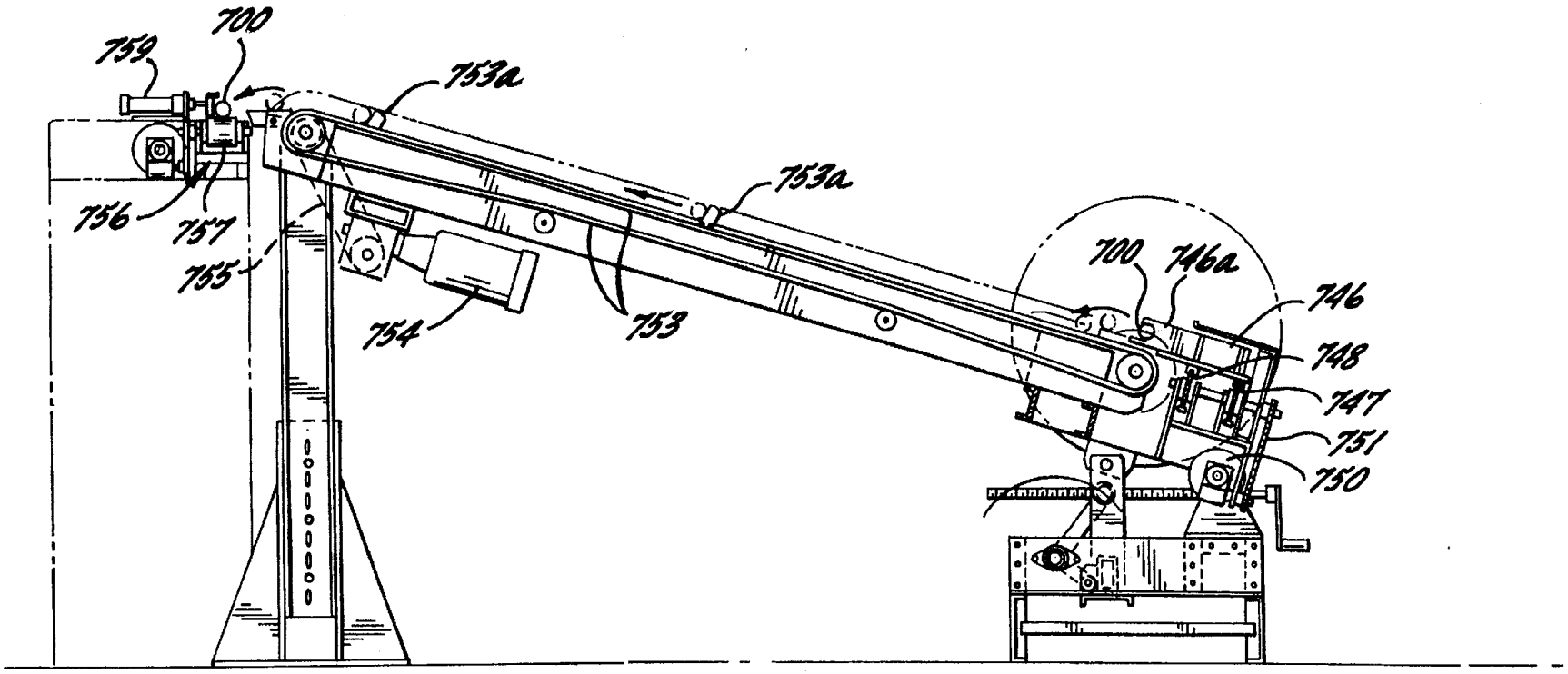
FIG. 30 is a fragmentary, somewhat schematic, elevational view of the mandrel handling apparatus illustrated in FIG. 29.

The right-hand end portion of the mandrel 700 is also delivered into a slot in the end portion **746*a* of a mandrel pulling member 746. Mandrel pulling member 746 is mounted on a pair of conveyor chains 747, 748 (FIGS. 29 and 30). Conveyor chains 747 and 748 are driven by a motor 750 and sprocket chain 751 to pull the mandrel laterally of the conveyor 666 and out of the rolls R1–R6. As the left-hand end of the mandrel 700 clears roll R6, that roll R6 is fed along conveyor 666 until the same is delivered from the delivery end thereof. As the mandrel 700 continues to be withdrawn, it clears each roll R5–R1 in seriatim and as it clears each roll, that roll is fed along conveyor 666** until it passes off of the delivery end thereof.

The mandrel pulling member 746 and the conveyor chains 747 and 748 continue to move the mandrel 700 laterally until the mandrel completely clears the conveyor 666 and reaches a discharge position of the mandrel 700. At that time, the mandrel is positioned adjacent the entry end of a pair of conveyor chains 752 and 753 which have upstanding lugs 752*a* and 753*a* thereon to pick up the mandrel 700 and to remove the right hand end portion of the mandrel 700 from the slotted end portion 746 of the mandrel pulling member 746 and to carry the mandrel 700 upwardly to the upper discharge end of the conveyor chains 752 and 753. Conveyor chains 752 and 753 are driven by a motor 754 and a sprocket chain 755 (FIG. 30).

Figures 27, 28:
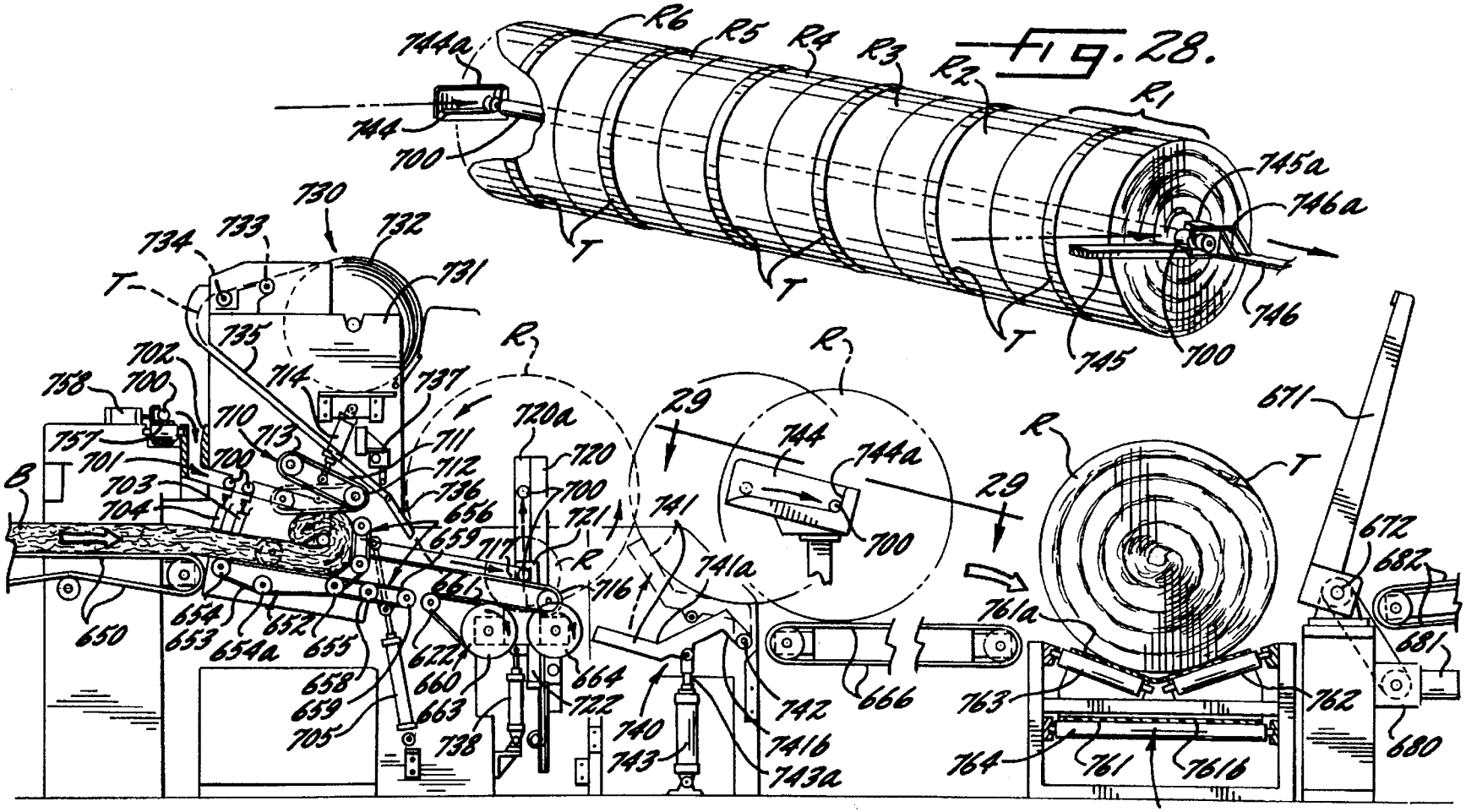
FIG. 27 is a sectional view similar to FIG. 24E but illustrating the formation of rolls of insulation instead of folded batts.
FIG. 28 is a fragmentary, somewhat schematic, perspective view of a mandrel about which rolls of insulation have been wound, as illustrated in FIG. 27.

Conveyor chains 752 and 753 deliver each mandrel onto a mandrel loading conveyor 756 which includes a conveyor belt 757 running perpendicular to the conveyor chains 752 and 753 and above the conveyor belt 650 to a position for discharge of the mandrel 700 into the magazine 701. Adjacent the magazine 701, a pair of pneumatic cylinders 758 and 759 are provided to push the mandrel 700 from the conveyor belt 757 into the magazine 701 (FIGS. 27 and 30). In this manner, the mandrels are withdrawn from the formed and taped rolls R1–R6 by the puller member 746 and chains 747 and 748 and is delivered back into the magazine 701 by the conveyor chains 752 and 753, and conveyor belt 757.

Conveyor 666 delivers the rolls R1–R6 onto a roll conveyor 760 (FIG. 27). Roll conveyor 760 includes a conveyor belt 761 having the upper run 761*a* thereof supported by pairs of angle rollers 762, 763 such that the upper run 761*a* of conveyor belt 761 is maintained in a V-shape to receive and cradle the rolls R1–R6 thereon. The lower run 761*b* of conveyor belt is supported by a plurality of rollers 764 in a normal horizontal attitude.

The roll conveyor 760 is disposed beneath the pivoted table 671 when the table 671 occupies its lowered position and is inoperative during folded batt formation. For roll formation, the table 671 is pivoted upwardly to its upper, raised position to uncover the conveyor 760 so that conveyor 666 can deliver the rolls of insulation material, R1–R6 onto the conveyor 760.

Figure 53:
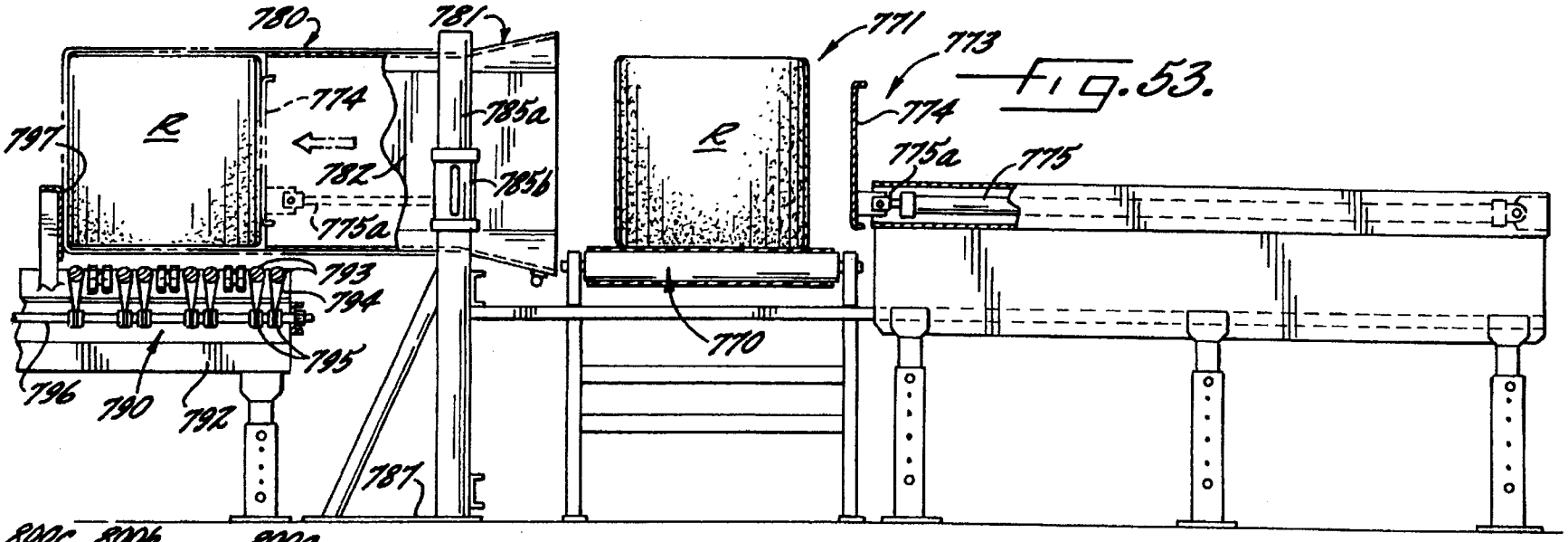
FIG. 53 is a fragmentary, somewhat schematic, vertical sectional view taken substantially along line 53—53 in FIG. 1C of the roll packing station.
Figure 54:
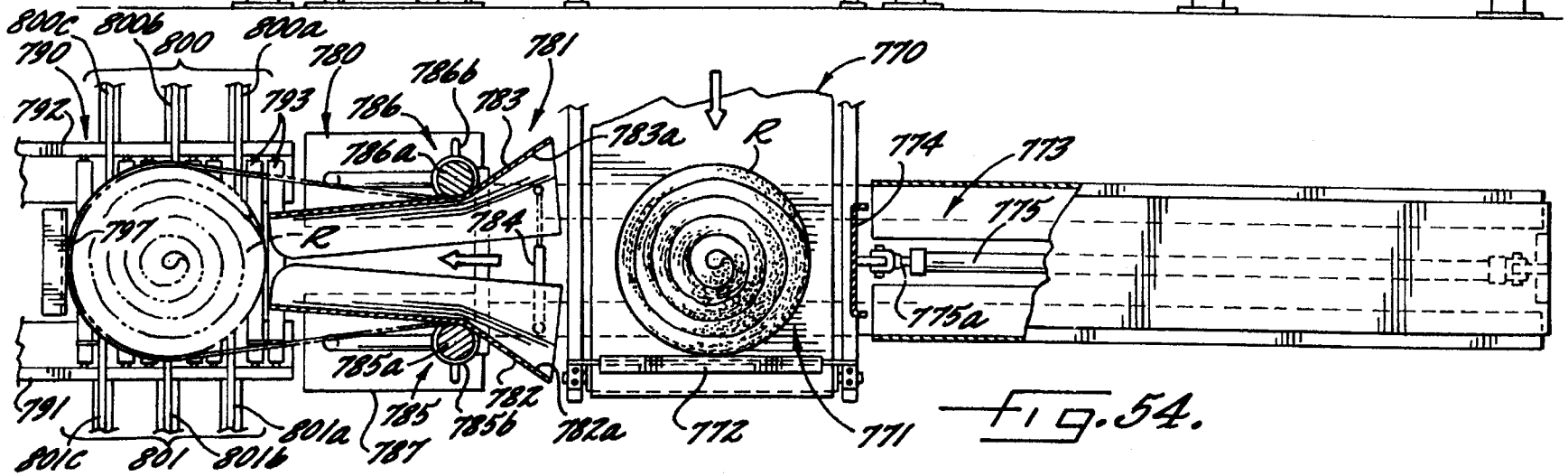
FIG. 54 is a horizontal sectional view of the apparatus shown in FIG. 53.

Conveyor 760 extends laterally of the conveyor 666 parallel to conveyor 690 to deliver the rolls R1–R6 of insulation material to another conveyor 770 (FIG. 1C). Conveyor 760 is disposed at a higher elevation than is conveyor 770 such that the rolls resting on their sides on the V-shaped upper run 761*a* of conveyor 760 are delivered off of the delivery end of conveyor 760 onto the entry end of conveyor 770 such that the rolls fall downwardly onto conveyor 770 and rest on one end thereof rather than the side (FIG. 53). Conveyor 770 extends from the delivery end of conveyor 760 to a packing station 771. A stop member 772 is provided at the delivery end of conveyor 770 (FIG. 54) to stop each roll on conveyor 770 in position to be packaged between a pusher mechanism 773 and a packaging mechanism 780.

Pusher mechanism 773 includes a vertical pusher member 774 carried by the outer end of a piston rod 775*a* of a pneumatic cylinder 775. Upon activation of cylinder 775, the piston rod 775*a* thereof is extended to push pusher member 774 laterally of conveyor 770 to push the roll of insulation material laterally off of conveyor 770 and into packaging mechanism 780.

Packaging mechanism 780 includes a packaging horn 781 comprising a first horn segment 782 and a second horn segment 783. The horned segments 782 and 783 have flared end portions 782*a*, 783*a* on the ends thereof adjacent to conveyor 770. The flared end portions 782*a* and 783*a* are connected together by a spring biasing cylinder mechanism 784 so that the flared end portions 782*a*, 783*a* thereof can be spread apart but will be pulled back closer together by the spring cylinder mechanism 784. The segments 782 and 783 are further biased toward each other by a pair of spring mechanisms 785, 786 comprising spring arms 785*a*, 786*a* mounted at one end on a support plate 787 and having a vertical end portion 785*b*, 786*b* contacting the horn segments 782 and 783 at the juncture of the flared end portions 782*a*, 783*a* with the remainder of the horn segments.

The remainder of the horn segments 782 and 783 are adapted to receive thereover a plastic bag of a size to receive and contain one of the rolls of insulation material. The plastic bag is held in position over the horn segment 782 and 783 by having the open end portion thereof positioned underneath the vertical spring members 785*b*, 786*b* such that the bag is held against the horn segments 782 and 783. The pusher member 784 when extended by the ram 785 will engage the roll of insulation material resting on conveyor 770 against stop member 772 and will push the roll of insulation material through the horn segments 782 and 783 into the plastic bag surrounding the horn segments. At that same time, the pusher member 774 and the roll of insulation material will push against the bottom of the plastic bag and will remove the plastic bag from beneath the spring members 785*b*, 786*b* such that the bag is then free from restraint with the roll of insulation material therein.

Upon exiting the horn 781, the roll of insulation material in the plastic bag will be received on a transfer conveyor 790. Transfer conveyor 790 includes a pair of end frame members 791, 792 which have journaled therein opposite ends of multiple rollers 793. Rollers 793 are driven by drive belts 794 which are trained about the rollers 793 in grooves in the surfaces of the rollers adjacent the frame member 792 at one end and about drive pulleys 795 on a drive shaft 796 at their other end. In this manner, the rollers 793 are driven in a direction to receive the plastic bag containing the roll of insulation material thereon and to convey that package until it engages a stop member 797 at the end of the transfer conveyor 790 opposite the horn 781.

Transfer conveyor 790 includes two belt conveyors 800, 801 each consisting of three belts 800*a*, 800*b* and 800*c* and 801*a*, 801*b* and 801*c*. Conveyor 800 has the belts 800*a*–800*c* driven in one direction transverse to the direction of receipt of the package on transfer conveyor 790, while conveyor 801 is driven in the opposite direction to convey the package of the roll of insulation in the opposite transverse direction. The belt conveyor 800 and belt conveyor 801 are operable in timed relation to each other such that conveyor 800 conveys alternate packages of rolls of insulation material in one direction, while conveyor 801 conveys intervening packages of rolls of insulation in the opposite direction.

Conveyor 800 has its delivery end above a package conveyor 802 while conveyor 801 has its delivery end above a package conveyor 803 (FIG. 1C). Conveyors 802 and 803 have bag sealing mechanisms 804, 805 associated therewith for sealing the open tops of the plastic bags containing the rolls of insulation material being fed along conveyors 802 and 803. Once sealed, the packaged rolls of insulation material are delivered by conveyors 802 and 803 to a package conveyor 806 (FIG. 1C).

Figure 31:
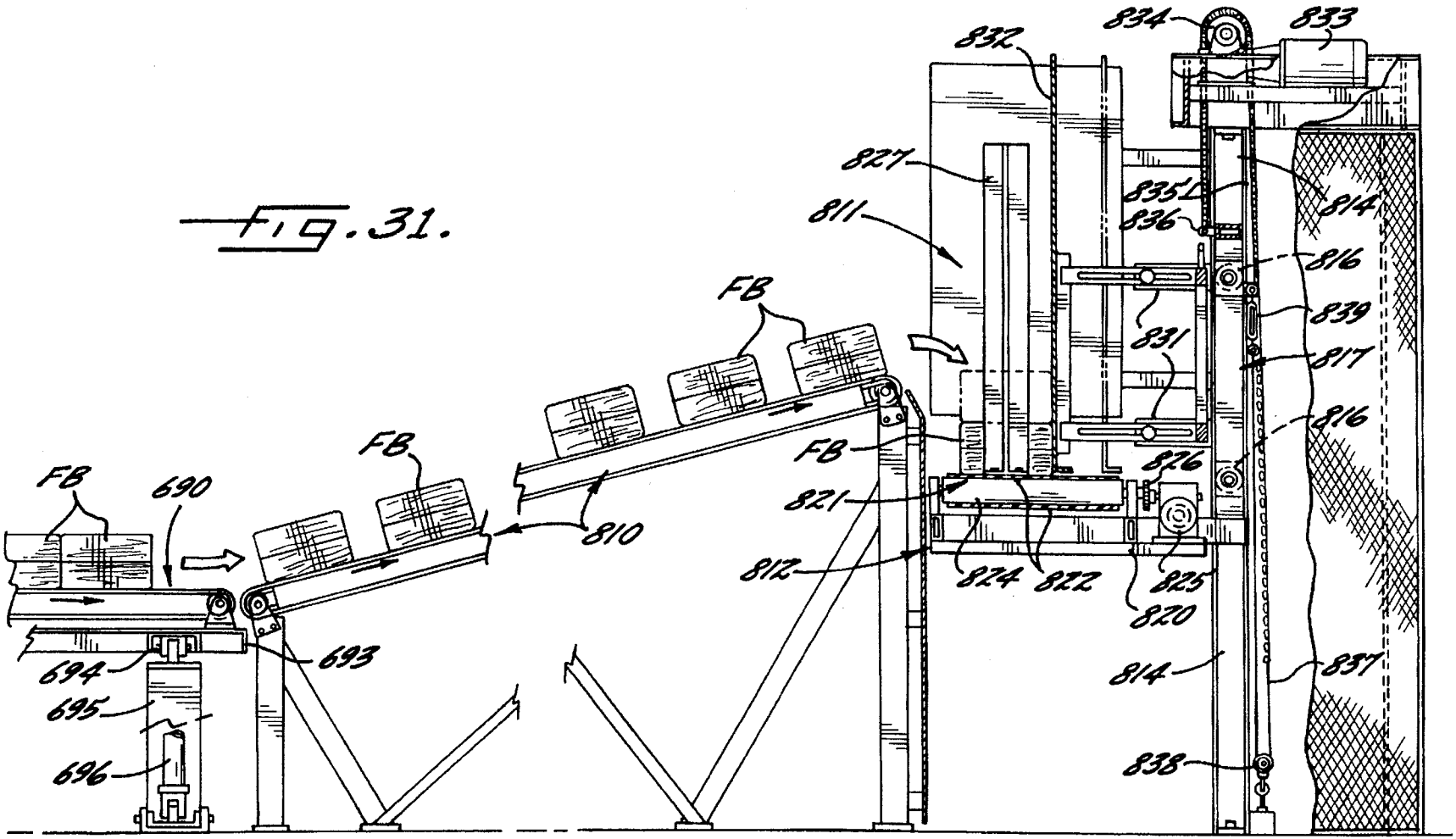
FIG. 31 is a sectional view of the folded batts out-feed and stacking mechanism taken substantially along line 31—31 in FIG. 1C.
Figure 32:
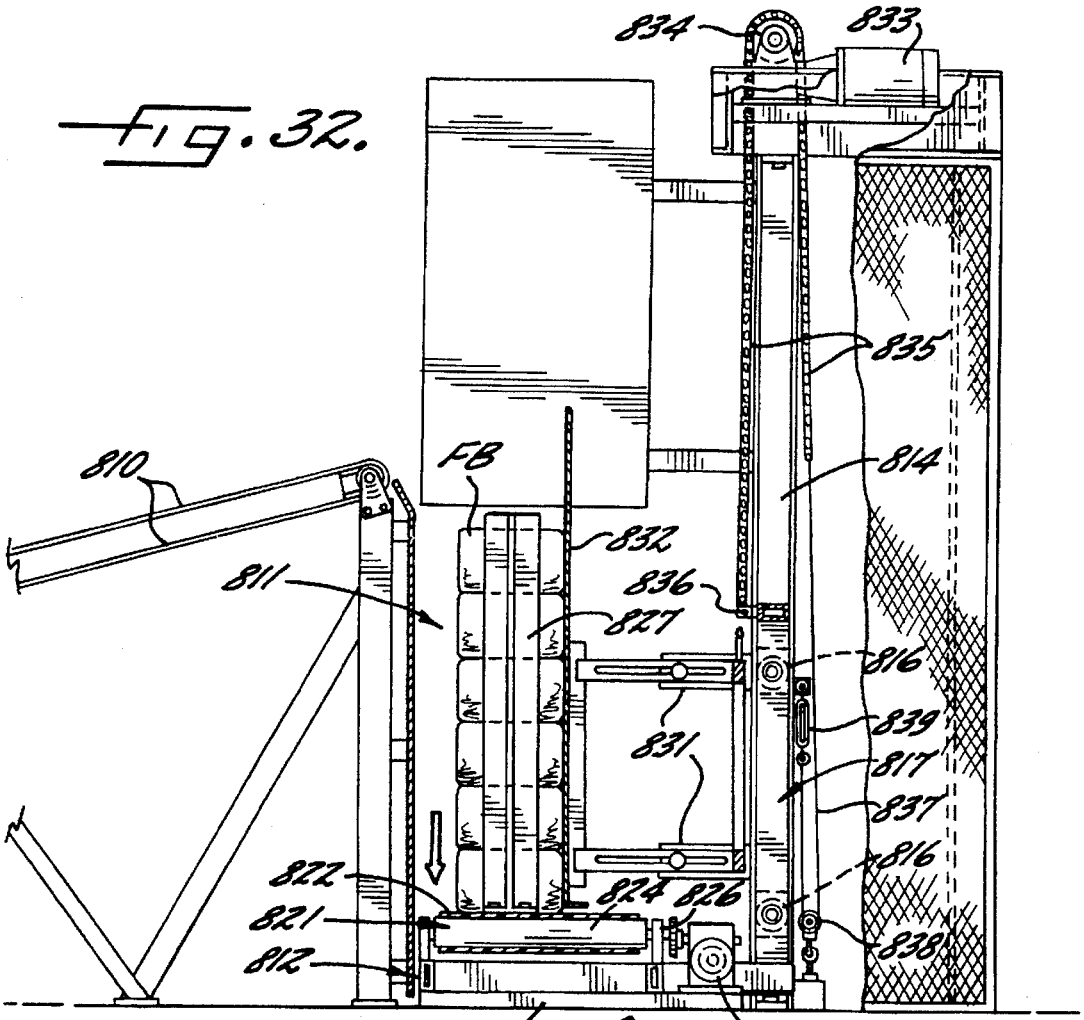
FIG. 32 is a sectional detail of the batt stacker mechanism illustrated in the right-hand portion of FIG. 31 in a different operational position.
Figure 33:
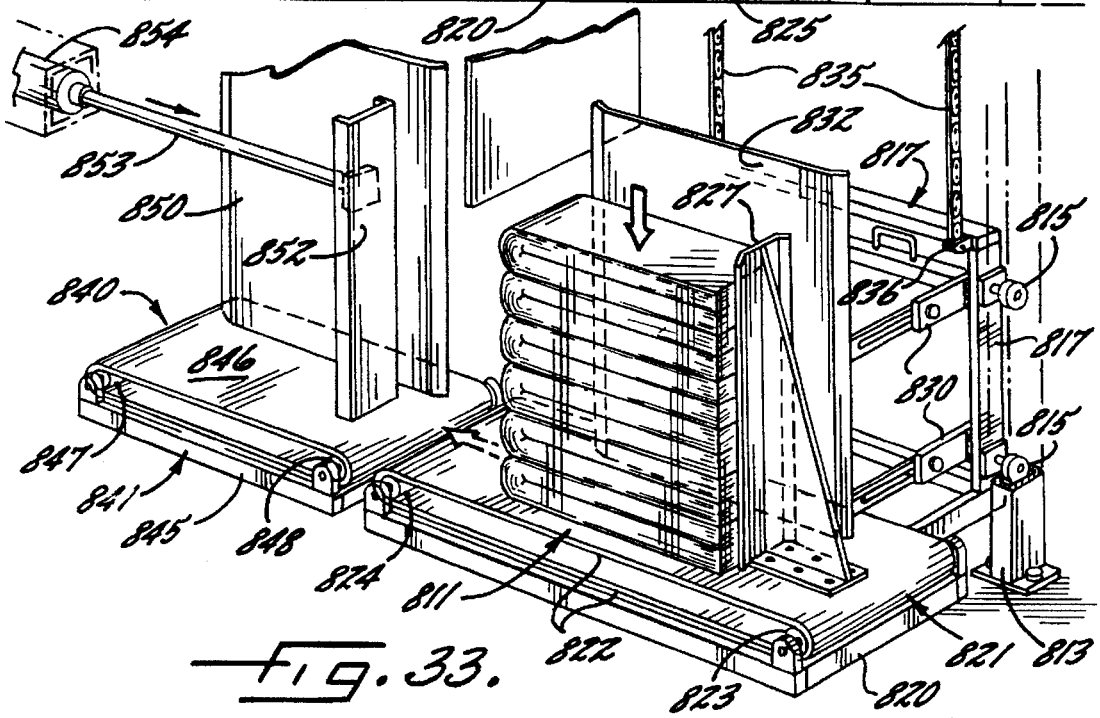
FIG. 33 is a perspective view of the batt stacker illustrated in FIGS. 31 and 32 and the transfer mechanism for transferring the stack of batts from the batt stacker to the out-feed and subsequent processing portions of the process of this invention.

Referring now to FIGS. 31 through 43, the batt packaging mechanism of the present invention will now be described. The folded batt conveyor 690 has its delivery end disposed adjacent the entry end of a transfer conveyor 810 which has its entry end at a level to receive the folded batts of insulation material from the conveyor 690, and is inclined upwardly to a delivery end where the conveyor 810 delivers the folded batts of insulation material to a batt stacker, generally indicated at 811 (FIGS. 31 through 33). Batt stacker 811 includes a vertically movable platform 812 mounted for vertical reciprocatory movement on guide columns 813, 814 by pairs of rollers 815, 816. Rollers 815, 816 are carried by a vertical frame 817 on which the horizontal platform 820 is mounted in cantilevered fashion.

Horizontal platform 820 has mounted thereon a conveyor 821 including a conveyor belt 822 mounted at opposite ends by rollers 823, 824. Roller 824 is driven by a motor 825 through a gear box 826. Motor 825 is a reversible motor that drives the conveyor belt 822 in one direction to deliver a stack of batts therefrom and then in the opposite direction to return the conveyor to a position to receive the next stack of batts thereon. To that end, conveyor belt 822 has mounted thereon an upstanding pusher member 827 which travels back and forth with conveyor belt 822 and is adapted to contact the ends of the individual folded batts in the stack being formed to position the individual batts in aligned, superposed position within the stack.

The vertical frame 817 includes pairs of adjustable horizontal arms 830, 831 which carry a side position plate member 832 at their outer ends. Plate member 832 overlies the conveyor belt 822 and is adapted to receive one side of the folded batts thereagainst to position the folded bats medially of the conveyor belt 822 and in superposed alignment within the stack being formed. The plate member 832 is stationary and does not travel with conveyor belt 822.

The platform 812 is indexed downwardly by a reversible indexing motor 833 which drives a gear box and drive sprocket 834, which, in turn, drives a chain 835. Chain 835 is connected at one end to the top of the vertical frame 817 as indicated at 836 and is connected at its other end to a cable 837, which is trained about an idler pulley 838 intermediate its ends and is connected at its other end to the movable frame 817 by a turnbuckle 839.

When a stack of batts is desired to be formed, the vertically movable platform means 812 is moved upwardly by the indexing motor 833 to position the conveyor belt 822 at a proper level to receive the initial folded batt from the conveyor 810 (FIG. 31). As soon as the conveyor 810 delivers a batt onto the conveyor 822, with one end thereof against the vertical pusher member 827 and one side thereof against positioning plate 832, the motor 833 is activated to index the platform 812 downwardly a distance equal to the vertical height of the folded batt on the conveyor belt 822. This indexing and stacking operation is repeated for each successive batt delivered by conveyor 810 until the desired height of folded batts is received on the platform 812. As illustrated in the drawings, the preferred number of folded batts is six, such that the height of the stack of batts is approximately 48 inches or four feet. Once the desired height of the stack of batts is received on the conveyor belt 822, the platform 812 is at its lowermost position and is aligned with a batt transfer mechanism, generally referred to at 840 (FIGS. 32 and 33).

Batt transfer mechanism 840 includes a vertically movable platform means, generally indicated at 841, which is mounted, for vertical movement on vertical guide columns 842 by a vertical frame 843 carrying rollers 844 thereon disposed within the vertical guide columns 842. The vertically movable platform means 841 includes a horizontal platform 845 mounted, in a cantilever manner, on the vertical frame 843 for movement therewith. Horizontal platform 845 has mounted thereon a conveyor belt 846 trained at opposite ends about rollers 847 and 848. Conveyor belt 846 is driven, similarly to conveyor belt 822, by a drive mechanism (not shown).

Figure 34:
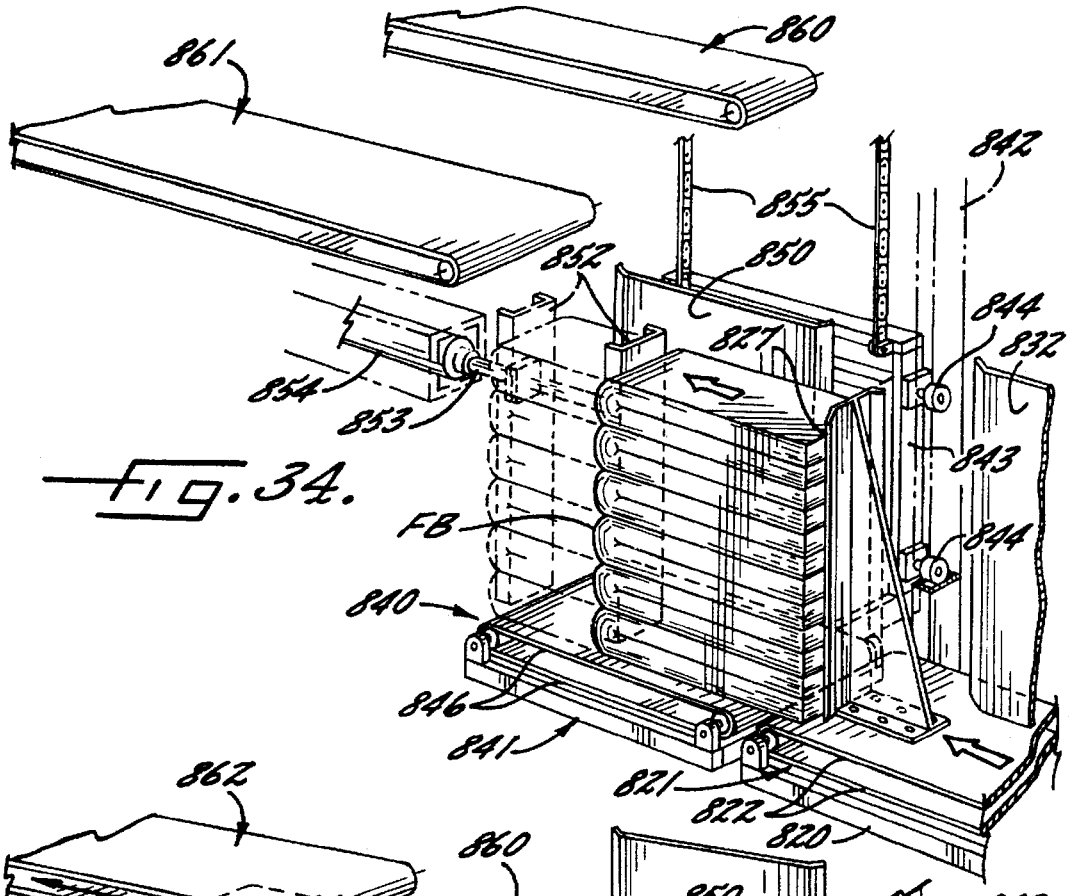
FIG. 34 is a view similar to FIG. 33 illustrating the operation of the transfer mechanism for transferring the stack of batts from the batt stacker to the beginning of the out-feed mechanism, with portions thereof in different operational positions.

A side positioning plate member 850 is carried on vertical frame 843 by pairs of adjustable arms 851 for movement vertically with the platform means 841. An end positioning member 852 is carried by the outer end of a piston rod 853 of a pneumatic cylinder 854 for engagement with the end of the stack of folded batts opposite the end positioning member 827 on conveyor belt 822 as the stack of batts is transferred from conveyor belt 822 onto conveyor belt 846. As the batts continue to be pushed off of the conveyor belt 822 onto conveyor belt 846, the end positioning member 852 is slowly forced back and the piston rod 853 is retracted into the cylinder 854 while firmly holding the stack of batts between the end positioning member 827 and end positioning member 852 above conveyor 846 (FIG. 34). Once the stack of folded batts is fully delivered off of conveyor belt 822 onto conveyor belt 846, the conveyor belt 822 is reversed and returns to its original position for receipt of the next successive stack of batts thereon. At that time, the motor 833 is activated to raise the platform 812 to its upper position for receipt and formation of the next stack of batts.

Once a full stack of folded batts is received on conveyor belt 846, platform 841 is raised vertically by chains 855 by a drive mechanism (not shown) similar to drive means 833, 834 for platform 812, until the platform 841 reaches its uppermost position. Disposed above platform 841 when in its upper, discharge position is a top conveyor belt 860 which is driven in a manner not shown to assist conveyor belt 846 in delivering the stack of batts off of conveyor belt 846. Preferably, top conveyor 860 is positioned at a height above platform 841 when platform 841 is in its upper, discharge position a distance less than the uncompressed height of the stack of folded batts carried by platform 841 such that the stack of folded batts is compressed between the conveyor belt 846 and top conveyor 860.

Figure 35:
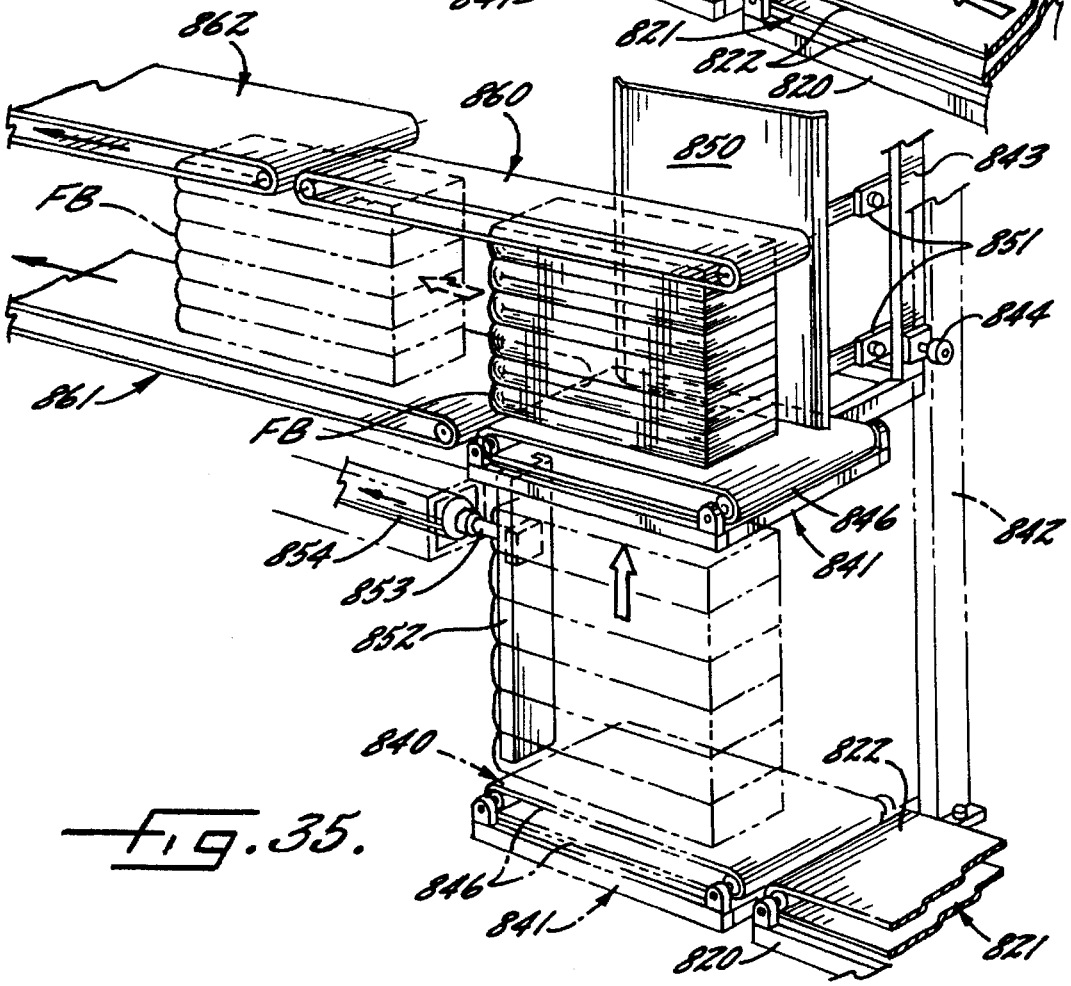
FIG. 35 is a view similar to FIG. 34 with the transfer and out-feed mechanism in different operational positions.

When in its upper discharge position, conveyor belt 846 has its top run aligned with the top run of a conveyor 861, which underlies the top conveyor 860 for receipt of the stack of folded batts from conveyor belt 846 and conveyor 860 and to convey the stack of batts to an additional section of the batt packing mechanism. A second top conveyor 862 is positioned in alignment with top conveyor 860 above delivery conveyor 861 for co-action with conveyor 861 in conveying the stack of batts from the conveyor 846 for further processing (FIG. 35).

Figure 37:
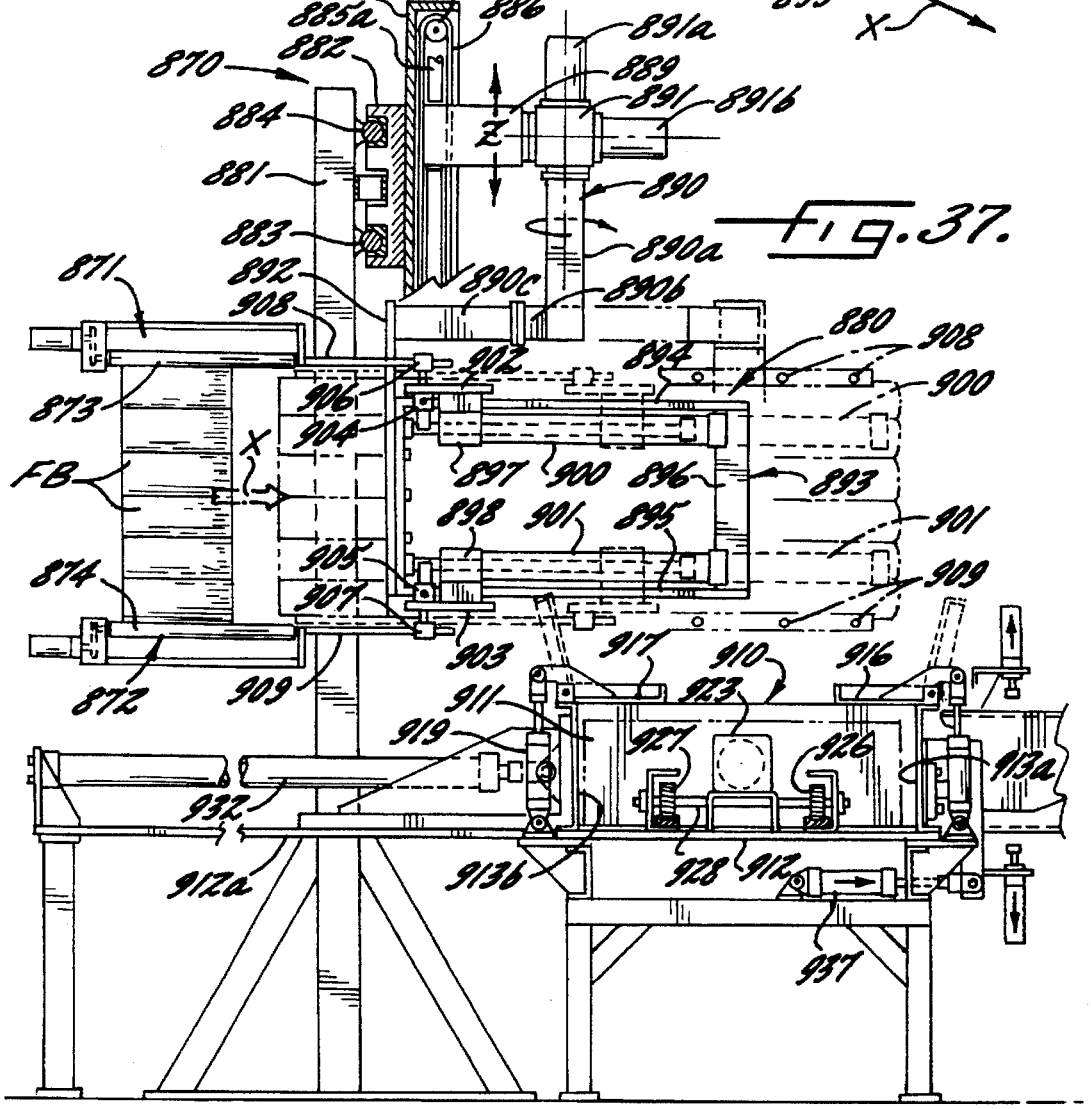
FIG. 37 is a sectional view taken substantially line 37—37 in FIG. 36.

Conveyors 861 and 862 deliver successive stacks of folded batts to a robot transfer mechanism 870. Robot transfer mechanism 870 includes upper and lower roller conveyors 871, 872 which have the rollers 873, 874 thereof aligned with the conveyor means 861 and 862 for receipt of the stack of folded batts therefrom. The rollers 873 and 874 are spaced apart for cooperation with a robot pickup mechanism 880, which removes the stack of batts from the roller conveyors 861 and 862. Robot transfer mechanism 870 also includes a vertical support frame 881 on which a horizontal frame 882 is mounted for reciprocable horizontal movement along a pair of spaced tracks 883, 884 mounted on vertical frame 881 (FIG. 37). Suitable means (not shown) is connected to the horizontal frame member 882 for moving the frame 882 along the tracks 883 and 884 to position properly the robot pickup mechanism 880 relative to the roller conveyors 871 and 872. Horizontal support member 882 has stationarily mounted thereon a vertical support member 885 which has mounted therein a chain 886 trained about upper and lower sprockets 887, 888. Chain 886 is connected at its opposite ends to a support arm 889 which extends outwardly therefrom. The support arm 889 is also supported by the vertical frame 885 and guide rods 885*a* therein for sliding vertical movement. The chain 886 is being driven in a reversible manner by suitable drive means (not shown) to move the support arm 889 vertically.

A support arm 890 is rotatably mounted on arm 889 by a universal mounting head 891 for rotation about a first axis aligned with the longitudinal centerline of arm 890, and a second axis perpendicular thereto. Arm 890 includes a first portion 890*a* which extends transversely up and outwardly from the arm 889 on which it is rotatably mounted and a second arm portion 890*b* which extends at right angles to the arm portion 890*a*. These arm portions 890*a* and 890*b* are joined by an angled portion 890*c* which extends between arm portions 890*a* and 890*b* along a 45° angle. A suitable first drive motor 891*a* is connected to arm 890 for reversibly rotating arm 890 relative to arm 889 about the first axis, and a second drive motor 891*b* reversibly rotates arm 890 about the second axis for reasons to be presently described.

Robot pickup mechanism 880 includes a vertical support member 892 is fixedly mounted on the outer end of arm portion 890*b*. Vertical support member 892 has fixedly mounted thereon a frame 893 which extends horizontally outwardly therefrom and includes an upper horizontal member 894 and a lower horizontal member 895 connected at their outer ends by a vertical member 896. Upper and lower block members 897 and 898 are slideably mounted on the frame members 894 and 895. Block members 897 and 898 have fixedly mounted thereon for movement therewith pneumatic cylinders 900, 901, the piston rods of which are connected at their outer ends to the vertical frame support member 892. Accordingly, upon activation of the cylinders 900 and 901, the piston rods are fixed against movement and the cylinders will reciprocate carrying the blocks 897 and 898 therewith along the frame members 894 and 895.

Mounting plates 902 and 903 are respectively mounted on blocks 897 and 898 for movement therewith. Mounting plates 902 and 903 have mounted thereon pneumatic cylinders 904 and 905, the piston rods of which extend through the mounting plates 902 and 903 and have their outer ends mounting cross members 906 and 907 such that cross members 906 and 907 are vertically adjustable relative to the mounting plates 902, 903 and relative to each other. Cross members 906 and 907 mount a plurality of rods or fingers 908, 909 which extend horizontally outwardly therefrom.

Figure 36:
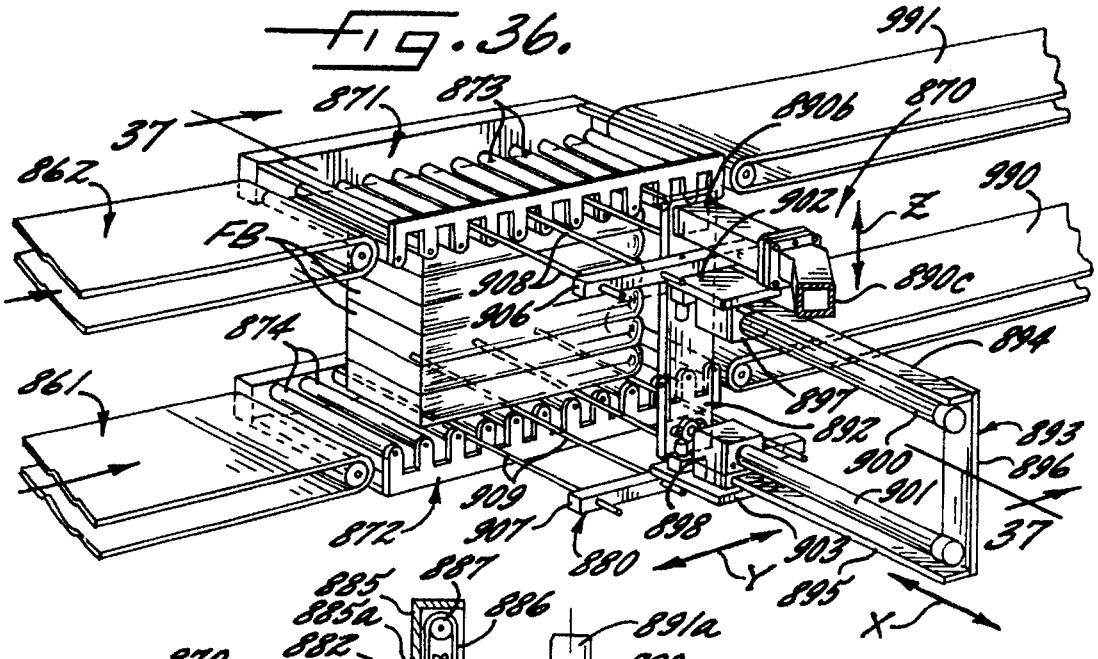
FIG. 36 is a fragmentary, somewhat schematic, perspective view illustrating the out-feed mechanism for conveying the stack of folded batts to the packaging station.

Before a stack of folded batts is delivered to the robot transfer mechanism 870, the robot pickup means 880 is positioned in the position shown in FIG. 36 with the fingers 908 and 909 extending across the roller conveyors 871, 872 between the rollers 873 and 874. The pneumatic cylinders 904 and 905 are extended such that the cross members 906, 907 are spread apart such that the fingers 908 and 909 will not contact the stack of folded batts when the same are fed onto the roller conveyors 871 and 872. Once a stack of folded batts have been received between lower conveyors 871 and 872, the pneumatic cylinders 904 and 905 are actuated to retract the piston rods thereof to move the cross members 906 and 907 toward each other and to cause the fingers 908 and 909 to squeeze the stack of folded batts together and to compress the same sufficiently so that the stack of batts may be removed from between the roller conveyors 871 and 872.

To accomplish such removal, the cylinders 900 and 901 are actuated to cause the cylinders to move laterally away from the conveyors 871 and 872 and to carry blocks 897 and 898 therewith which also carries the cross members 906 and 907 and fingers 908 and 909. In this manner, the stack of batts is withdrawn from between the roller conveyors 871 and 872.

Figure 38:
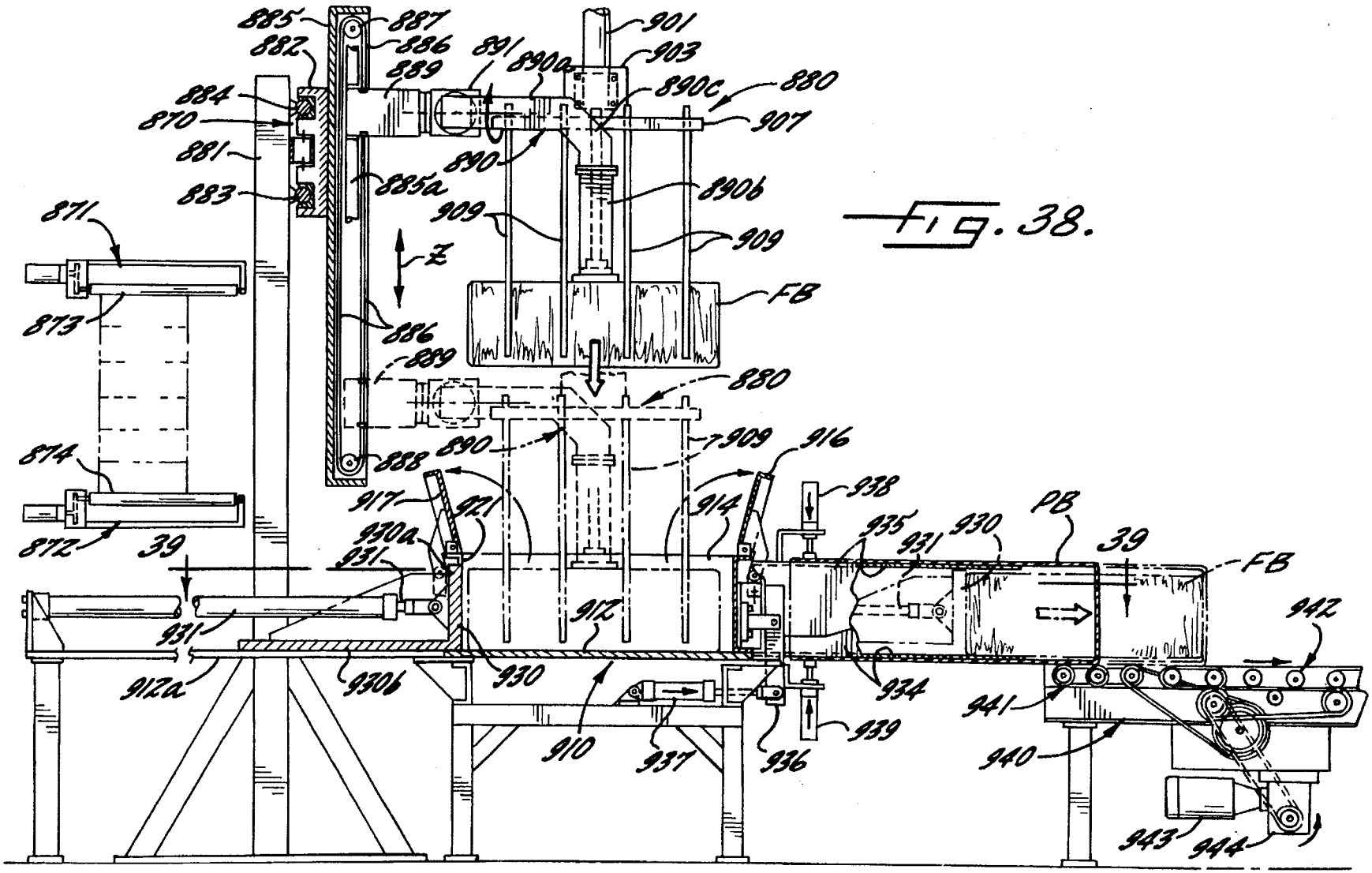
FIG. 38 is a sectional view of the batt packing station.

Once the stack of batts and the fingers 908 and 909 have cleared the roller conveyors, the motor 891*a* is activated to rotate the arm 890 90° to position the fingers 908 and 909 and the stack of batts above a batt compressor means, generally indicated at 910 (FIG. 38). The batt compressing means 910 comprises a housing 911 including a bottom wall 912, side walls 913*a*, 913*b*, a front wall 914 and a compressor member 915 forming the other end wall. A pair of pivotably mounted top wall segments 916 and 917 are provided for retaining the stack of folded batts within the compression chamber during compression thereof. A pair of pneumatic cylinders 918 and 919 are connected to the top walls 916 and 917 respectively for opening and closing these top wall segments.

Figures 39, 41:
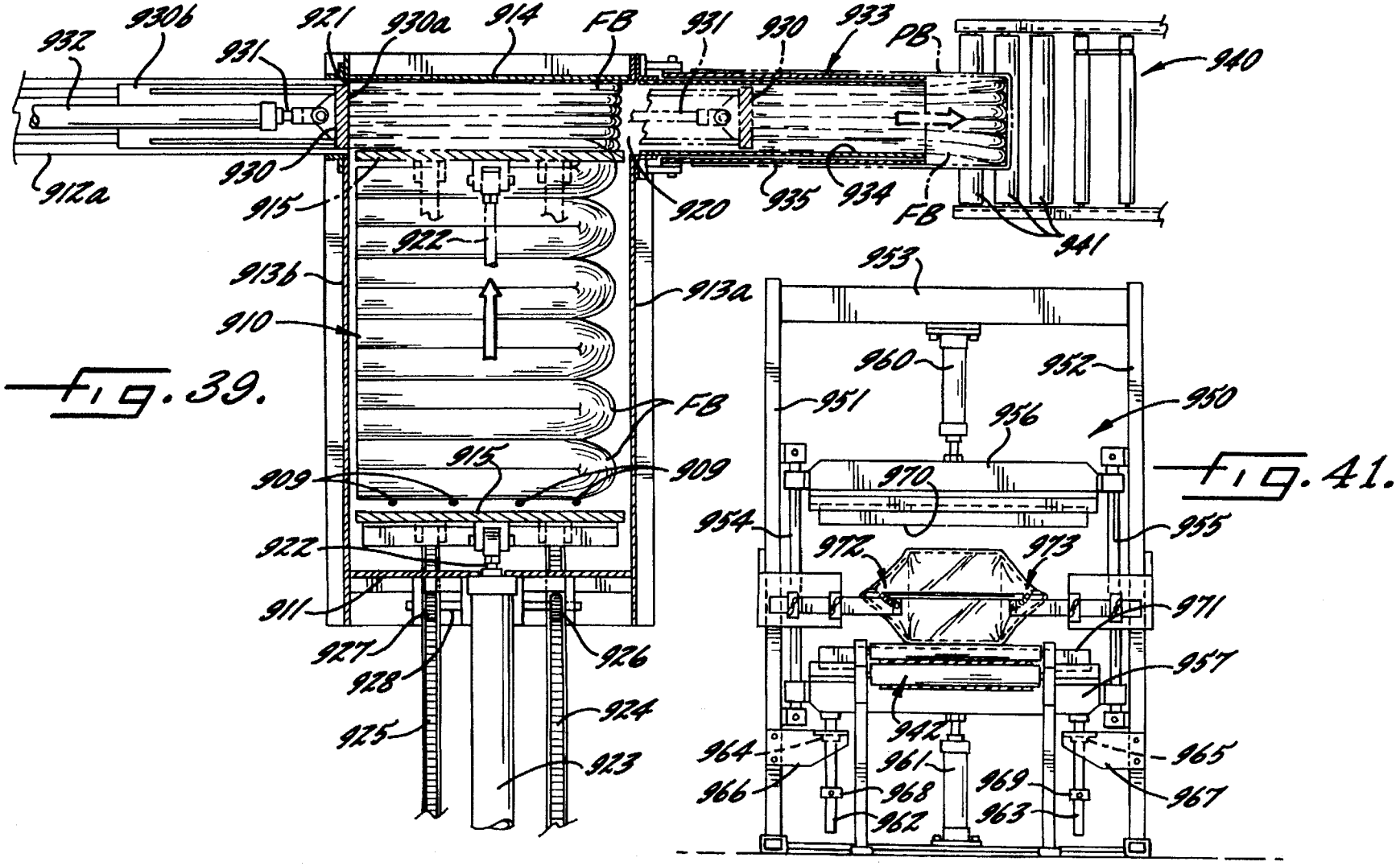
FIG. 39 is a sectional view taken substantially along line 39—39 in FIG. 38.
FIG. 41 is a vertical sectional view taken substantially along line 41—41 in FIG. 40.

As shown in FIG. 39, side walls 913*a* and 913*b* terminate short of the end wall 914 such that an opening 920 is provided in side wall 913*a* and an opening 921 is provided in the side wall 913*b*. Pusher member 915 is mounted for reciprocatory movement on bottom wall 912 and is connected to the outer end of a piston rod 922 of a pneumatic cylinder 923 which reciprocates the pusher member 915 within the compression chamber to compress the stack of batts placed therein. For stability, pusher member 915 has mounted to the rear thereof a pair of racks 924, 925 which reciprocate with the pusher member 915 and rest on the bottom wall 912. A pair of pinion gears 926, 927 are mounted by a shaft 928 so as to mesh with the teeth of racks 924 and 925, respectively, to hold the racks against the bottom wall 912 and to stabilize the pusher member 915 in its movement back and forth within the compression chamber.

A second pusher member 930 is positioned in opening 921 of the sidewall 913*b* and is carried by the outer end of a piston rod 931 of a pneumatic cylinder 932 for reciprocation transversely of the compression chamber through the opening 921, parallel to the end wall 914 and through the opening 920 in the side wall 913*a* to push the compressed stack of folded batts out of the compression chamber. For stability, pusher member 930 includes a vertical portion 930*a* adapted to engage the compressed stack of batts and a horizontal portion 930*b* which slides against the bottom wall 912 and an extension 912*a* thereof.

When it is desired to load a stack of folded batts into the compression chamber 910, the robot pickup means 880 is activated, as described above, to remove a stack of folded batts from the roller conveyors 871 and 872, the arm 890 is rotated about the first axis by first motor 891*a*, and then about the second axis by the second motor 891*b* to position the fingers 908 and 909 vertically with the free ends thereof pointing downwardly (FIG. 38). At that time, the indexing means 886 for the support arm 889 is activated to lower the support arm 889 and support arm 890 with the robot pickup means 880 downwardly to position the stack of folded batts within the compression means 910. Of course, prior to the lowering of the robot pickup means 880, the upper wall segments 916 and 917 are pivoted upwardly to the open position. The pneumatic cylinders 904 and 905 are actuated to spread apart the fingers 908 and 909 to release the stack of folded batts and the indexing means 886 raises the arm 889 and the remainder of the robot pickup means 880 upwardly and the procedure is reversed to again position the fingers 908 and 909 between the roller conveyors 871, 872 to receive another stack of folded batts.

Then, the top wall segments 916 and 917 are closed by cylinders 918 and 919 and the cylinder 923 is actuated to extend the piston rod 922 thereof to cause the pusher member 915 to move toward end-wall 914 and thereby compress the stack of folded batts into a highly compressed, reduced volume, form (FIG. 39). Then, cylinder 932 is actuated to extend the piston rod 931 thereof to cause pusher member 930 to push the compressed stack of folded batts out of the compression chamber through the opening 920.

Figure 40:
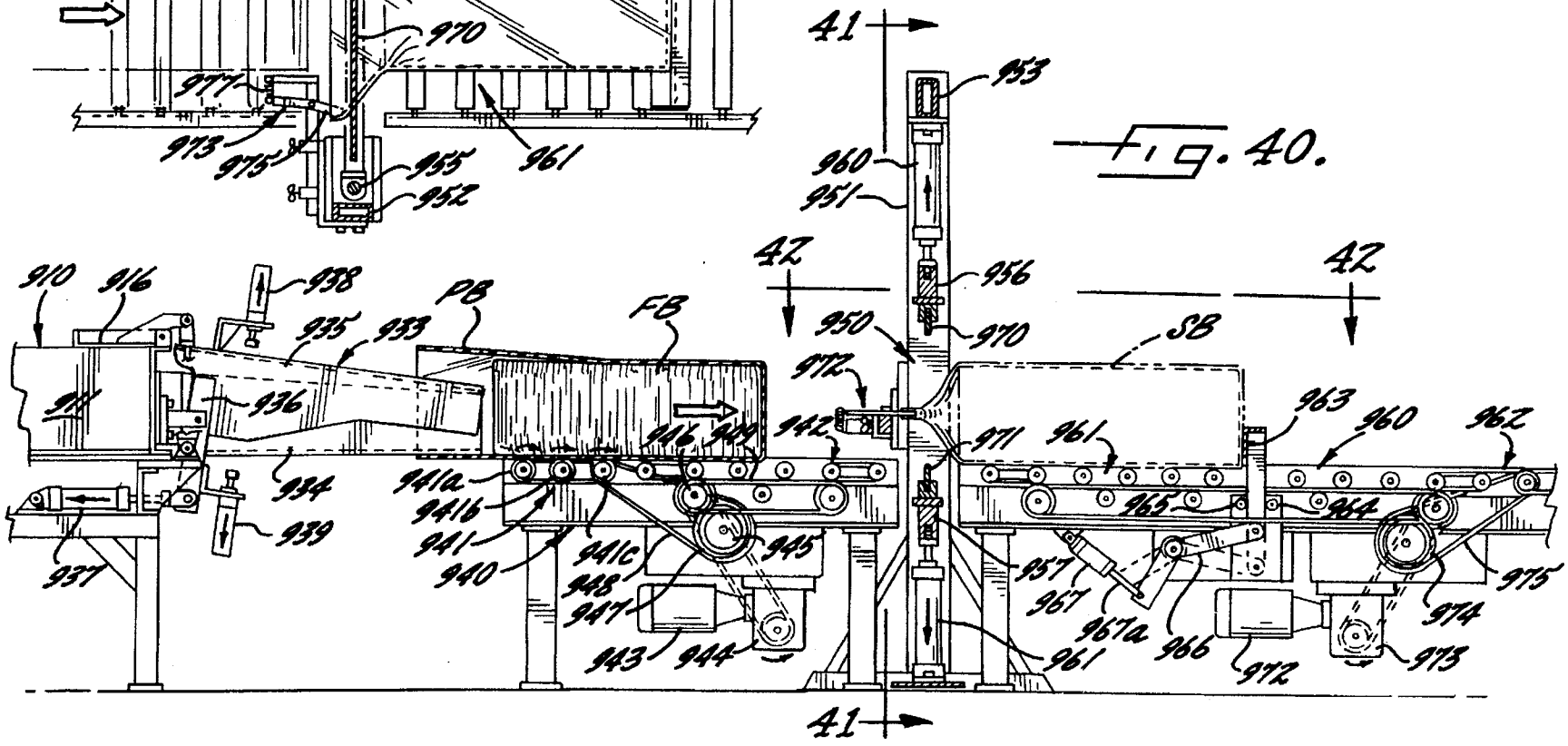
FIG. 40 is a sectional view of the batt packing and bag sealing portion of the process illustrated in FIGS. 38 and 39.
Figure 42:
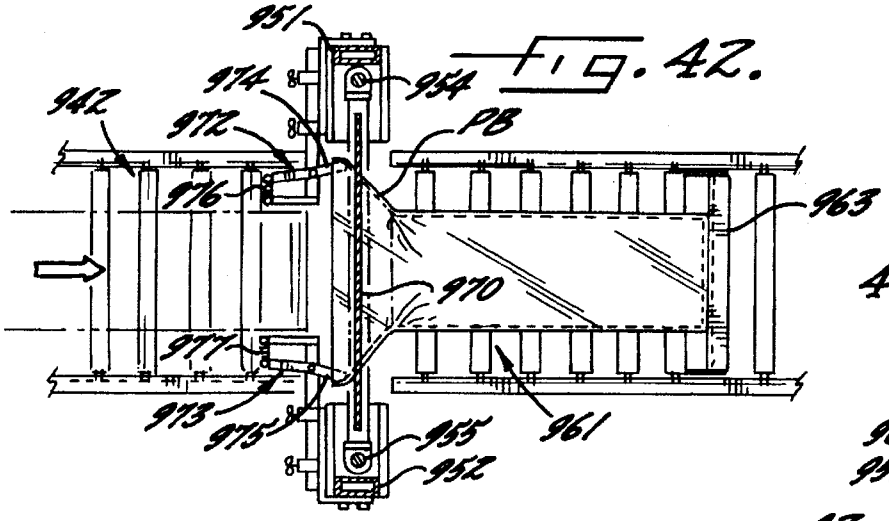
FIG. 42 is a horizontal sectional view taken substantially along line 42—42 in FIG. 40.

A packaging horn 933 is mounted on the side of the compression chamber means at the opening 920 (FIGS. 38, 39 and 40). Packaging horn 933 includes a lower stationary segment member 934 and an upper pivotably mounted segment member 935. Upper member 935 is carried by a pair of pivoted arms 936, the lower ends of which are connected to a pneumatic cylinder 937 for pivoting the arms 936 and thus moving the segment member 935 between a collapsed position shown in FIG. 40 and an open position shown in FIG. 38. Packaging horn 933 is adapted to receive the open end and a substantial portion of a plastic bag thereover and a pair of pneumatic cylinders 938 and 939 are provided above and beneath the members 935 and 934, respectively, for gripping the open end of the plastic bag against the horn 933 to hold the bag firmly in position during insertion of a compressed stack of folded batts therein.

In this regard, when the pusher member 930 is extended by the cylinder 932 across the compression chamber to push a compressed stack of folded batts through the opening 920, the stack of batts enters the packaging horn 933 which is in the open position. The pusher member 930 continues its path of travel until the compressed stack of batts clears the open end of the packaging horn 933 and is confined in the closed end portion of the plastic bag. At this time, the cylinder 932 retracts the pusher member 930 until the pusher member clears the horn 933 at which time the cylinder 934 collapses the horn while the cylinders 938 and 939 release the plastic bag. The collapsed stack of folded batts expand to some extent but not to an extent that will cause the same to exit the open end of the bag.

The filled, but unsealed, bag of compressed folded batts is pushed off of the end of the packaging horn 933 onto the entry end of a roller conveyor 940. The roller conveyor 940 includes a first roller section 941 comprising three rollers 941*a*, 941*b* and 941*c* of larger diameter than the remaining rollers of the remaining roller section 942. The rollers of roller conveyor 940 are driven by a motor 943 through a gear box 944 driving a pulley transmission 945. Pulley transmission 945 includes a first pulley 946 of a relatively small diameter and a second pulley 947 of larger diameter. The large pulley 947 drives the roll section 941 through a belt 948 while the smaller pulley 946 drives the second roller section 942 through a belt 949. In this manner, the initial roll section 941 is driven at a faster speed than is the second roll section 942 such that the filled plastic bag is removed from the packaging horn 933 at a relatively rapid rate and is thus delivered onto the second roller conveyor section 942 which feeds the bag away from the first roller section 941 at a slower speed.

Mounted adjacent the delivery end of the lower conveyor section 942 is a bag sealer means 950. On the opposite side of the bag sealer means 950 is another roller conveyor means 960 which receives the filled plastic bag from the roller conveyor 940. The roller conveyor 960 includes a first roller section 961 and a second roller section 962. The roller sections 961 and 962 are separated by a stop member 963 which is mounted for vertical movement by a pair of guide rollers 964, 965. The lower end of stop member 963 is pivotably connected to one leg of a crank arm 966 the other leg of which is connected to a pneumatic cylinder 967. Thusly, cylinder 967 can raise or lower the stop means 963 by extending or retracting the piston 967*a* thereof.

The sealing station 950 includes a pair of vertical columns 951, 952 and an upper cross beam 953 (FIG. 41). Columns 951 and 952 have a pair of guide rods 954, 955 mounted thereon. Guide rods 954 and 955 have an upper sealing member 956 and a lower sealing member 957 slideably mounted thereon for vertical reciprocation toward and away from each other. An upper pneumatic cylinder 960 reciprocates upper sealing member 956 upwardly and downwardly on the guide rods 954 and 955 and a lower pneumatic cylinder 961 reciprocates lower sealing member 957 in like manner. Lower sealing member 957 has a pair of guide rods 962, 963 mounted adjacent opposite ends thereof and depending downwardly therefrom. Guide bars 962 and 963 are guided in their vertical movement by bearings 964, 965 mounted on brackets 966, 967 carried by the vertical columns 951 and 952. Stop collars 968 and 969 are adjustably mounted on the guide bars 962 and 963 to limit the upward movement of the lower sealing member 957.

The upper sealing member 956 carries a heated sealing bar 970 on the lower surface thereof and extending downwardly therefrom. Similarly, lower sealing member 957 carries a sealing bar 971 on the upper surface thereof and extending longitudinally therealong. The sealing bars 970 and 971 are heated to a temperature sufficient to heat seal the plastic bag having the compressed stack of folded batts therein to close the open end thereof. To assist in sealing the open end of the plastic bag, spreader means 972 and 973 are provided at opposite sides of the conveyor 940 and are adjustably carried on the vertical columns 951 and 952. Spreader means 972 and 973 include pivotably mounted spreading fingers 974, 975 which are spring biased by springs 976, 977 toward the spread position.

When a filled, but unsealed, plastic bag is delivered by conveyor 940 onto conveyor section 961 and stop member 963 is engaged thereby, the spreader fingers 974 and 975 are inserted in the open end of the bag and the springs 976 and 977 pivot the spreader members 974 and 975 to spread the open end of the bag and flatten the open end of the bag by bringing opposed top and bottom walls of the bag relatively close together. At that time, the cylinders 960 and 961 are activated to lower and raise the upper and lower sealing members 956 and 957 to bring the heated sealing bars 970 and 971 into sealing contact with the flattened open end of the plastic bag. The plastic bag open end is thus heat sealed closed. The cylinders 960 and 961 are reversed to retract the sealing bars 970 and 971 out of contact with the plastic bag and the cylinder 967 is activated to retract the stop member 963 downwardly to permit the roller conveyor 960 to convey the sealed plastic bag away from the sealing station 950.

The rollers of the conveyor 960 are driven by a motor 972 through a gear box 973 and a pulley transmission 974. Conveyor section 962 of conveyor 960 is itself formed in two sections, 962*a* and 962*b*. 962*b* is driven by the pulley transmission 974 by belt 975 at a faster speed than the section 961 rollers and the initial section 962*a* rollers of conveyor section 962 such that the rollers of section 962*b* feed the sealed plastic bag off of conveyor 960 at a faster rate than the plastic bag is conveyed along the remainder of conveyor 960. The fast exit section 962*b* feeds the sealed bag therefrom onto the package delivery conveyor 806. Conveyor 806 comprises a roller conveyor extending at right angles to the conveyor 960 and includes rollers 980 that are driven by a pair of drive belts 981, 982 disposed beneath the rollers 980.

Referring now back to FIGS. 1C and 36, the robot transfer mechanism 870 heretofore described and the folded batt packaging mechanism is sized and constructed for removing, compressing and packaging folded batts of insulation material for residential use. For commercial insulation material, the heretofore described robot transfer and batt packaging means would not be utilized, but the stack of folded batts of commercial building insulation would pass through and between the roller conveyors 871 and 872 onto extension belt conveyors 990 and 991 which receive the stack of folded batts of commercial building insulation therebetween and convey such stacks of insulation material to a transfer station 992 and a pair of batt packaging stations 993 and 994. The stack of batts, compressor, packaging means, sealers and conveyors are identical to the corresponding apparatus previously described for use with residential type insulation material except as to size and, therefore, will not be shown in detail nor described further herein.

It is noted, however, that the robot transfer means 870 is mounted for translational movement along the conveyors 990, 991 such that it can be moved between the residential insulation material packaging stations and the commercial insulation packaging stations. In this manner, only one robot transfer means 870 is required.

Figure 44:
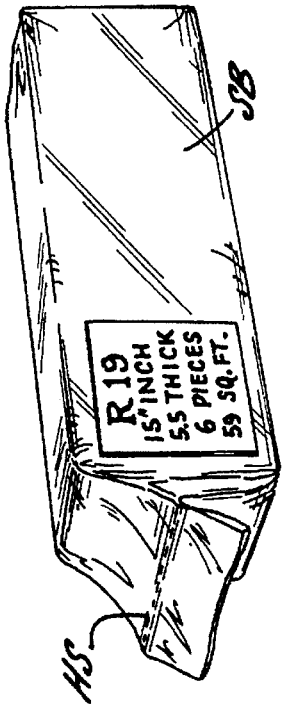
FIG. 44 is a perspective view of a package of folded insulation batts produced by the process illustrated in FIGS. 1A–43, inclusive.
Figure 43:
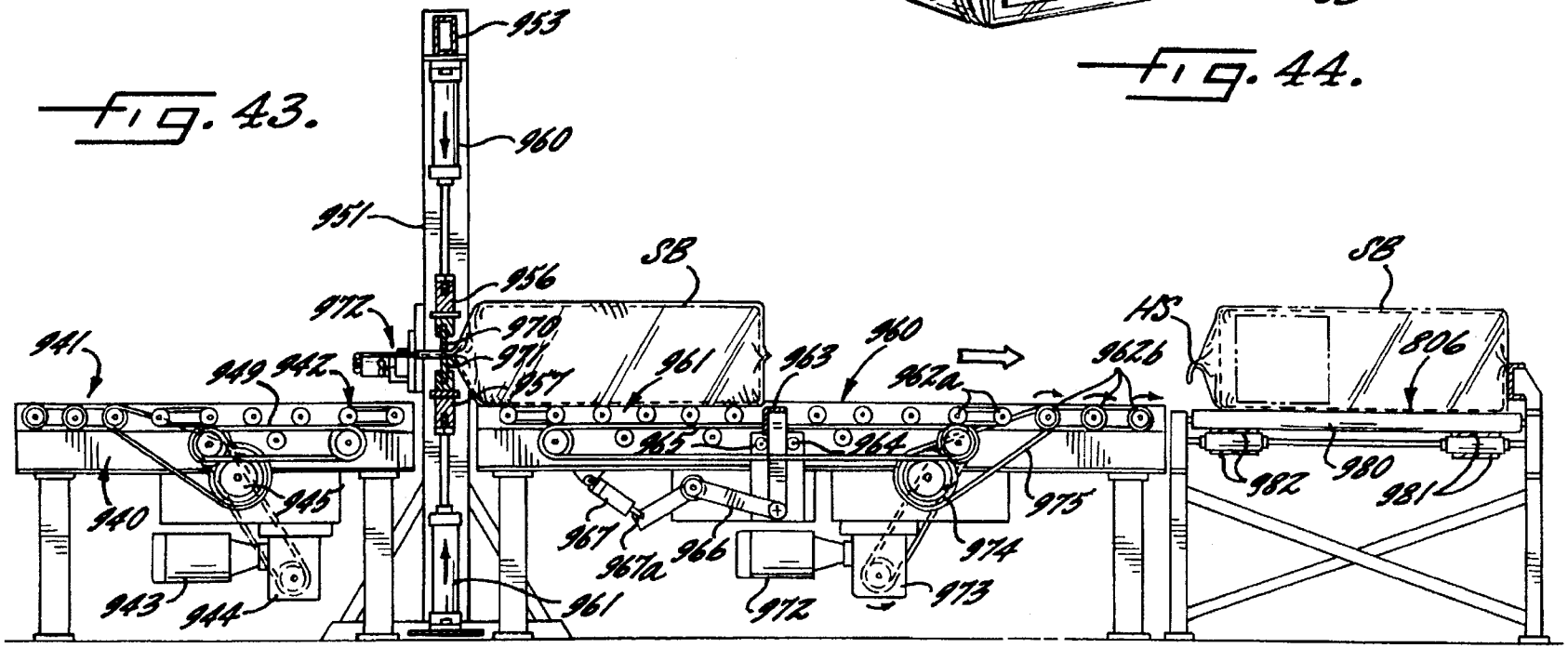
FIG. 43 is a sectional view similar to FIG. 40 illustrating the bag sealing and out-feed delivery from the batt packing station.

Conveyor 806 receives the sealed bags of folded batts of insulation, shown in FIG. 44, or bags of rolls of insulation from the batt packers and sealers or from the roll packers and sealers and delivers the same sequentially to stacking and packaging stations. Conveyor 806 has a fixed stop member 995 at its delivery end and a movable stop member 996 spaced upstream from the fixed stop member 995 and mounted for vertical movement between an inactive position below conveyor 806 and an active position above conveyor 806 to serve as a temporary stop for packaged insulation material being conveyed along conveyor 806.

First, second and third package sensing means 997, 998 and 999 are mounted on one side of conveyor 806 in spaced relation to each other to detect the presence or absence of packages of insulation material at that location on conveyor 806. Sensing means 997 is spaced from the fixed stop member 995 a distance less than the front-to-back dimension of a package of insulation material. Sensing means 998 is spaced from sensing means 997 a distance approximately the same as the front-to-back dimension of a package of insulation material and sensing means 999 is spaced from sensing means 998 a corresponding distance. When a first package of insulation material is conveyed by conveyor 806 to the delivery end thereof and passes sensing means 998 and 999 and arrives at the fixed stop member 995, sensing means 997 will remain activated but sensing means 998 and 999 will be only temporarily activated. When second and third packages of folded batt insulation arrive at the sensing means 998 and then 999, all three sensing means will be continuously activated.

At that time, the temporary stop member 996 will be raised into position above conveyor 806 by its reciprocating means (not shown), which is very similar to the mechanism for raising and lowering the stop means 963 previously described. With the temporary stop member 996 raised, subsequent packages of insulation material being conveyed by conveyor 806 will be stopped by the temporary stop 996 in spaced relation to the three packages of insulation material resting on the delivery end of the conveyor 806 in juxtaposed relation.

Figure 45:
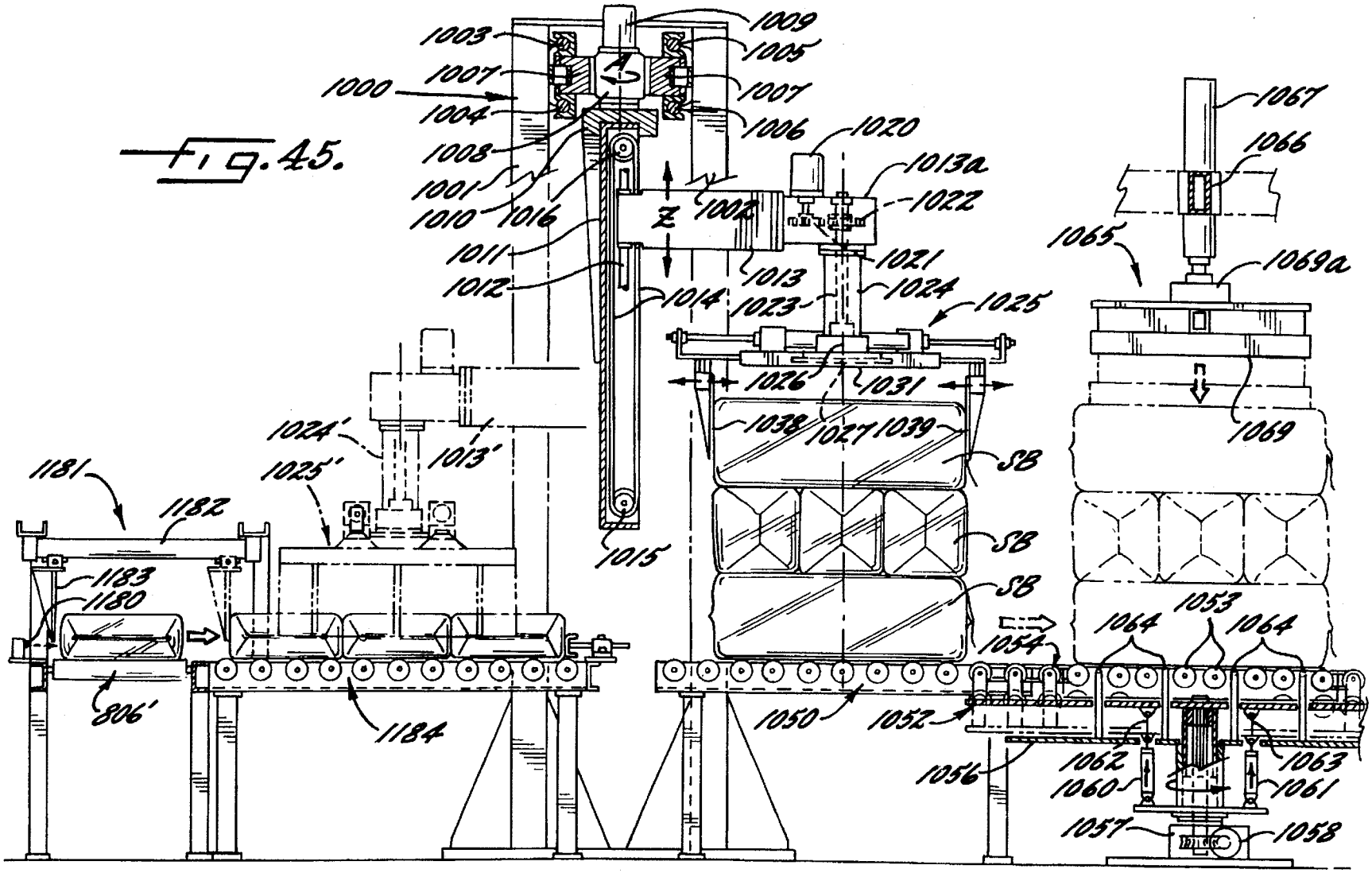
FIG. 45 is a fragmentary, somewhat schematic, sectional view illustrating the insulation package stacker and wrapping station.

A robot stacker, generally indicated at 1000 (FIGS. 45 and 46), is provided at this stacking station. Robot stacker 1000 includes a pair of vertical columns 1001 and 1002, which respectively have upper and lower tracks 1003, 1004, 1005 and 1006 mounted thereon and extending horizontally in facing relation to each other thereon. A carriage 1007 is mounted on the tracks 1003, 1004, 1005 and 1006 for sliding horizontal movement along the tracks to provide for movement of the robot stacking means in a first horizontal Y axis by drive means (not shown). Carriage 1007 has mounted thereon a rotatable head 1008 for rotation about a first vertical axis. A reversible motor 1009 is carried by carriage 1007 and connected to the rotatable head 1008 for rotating the head about the first axis for reasons to be hereinafter described.

A support member 1010 is carried by the rotatable head 1008 in depending relation thereto for rotation therewith. Support member 1010 mounts thereon a support housing 1011 which is open along one side and extends vertically downwardly from support member 1010 for a sufficient distance to provide the necessary range of vertical motion for the robot stacking means 1000. Suitable guide rods 1012 are mounted in the housing 1011 and slideably receive a robot support arm 1013 thereon for sliding relative movement upwardly and downwardly relative to the housing 1011. A suitable drive means, comprising a belt 1014 connected at its opposite ends to the arm 1013 and trained about a bottom pulley 1015 and a top pulley 1016, is driven in a suitable manner (not shown) for movement of the arm 1013 upwardly and downwardly upon demand.

Arm 1013 has an outer end support housing **1013*a* which carries a reversible motor 1020 on the top thereof and which has a drive pinion 1021 on the output shaft which meshes with a driven gear 1022 fixed on a drive shaft 1023 journaled in housing 1013*a*. A vertical support member 1024 is carried by the lower outer end portion of housing 1013*a*** and depends downwardly therefrom.

A robot head 1025 is carried by the lower end of column 1024 and includes a base member 1026 and a support plate 1027 mounted to the bottom of the base plate 1026. A pair of support slide members 1030 and 1031 are affixed to opposite sides of the support plate 1027. Guide members 1030 and 1031 are hollow and have slideably mounted therein a pair of slideable support members 1032, 1033, respectively. The guide member 1032 has mounted on the outer end 1034 thereof a cross member 1036 while guide member 1033 has a cross member 1037 mounted on the outer end 1035. Cross members 1036 and 1037 have clamping members 1038 and 1039 mounted thereon depending downwardly from the cross members 1036 and 1037 a predetermined distance.

A pneumatic cylinder 1040 is carried by the guide member 1030 and has the piston rod 1041 thereof connected to the support member 1032 for moving the support member 1032 inwardly and outwardly relative to the guide member 1030 to move the cross member 1036 and clamping plate 1038 inwardly and outwardly with respect thereto. A similar pneumatic cylinder 1042 is carried by the guide member 1031 and has its piston member 1043 connected to support member 1033 for similar movement of the clamping plate 1039. In this manner, the clamping plates 1038 and 1039 may be moved inwardly and outwardly relative to each other to clamp a set of three packages of insulation therebetween.

When all three of the sensing means 997, 998 and 999 are activated, and remain activated for a predetermined period, the robot stacking means 1000 will be activated to move the robot stacker to position the arm 1013 and the head 1025 above the three packages of insulation material with the clamping members 1038 and 1039 disposed above the opposite ends of the juxtaposed three packages. The belt 1014 will then be activated to lower the head 1025 downwardly until the clamping members are disposed outwardly of the ends of the three packages and in position to engage the ends of the three packages. At that time, the pneumatic cylinders 1040 and 1042 will be activated to move the clamping plates 1038 and 1039 toward each other until the three packages of insulation material are firmly clamped thereby.

Figure 46:
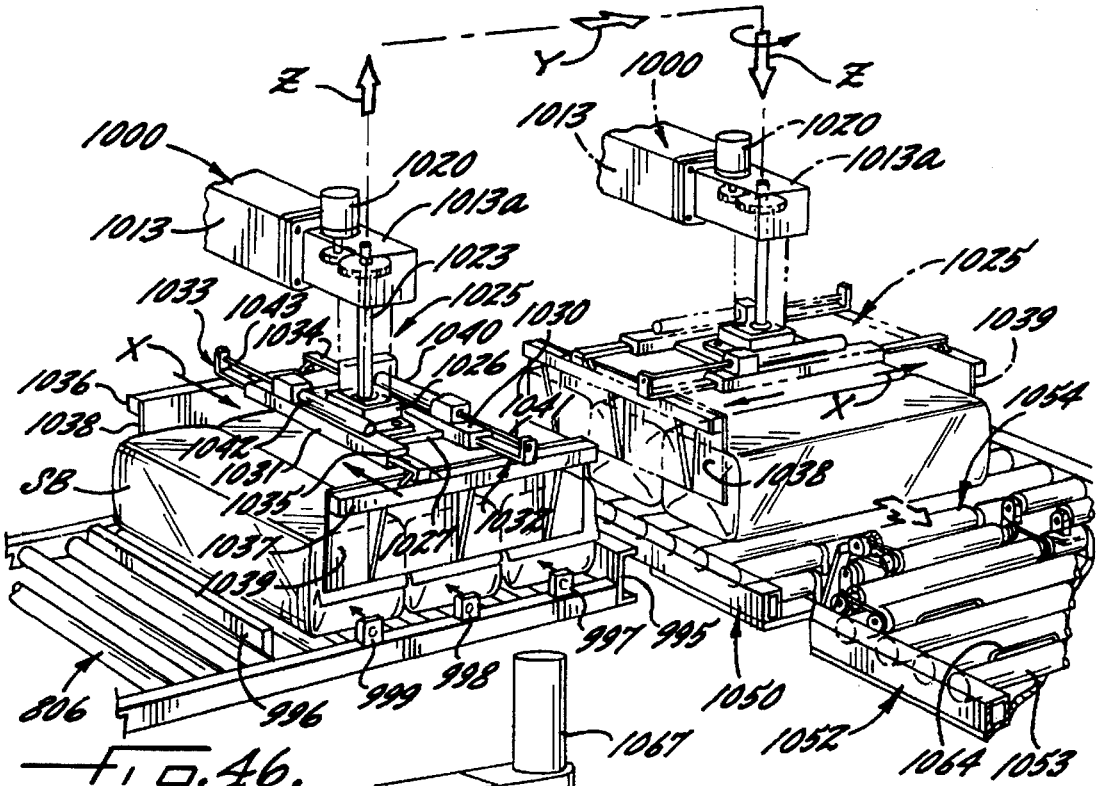
FIG. 46 is a fragmentary, somewhat schematic, perspective view illustrating the stacking operation.

Then, the belt 1014 will be reversed to raise the head 1025 upwardly and to lift the three packages of insulation material upwardly therewith. When the belt 1014 reaches its predetermined upper position, the drive means (not shown) will be activated to move the carriage 1007 and the robot mechanism depending therefrom along the tracks 1003–1006 to position the three clamped packages of insulation material above a stacking conveyor 1050 (FIG. 46). At that time, the belt 1014 will be activated to lower the clamping head 1025 downwardly to position the clamped three packages of insulation material on the stacking conveyor 1050. The cylinders 1040 and 1042 will be reversed to move the clamping plates 1038 and 1039 apart to release the three packages of insulation material. Belt 1014 will then be reversed to raise the robot head 1025 upwardly and the drive means (not shown) will be reversed to move the robot mechanism back into position above the discharge end of conveyor 806.

Meanwhile, the temporary stop member 996 has been lowered such that an additional three packages of insulation material can be delivered by conveyor 806 into position against stop member 995 and in line with the sensing means 997–999. When the robot head 1025 is in position above the delivery end of conveyor 806, the same will be lowered again into clamping position and will clamp the next three packages of insulation material in position on the delivery end of conveyor 806 in the same manner as previously described. The clamping robot head 1025 will then be raised by belt 1014 and moved by the drive means (not shown) into position above the stacking conveyor 1050 and the first layer of three packages resting thereon. At that time, the motor 1020 will be activated to rotate the robot head 1025 through one quarter of a revolution or 90° to position the second layer of three packages of insulation material transversely of the first layer resting on the stacking conveyor 1050. When this degree of rotation has occurred, the conveyor 1014 will lower the robot head 1025 downwardly until the three packages rest on the first layer of packages at which time the clamping plates 1038 and 1039 will be released and the robot head 1025 will be raised back to its upper position and the motor 1020 will be reversed to rotate the robot head 1025 back to its original orientation.

The robot head 1025 will then be returned to a position above the delivery end of conveyor 806 where three additional packages should be in position to be transferred. The robot head 1025 will then be lowered and the three additional packages will be clamped, raised and transferred in the manner previously described into position above the first two layers of three packages resting on the stacking conveyor 1050. These last three packages, in the same orientation as the first layer, will be lowered onto the first two layers, and the clamping plates 1038 and 1039 will be released. The robot head 1025 will then be raised and returned to its position above the delivery end of conveyor 860. This completes the package stacking operation with three layers of three packages in the stack.

Figure 47:
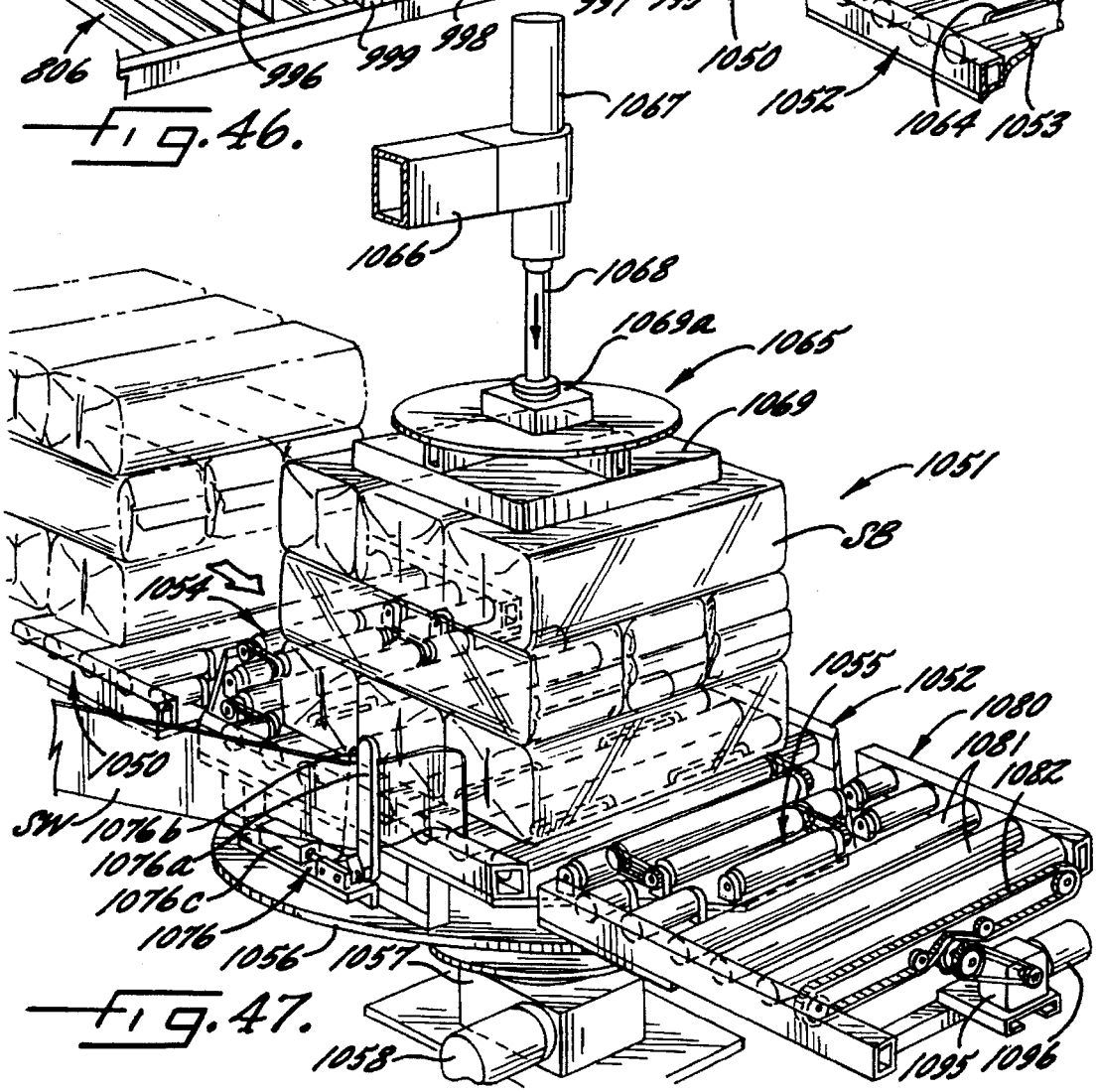
FIG. 47 is a fragmentary, somewhat schematic, perspective view illustrating the stack wrapping station.

The stacking conveyor 1050 will be activated to discharge the stack of packages off of the stacking conveyor into a first wrapping station 1051. Wrapping station 1051 includes a platform conveyor generally indicated 1052, which has driven rollers 1053 thereon for receiving and conveying the stack of packages of insulation material into proper position in the wrapping station 1051. The entry end of conveyor 1052 is referred to at 1054 and is tapered and received within an oppositely tapered recess in the delivery end portion of conveyor 1050. Similarly, a discharge end 1055 of conveyor 1052 is similarly tapered and received within the recess of a conveyor 1080. Conveyor 1052 is supported on a turntable 1056 that is ratably mounted on a support 1057 and is driven in rotation by a motor 1058 (FIG. 47). The conveyor 1052 is mounted on the turntable 1056 for vertical movement relative to the turntable 1056 such that the conveyor may be raised or lowered relative to the turntable 1056 and relative to the stacking conveyor 1050 and the out-feed conveyor 1080. Suitable pneumatic cylinders 1060 and 1061 (FIG. 45) are provided and have the piston rods 1062 and 1063 thereof connected to the conveyor 1052 to raise and lower the same between the two positions.

A plurality of stationary members 1064 are carried by turntable 1056 and extend upwardly through the base of conveyor 1052 and between the rollers 1053 of conveyor 1052 in position to engage the bottom of the stack of packages of insulation material when conveyor 1052 is lowered by the cylinders 1060 and 1061. When the conveyor 1052 is raised, these feet will be below the level of the rollers 1053 and will be out of contact with the stack of insulation material thereon. A hold-down mechanism 1065 is provided above the conveyor 1052 and includes an overhanging cantilevered support arm 1066 and a cylinder 1067 having the outer end of its piston rod 1068 carrying a hold-down head 1069 thereon.

When the conveyor 1052 is lowered by cylinders 1060 and 1061, the cylinder 1067 will be activated to lower the hold-down head 1069 into contact with the top of the stack and to hold firmly the stack downwardly against the stationary member 1064. Thereafter, the motor 1058 will be activated to rotate the turntable. It is noted that the hold-down head 1069 is rotatably mounted by a bearing block **1069*a* on the bottom end of the piston rod 1068 such that the same can freely rotate with the turntable, conveyor 1052** and stack of packages of insulation material.

A stack wrapping means 1070 is provided adjacent the wrapping station and adjacent the turntable 1056 and the conveyor 1052. The stack wrapping means 1070 includes a support column 1071 on which a carriage 1072 is mounted for vertical sliding movement. The carriage 1072 includes a supply roll 1073 of plastic film which is supplied through a series of feed and guide rolls 1074 to an application guide means 1075 through a gripper means 1076. The application guide means 1075 includes a heat sealing head **1075*a* moveable into and out of contact with the plastic film by a cylinder 1075*b*. Application guide means 1075 further includes a guide roll 1075*c* for guiding the plastic film from the gripper means 1076 and against the stack of packages of insulation material resting on feet 1064 above conveyor 1052**.

The gripper means 1076 includes a pair of clamping members **1076*a* and 1076*b* which are relatively movable by a pneumatic cylinder 1076*c*. When not in use to supply plastic film to wrap around the stack of packages of insulation material, the gripper means 1076 will be activated to firmly grip the plastic film material and hold it therebetween. When plastic film is being wrapped around the stack of packages, the gripper means 1076** will be open to permit the plastic film to be fed therethrough.

When it is desired to wrap a stack of packages of insulation material, and an appropriate stack of packages of insulation material is in position on the conveyor 1052, conveyor 1052 will be lowered by cylinders 1060 and 1061 downwardly to clear the stacking conveyor 1052 and the conveyors 1050 and 1080. Simultaneously, the hold-down head 1069 will be lowered into engagement with the top of the stack of packages and the heat sealing member 1075*a* will be extended by cylinder 1075*b* to heat seal the leading end of the plastic film to the plastic of the bag of one of the packages of insulation material in the lower layer of the stack. The gripper means 1076 will be released and the motor 1058 activated to commence rotation of the turntable 1056. As the turntable and the stack of packages thereon rotate, the plastic film will be supplied by guide rollers 1074 and application means 1075 from the supply roll 1073 and will wrap very tightly around the stack of packages of insulation material. Simultaneously therewith, the plastic film wrapping means 1070 will be indexed upwardly such that convolute wrappings of the plastic film will be wrapped around the stack until the stack is fully wrapped including the top layer thereof. At that time, the heat sealing member 1075*a* will again be advanced to heat seal the trailing end of the plastic film to the plastic bag of one of the top layer packages and the plastic film will be severed to complete this wrap. It is preferred that the bottom and top wraps extend below and above the bottom and top of the stack by a few inches such that the bottom and top wraps cup under and over the stack.

Upon completion of the wrapping of the plastic film about the stack of packages, the plastic film supply means 1070 will be lowered downwardly to its starting position and the gripper means 1076 will be activated to firmly clamp the leading end portion of the plastic film therein. The conveyor means 1052 will then be raised into alignment with the out-feed conveyor 1080 and the hold-down member 1069 will be retracted upwardly out of contact with the stack.

At that time, the conveyor 1052 will be activated to feed the wrapped stack of packages of insulation material from the conveyor 1052 onto the out-feed conveyor 1080. Conveyor 1080 includes a plurality of rollers 1081 which are driven to advance the wrapped stack of packages of insulation material onto the conveyor. Extending parallel to the rollers 1081 and between adjacent pairs of rollers are three conveyor chains 1082, 1083 and 1084.

Figure 48:
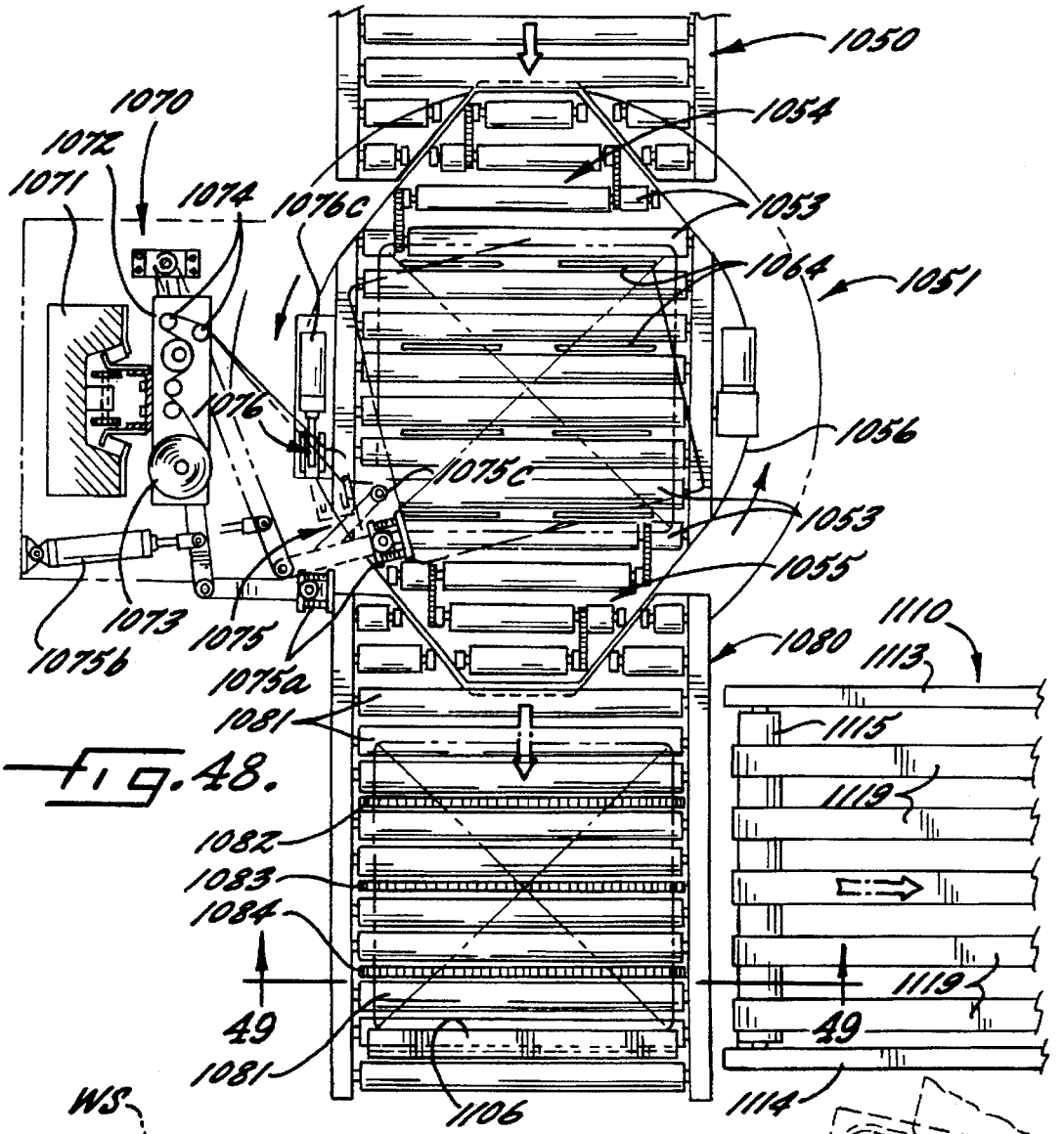
FIG. 48 is a plan view illustrating the stack wrapping station illustrated in FIG. 47.
Figure 49:
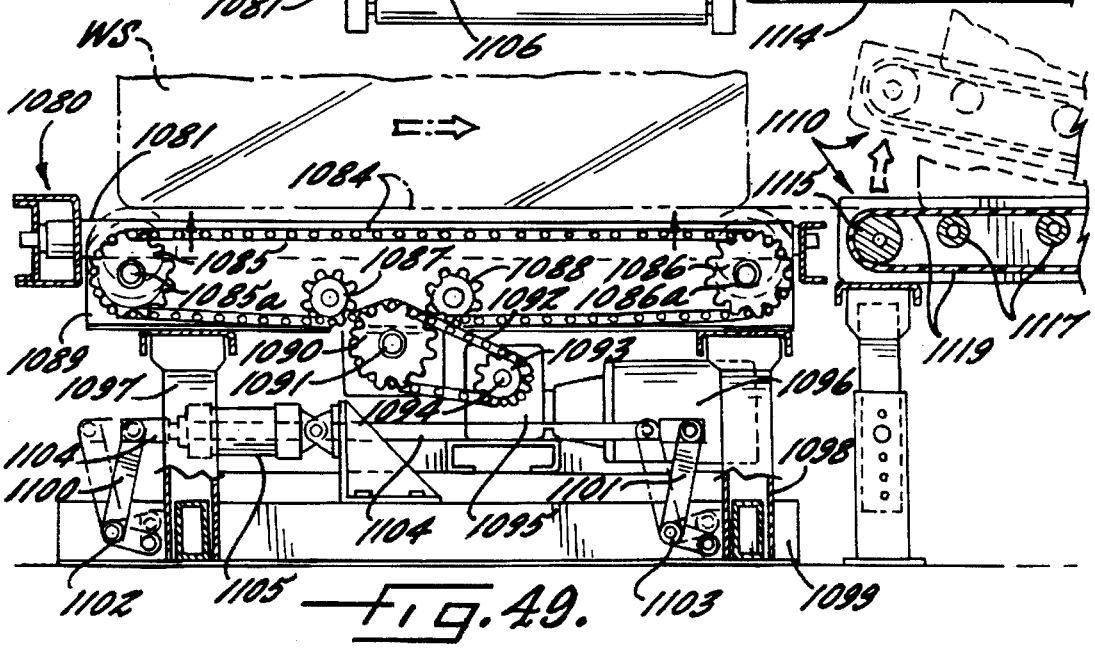
FIG. 49 is a vertical transverse sectional view taken substantially along line 49—49 in FIG. 48.

Conveyor chains 1082–1084 are identical and therefore only chain 1084 will be described in detail (FIG. 48). Conveyor chain 1084 is trained at its opposite ends about sprockets 1085 and 1086 which are mounted for rotation on suitable shafts 1085*a* and 1086*a* and have the teeth thereof meshing with the links of conveyor chain 1084. A pair of idler sprockets 1087 and 1088 are carried by a conveyor frame 1089 and mesh with the bottom run of conveyor chain 1084. Conveyor chain 1084, and the chains 1082 and 1083, are driven by a drive sprocket 1090 which is on a shaft 1091. Shaft 1091 is driven by a drive chain 1092 driven by a sprocket 1093 carried on the output shaft 1094 of a gear box 1095 driven by a motor 1096.

The chain conveyor frame 1089 is carried by a pair of columns 1097, 1098 which are mounted for vertical adjustable movement on a base 1099. Columns 1097 and 1098 are connected respectively to crank arms 1100 and 1101 which are pivotably mounted on base member 1099 for pivotal movement about pivots 1102 and 1103. The upper ends of crank arms 1100 and 1101 are connected to the piston 1104 of a pneumatic cylinder 1105 such that upon activation of the cylinder 1105, the columns 1097, 1098 and thus frame 1089 will be raised or lowered with respect to the base 1099 and with respect to the rollers 1081 of conveyor 1080.

When a wrapped stack of insulation material packages is discharged from the conveyor 1052 onto conveyor 1080 and reaches a medial location thereon, the stack will engage a stop member 1106 and the drive of the rollers 1081 is discontinued such that the stack stops in position above the conveyor chains 1082–1084. The cylinder 1105 is then activated to raise the conveyor chains 1082–1084 above the rollers 1081 to raise the wrapped stack of packages of insulation material off of the rollers 1081. The motor 1096 is activated to drive the conveyor chains 1082–1084 in a direction transverse of the conveyor 1080 in a direction parallel to the longitudinal axes of the rollers 1081 to discharge the wrapped stack of insulation material onto a conveyor 1110.

In some instances, a single wrapping of a stack of packages may be sufficient. In other instances, two wrappings of the stack will be deemed desirable.

To that end, conveyor 1110 preferably includes a first conveyor section 1111 and a second conveyor section 1112. Conveyor section 1111 includes a pair of side frames 1113 and 1114, and rollers 1115 and 1116 and a plurality of intermediate support rollers 1117 which support, along with the end rollers 1115 and 1116, a plurality of spaced apart conveyor belts 1119. The side frame members 1113 and 1114 are pivoted with respect to conveyor section 1112 along the axis of the end roller 1116 such that conveyor section 1111 may be pivoted from its normal horizontal position to a vertical position 90° from its horizontal position and perpendicular to the conveyor section 1112.

Similarly, section 1112 has a construction very similar to section 1111, except that it is pivoted about the axis of the roller 1116 in the opposite direction to conveyor section 1111. An indexing motor 1118 is provided and drives the pivoting of the conveyor sections 1111 and 1112 through a drive belt 1118*a*.

When a wrapped stack of insulation material is to be discharged from conveyor 1080 onto conveyor 1110, the conveyor section 1111 is positioned in a horizontal position and conveyor section 1112 is raised to a vertical position. Conveyor chains 1082–1084 are raised and activated to feed the wrapped stack of packages of insulation material off of conveyor 1080 and onto conveyor section 1111. Conveyor belts 1119 are driven until the wrapped stack of packages of insulation material are stopped against the vertical conveyor section 1112.

Figures 50, 51, 52:
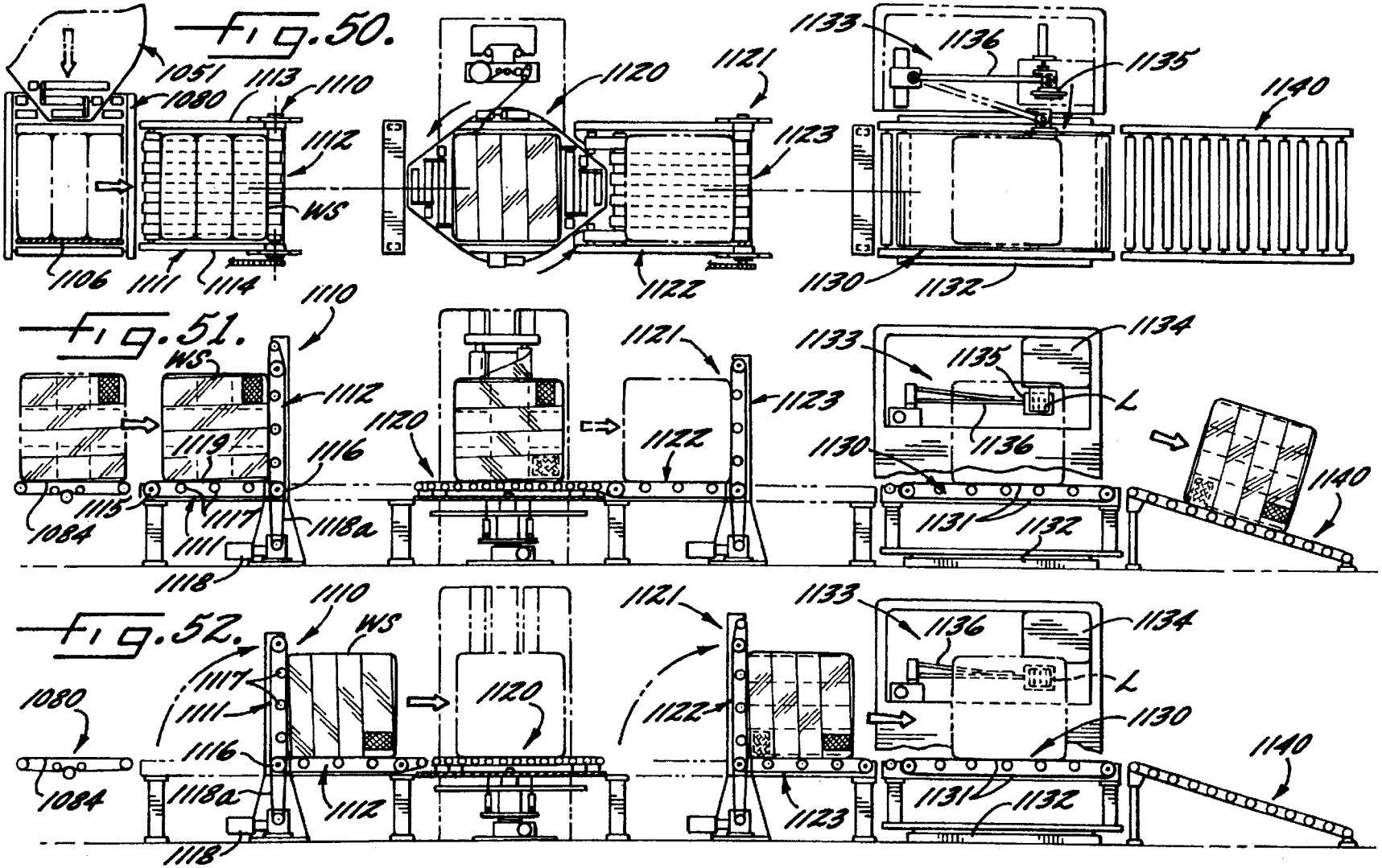
FIG. 50 is a fragmentary, somewhat schematic, top plan view of the stack weighing and marking station.
FIG. 51 is side elevation of the process illustrated in FIG. 50.
FIG. 52 is a side elevation similar to FIG. 51 with portions thereof in different operational positions.

At that time, motor 1118 is activated to drive the pivoting action of conveyor segments 1111 and 1112 to pivot the vertical conveyor section 1112 and the horizontal conveyor section 1117 clockwise around the pivot roller 1116, as shown in FIGS. 51 and 52. Thusly, conveyor section 1112 is moved from the vertical to the horizontal position and conveyor section 1111 is moved from the horizontal to the vertical position. The wrapped stack of packages of insulation material is thus rotated 90° such that the shrink wrap wrappings which extended around the stack about a generally vertical axis now extend around the wrapped stack about a generally horizontal axis.

The conveyor belts of section 1112 are then driven to deliver the stack of packages of insulation material off of the conveyor section 1112 and into a second wrapping station 1120. The second wrapping station 1120 is identical to wrapping station 1051 and therefore wrapping station 1120 will not be redescribed. At the second wrapping station 1120, plastic film wrap is wrapped tightly around the stack of insulation material in the same manner as at wrapping station 1051 until the stack is wrapped from top to bottom. Once the stack is completely covered in plastic film, the conveyor of the second wrapping station 1120 is raised and discharges the wrapped stack onto another conveyor 1121.

Conveyor 1121 has a first conveyor section 1122 which is identical in construction to conveyor section 1112 and a second conveyor section 1123 which is identical to conveyor section 1111 of conveyor 1110. Accordingly, these conveyor sections 1122 and 1123 will not be described again. When a wrapped stack of insulation material is to be discharged from the second wrapping station 1120, conveyor 1121 is operated to position the conveyor section 1122 horizontal and conveyor section 1123 vertical. The wrapped stack of insulation material is discharged from the conveyor of the second wrapping station 1120 onto conveyor section 1122 and conveyor section 1122 feeds the wrapped insulation material until it abuts against the vertical conveyor section 1123 (FIG. 51). Conveyor 1121 is then actuated to rotate the conveyor section 1122 from a horizontal to a vertical position and conveyor section 1123 from a vertical to a horizontal position as shown in FIG. 52. This rotates the wrapped stack about 90° for a second time such that the packages in the stack are back to their original orientation after the first shrink wrapping at the wrapping station 1051 except that the top of the stack at the wrapping station 1051 is now on the bottom and the bottom of the stack at the wrapping station 1051 is now on top.

The conveyor section 1123 is then operated to feed the wrapped stack of insulation material from the conveyor section 1123 into a weighing station 1130 (FIGS. 50–52). Weighing station 1130 includes a conveyor 1131 which receives the wrapped stack of insulation material from conveyor section 1123 and feeds the same into position at weighing station 1130. Weighing station 1130 further includes a platform scale 1132 which weighs the wrapped stack of packages of insulation material. The scale 1132 transmits the weight of the stack to label applicator means 1133. Label applicator means 1133 includes a printer 1134 to print suitable indicia, including the weight information, on labels applied to the wrapped stack of insulation by label applicator 1133. Label applicator means 1133 further includes a vacuum head 1135 to which the printed labels are delivered and vacuum head 1135 is carried by a swingable arm means 1136 to apply the labels to the stacks of wrapped insulation.

Once the label has been applied, the completed unitized package of insulation material is delivered from the weighing station 1130 by conveyor 1131 onto a gravity roller out-feed conveyor 1140 so that the unitized package is delivered to suitable material handling equipment (not shown) for placement in inventory in a suitable warehouse facility.

Hereinabove, the operation of the conveyor 806, the stacking robot 1000, and the wrapping stations 1051 and 1120, have been described with respect to packages of folded batt insulation. The operation of these different stations is quite similar for roll-type insulation, except that the roll packers and sealers deliver the rolls to conveyor 806 in such manner that at the sensing means 997–999, there will be two packages, each containing a roll of insulation material in side-by-side relation transversely of conveyor 806, and two rows of rolls longitudinally of conveyor 806, such that the clamping plates 1038 and 1039 will clamp four packages of rolls of insulation material and transfer the same to conveyor 1050. Accordingly, instead of three packages of batt-type insulation forming each layer in the stack, there will be four packages of roll-type insulation in each layer and there will be three layers in each stack, the same as with the batt-type insulation. In all other respects, the unitizing operation will be the same for roll-type insulation as has been previously described with respect to packages of batt-type insulation.

As previously noted, the present process and apparatus also provides for the manufacture of insulation of the blown-type for use in insulating areas into which the insulation material is applied by being entrained in a slow moving air stream and deposited in the area to be insulated. The process and apparatus of the present invention for producing blown-type insulation material will not be described. In those instances where the same step and apparatus is used for blown-type insulation material production as that previously described, the same reference characters, with the prime notation added, will be used.

The bales of recycled cotton fibers are placed on conveyors **71*a*'–71*c*' (FIG. 1A) and the compressed fibers are opened or decompressed in bale breakers 72*a*', 72*b*', 72*c*'. The clumps of somewhat opened recycled cotton fibers are then fed through a preopener 100' into a pneumatic blower 114' which delivers the preopened fibers into a pneumatic conveying conduit 115' Conduit 115' delivers the fibers into an impregnator 120'** in which the cotton fibers are impregnated with liquid fire retardant chemicals.

From impregnator 120', the fibers pass into a bale press 150' in which the fibers are compressed, in the same manner as in bale press 150, and are then placed on a migration conveyor 162' for a similar period of time as on migration conveyor 162. The compressed and impregnated cotton fibers are delivered to an opener 163' which corresponds in construction and operation to opener 163 and then to a predryer 180' in which the wet fibers are partially dried and which then delivers the fibers to a dryer 200'. Once the fibers are fully dried, the same may be delivered directly to a reserve prior to packaging or may be passed through a willow 260' for application of a dry chemical fire retardant thereto. The latter process is preferred in accordance with the present invention.

Figure 55:
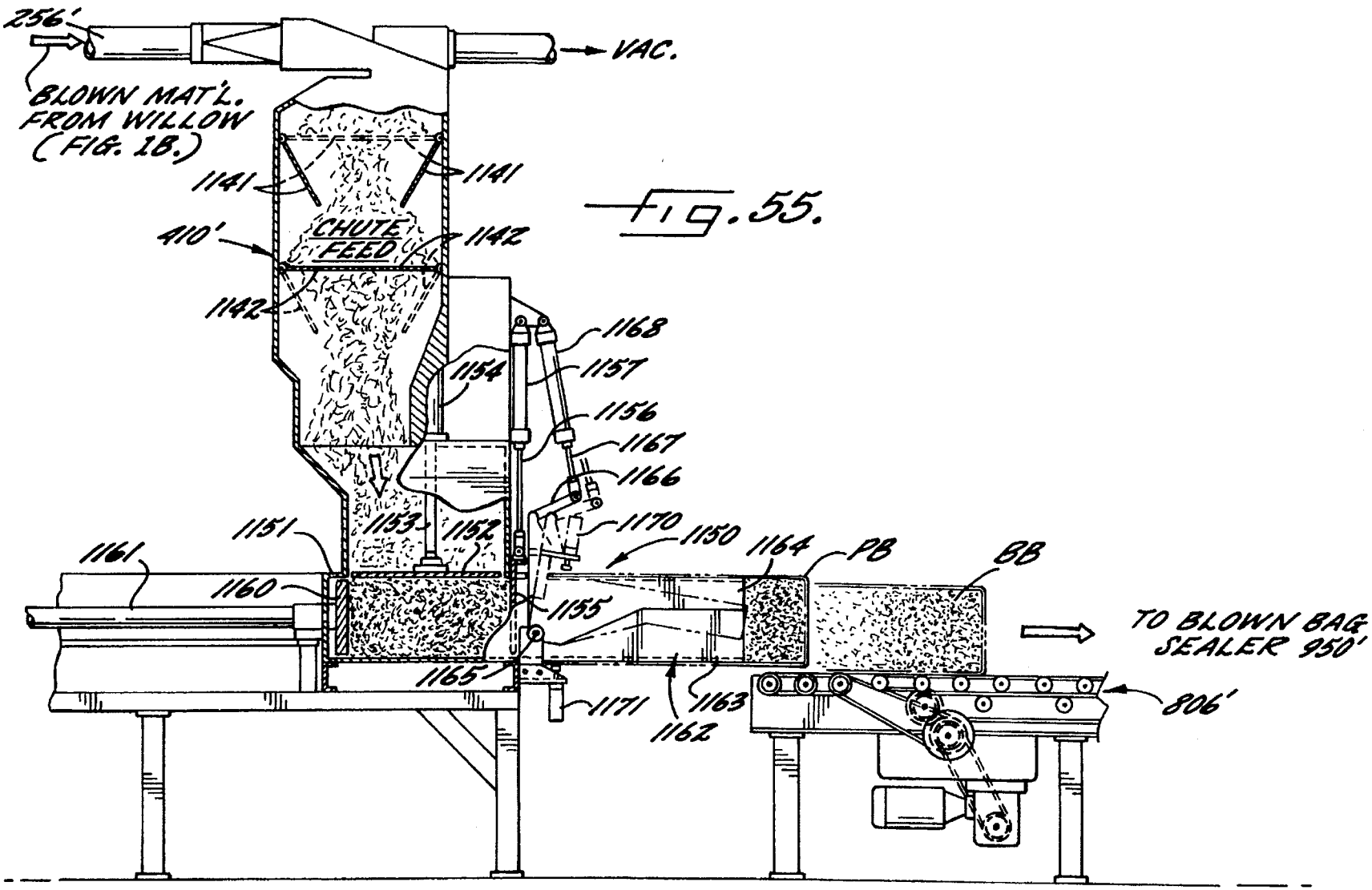
FIG. 55 is a fragmentary, somewhat schematic, vertical sectional view of the blown insulation packing station illustrated in the upper left-hand portion of FIG. 1C.

From the willow 260', the treated and dried cotton fibers are delivered by a conduit 256' to a chute feed reserve 410' (FIG. 55) which is similar in construction and operation to the chute feed 410. The chute feed 410' differs from chute feed 410 in that it includes two spaced apart, superposed pairs of doors 1141, 1142. The upper pair of doors 1141 are pivotally mounted for movement between open and closed positions. Similarly, the lower pair of doors 1142 are pivotally mounted for movement between open and closed positions. Doors 1142 are weight sensitive and automatically open when a predetermined amount of fibers collect thereon. For example, thirty pounds has been used in one packaging format. Doors 1141 are closed when doors 1142 are open and vice versa.

A packing device 1150 is provided beneath the chute feed 410' and includes a housing 1151 having a compression ram 1152 carried by the lower end of a piston rod 1153 of a pneumatic cylinder 1154. Ram 1152 is raised and lowered by the cylinder 1154 and piston rod 1153 to permit blown insulation fibers to pass by the ram member when it is in its raised position into the bottom of housing 1151 and the ram is then moved downwardly to compress those fibers in the bottom part of the housing.

A closure gate valve 1155 is provided in one end of the bottom portion of the housing 1151 to close the discharge opening thereof during collection and compression of the blown fibers in housing 1151. The valve member 1155 is carried by the end of a piston 1156 of a pneumatic cylinder 1157. A ram 1160 is provided in the housing 1151 opposite the gate valve 1155 and is carried by the piston rod of a pneumatic cylinder 1161 for discharging the compressed fibers from the housing 1151 through the opening normally closed by the gate valve 1155.

A packaging horn 1162 is provided outside housing 1151 and having the entry end thereof communicating with the opening normally closed by gate valve 1155. Packaging horn 1162 includes a lower stationary segment 1163 and a movable upper segment 1164. Movable upper segment 1164 is pivoted about a pivot 1165 by a crank arm 1166 connected to a piston rod 1167 of a pneumatic cylinder 1168.

A pair of bag clamping pneumatic cylinders 1170 and 1171 are provided above and below horn segments 1164 and 1163 to clamp the open end portion of a plastic bag to the packaging horn 1162. When a plastic bag is in position over the packaging horn 1162, the cylinders 1170 and 1171 are activated to clamp the same and at the same time cylinder 1168 is activated to pivot the segment 1164 about the pivot 1165 to its fully open position within the plastic bag.

A predetermined measured and weighed amount of the treated and dried blown-type insulation fibers are collected in the housing 1151 and compressed by the ram 1152. When a predetermined measured amount of the fibers are collected and compressed, the cylinder 1161 is activated to extend the ram 1160. Immediately prior to activation of ram 1161, cylinder 1157 is activated to withdraw the gate valve member 1155 and open the discharge opening in housing 1151. Ram 1160 then extends and presses the compressed blown-type insulation material from the housing 1151 through the packaging horn 1162 and into the plastic bag. Simultaneously with full extension of the ram 1160, the bag clamping cylinders 1107 and 1171 are reversed to release the plastic bag and the cylinder 1168 is activated to attempt to pivot the horn segment 1164 about pivot 1165 toward the collapsed position. The ram 1160 will prevent the segment 1164 from moving fully to the collapsed position until the ram is withdrawn. Upon withdrawal of the ram 1160, the horn 1162 will collapse and the bag of blown-type insulation will be deposited on a conveyor 806'. Conveyor 806' has a bag sealer 950' corresponding to bag sealer 950 in FIG. 1C.

The sealed bags of blown-type material are delivered by conveyor 806' to a location on the opposite side of the robot stacker 1000 from the conveyor 806. When the bags of blown-type material reach the end of conveyor 806', a sensing means 1180 (FIG. 45) will be activated. Sensing means 1180 will in turn activate a pusher means 1181 comprises a rodless cylinder 1182 having a pusher plate 1183 connected thereto. Pusher means 1181 discharges the sealed bags onto a pick-up station 1184 which accumulates three bags of blown-type insulation for robot stacker 1000.

The robot stacker 1000 is constructed and arranged to serve both the conveyor 806 and the pick-up station 1184. The blown insulation material packaging line has a stacking conveyor 1050', a first wrapping station 1051', a delivery conveyor 1080', a first stack rotating conveyor 1110', a second wrapping station 1120', a second stack rotating conveyor 1121', a weighing station 1130' and a discharge conveyor 1140', all of which correspond in construction to the previously described stacking and unitizing line.

It is noted that the stacking robot 1000 is constructed and arranged such that if the batt-type or roll-type insulation production exceeds the capacity of the stacking, wrapping and unitizing facilities of their production line, the robot stacker 1000 can alternate between the batt-type or roll-type unitizing line and the blown-type insulation material unitizing line such that both stacking and unitizing lines can be used for batt-type or roll-type insulation in alternation. This alternate use of robot stacker 1000 is accomplished by actuating motor 1009 (FIG. 45) to rotate head 1008 relative to the carriage 1010. In this manner, the robot head 1025 may be alternately positioned above the stacking conveyor 1050 or stacking conveyor 1050'.

In the drawings and specifications, there has been set forth a preferred embodiment of the invention, and although specific terms are employed, they are used in a generic and descriptive sense only and not for purposes of limitation, the scope of the invention being set forth in the following claims.

That which is claimed is:

1. A method of forming thermal insulation comprising:

(a) forming cotton fibers into a relatively loose mass, (b) impregnating the cotton fibers with a liquid fire retardant, (c) drying the impregnated cotton fibers, (d) blending the cotton fibers with springy fibers having greater stiffness and resilience than the cotton fibers to provide increased bulk or loft, (e) blending the cotton fibers with bonding thermoplastic fibers having a predetermined melting temperature, (f) forming the blended fibers into a composite web having a predetermined thickness to provide a desired insulation value and having a low density, (g) heating the composite web to a temperature to soften the bonding fibers and to cause the same to bond the cotton and springy fibers in to a self-sustaining batt of insulation material, and (h) severing the bonded composite web into predetermined lengths to form individual batts of insulation material.

2. A method according to claim 1 wherein the cotton fibers are recycled cotton fibers recovered from previous processing.

3. A method according to claim 1 wherein the springy fibers are selected from a group including nylon and polyester.

4. A method according to claim 1 where the springy fibers comprise a blend of nylon and polyester.

5. A method according to claim 1 wherein the bonding fibers are selected from a group including polyester and polyolefins.

6. A method according to claim 1 wherein the bonding fibers comprise bi-component fibers, each having a core component and a sheath component and wherein the sheath components have a lower melting temperature than the core components.

7. A method according to claim 1 wherein the bi-component fibers have polyester sheaths and polyester cores.

8. A method according to claim 1 wherein the bi-component fibers have polyethylene sheaths and polyester cores.

9. A method according to claim 1 including mixing a predetermined amount of dry granular fire retardant with the impregnated cotton fibers while causing the dry granules of fire retardant to adhere to the surfaces of the cotton fibers to impart increased fire retardancy to the insulation being formed.

10. A method according to claim 1 wherein the cotton fibers are impregnated with the liquid fire retardant by applying the liquid fire retardant to the relatively loose mass of cotton fibers, compressing the mass of cotton fibers having the liquid fire retardant applied thereto into a dense mass to cause the liquid fire retardant to penetrate substantially throughout the mass of cotton fibers, and maintaining the treated cotton fibers in the dense mass for a sufficient time period for the liquid fire retardant to migrate substantially uniformly throughout the cotton fibers and to impregnate substantially all of the cotton fibers.

11. A method according to claim 1 wherein the blended fibers are formed into a composite web by carding the blended fibers and delivering the carded fibers as a plurality of card webs, cross-lapping each card web into a cross-lapped web of predetermined thickness, and superposing a sufficient number of cross-lapped webs to provide a composite web of the requisite thickness.

12. A method according to claim 1 wherein the composite web of blended fibers is formed by air-laying the blended fibers on a moving surface to form the composite web of the requisite thickness.

13. A method according to claim 1 wherein the composite web is formed of a width sufficient to provide a plurality of juxtaposed, individual batts of insulation and including slitting the bonded composite web longitudinally into a plurality of narrow strips, each of which has a width corresponding to the desired width of the individual batts of insulation.

14. A method according to claim 1 including packaging the individual batts in sealed plastic bags.

15. A method according to claim 14 wherein the individual batts are compressed before being placed in the plastic bags.

16. A method according to claim 14 wherein the individual batts are folded medially thereof before being placed in the plastic bags.

17. A method according to claim 16 wherein the individual batts are folded substantially along their transverse center line.

18. A method according to claim 14 wherein a plurality of individual batts are superposed and packaged in each plastic bag.

19. A method according to claim 14 wherein the individual batts are wound into rolls before being placed in the plastic bags.

20. A method according to claim 14 including stacking a plurality of the packages of batts of insulation in juxtaposed and/or superposed relation, and wrapping the stack of packages with plastic film to unitize the plurality of packages.

21. A method according to claim 20 wherein the plastic film is tensioned and wrapped tightly about the stack of packages to enclose tightly the stack of packages.

22. A method according to claim 21 wherein the stacking of the packages includes placing a plurality of packages in juxtaposed relation to form layers of packages and placing a plurality of such layers in superposed relation to form a cube.

23. A method according to claim 22 wherein the wrapping of the stack of packages includes wrapping the stack of packages with plastic film in one direction to cover substantially four sides of the stack and in another direction to cover two sides, top and bottom of the stack.

24. A method according to claim 23 wherein the stack of packages is firstly wrapped with the plastic film about a substantially vertical axis to cover four sides thereof, the wrapped stack is rotated a one-quarter turn or 90°, and the stack is secondly wrapped with the plastic film about a substantially vertical axis.

25. A method of forming thermal insulation comprising:

(a) forming recycled cotton fibers into a relatively loose mass, (b) impregnating the cotton fibers with a liquid fire retardant by spraying the liquid fire retardant onto the mass of cotton fibers, compacting the mass of fibers into a dense mass to force the liquid fire retardant throughout the mass of fibers, and holding the compacted, dense mass of cotton fibers for a predetermined time sufficient to permit the liquid fire retardant to migrate throughout the cotton fibers and to impregnate such cotton fibers substantially uniformly, (c) drying the impregnated cotton fibers by forming the cotton fibers into a relatively loose mass and subjecting the same to heated air until substantially dry, (d) blending the impregnated, dry cotton fibers with a minor amount of synthetic springy fibers having increased stiffness and resiliency than the cotton fibers to provide increased bulk or loft to the insulation being formed, (e) blending the cotton and springy fibers with a minor amount of bi-component, bonding fibers having core components and sheath components, the sheath components having a lower melting temperature than the core components and the springy fibers, (f) forming the blended cotton, springy and bi-component fibers into a composite web having a thickness sufficient to provide the desired insulation value and a width sufficient to provide a plurality of juxtaposed individual batts of insulation, (g) heating the composite web to a temperature to soften the sheath components of the bonding fibers but insufficient to affect the core components to cause the sheath components to bond to adjacent cotton and springy fibers to secure the fibers together into a self-sustaining composite web, (h) slitting the bonded composite web longitudinally into relatively narrow strips having widths corresponding to the width of the individual batts of insulation being formed, and (i) severing the strips into predetermined lengths to form individual batts of insulation.

26. A method according to claim 25 wherein the cotton fibers form a major constituent of the blend of fibers and the springy and bi-component fibers form a minor constituent of the blend of fibers.

27. A method according to claim 26 wherein the cotton fibers comprise about 75% of the blend of fibers.

28. A method according to claim 27 wherein the springy fibers comprise about 15% and the bi-component fibers comprise about 10% of the blend of fibers.

29. A method according to claim 25 including adhesively securing a web of backing material to one face of the relatively narrow strips of insulation into which the composite web is slit.

30. A method according to claim 29 wherein the backing material is vinyl.

31. A method according to claim 30 wherein the web of vinyl backing material is adhered to one face of the bonded composite web prior to slitting thereof, and wherein slitting of the composite web also slits the vinyl backing material.

32. A method according to claim 31 wherein the individual batts of insulation having the vinyl backing material thereon are for use in commercial buildings and the composite web is slit into strips of predetermined widths and the strips are severed into predetermined lengths for such commercial buildings.

33. A method according to claim 32 wherein the batts of commercial insulation have a width of about 24 inches.

34. A method according to claim 29 wherein the backing material is paper.

35. A method according to claim 34 wherein the web of paper backing comprises a plurality of juxtaposed webs equal in number to the number of strips into which the composite web is slit, and wherein the webs of paper backing material are adhered to the strips of insulation after the slitting of the composite web.

36. A method according to claim 35 wherein the individual batts of insulation having the paper backing material thereon are for residential insulation purposes and have a predetermined width and length for residential buildings.

37. A method according to claim 36 wherein the batts of residential insulation have widths of about 15 and 24 inches.

38. A method according to claim 36 wherein the composite web is slit such that some of the individual batts having the paper backing material have insulation material slit into two juxtaposed strips adhered to the web of paper backing material which collectively provide the predetermined width.

39. A method according to claim 38 wherein the individual batts of residential insulation have a width of about 15 inches and some of the individual batts are slit into juxtaposed strips having widths of about 6 inches and about 9 inches.

40. A method according to claim 25 including applying additional liquid fire retardant to at least one surface of the composite web and then drying the composite web to provide additional fire retardancy to the batts of insulation.

41. A method according to claim 40 wherein additional liquid fire retardant is applied to both surfaces of the composite web.

42. A method according to claim 40 wherein additional liquid fire retardant is applied to only one surface of the composite web and that surface is opposite the surface to which backing material is to be adhered.

43. An automated method of forming thermal insulation comprising feeding bales of compacted recycled cotton fibers through a bale breaker and a pre-opener to loosen the compacted fibers and to form a relatively loose mass of cotton fibers, feeding the mass of cotton fibers from the pre-opener to a liquid fire retardant applicator, applying a liquid fire retardant to the cotton fibers in the liquid fire retardant applicator, feeding the cotton fibers from the liquid fire retardant applicator into a first bale press, compressing the cotton fibers to which the liquid fire retardant has been applied into a highly compressed state to force the liquid fire retardant into and throughout the mass of cotton fibers, conveying the compressed mass of fibers from the bale press along a predetermined path of travel for a period of time sufficient for the liquid fire retardant to migrate substantially throughout the mass of cotton fibers and through an opener to loosen the fibers into a relatively loose mass, drying the loosened fibers to a substantially dry state by conveying the fibers through a hot box and a dryer, conveying the dry, fire retardant treated fibers from the dryer through a willow mixing unit while applying a small amount of moisture thereto and mixing therewith a predetermined amount of dry fire retardant granules, conveying the treated cotton fibers from the willow mixing unit into a second bale press and baling the treated cotton fibers into bales, storing the bales of treated cotton fibers until needed, feeding the bales of treated cotton fibers through at least one bale breaker to loosen the compacted fibers and delivering the loosened fibers onto a feed conveyor, feeding bales of springy fibers through a bale breaker to loosen the compacted fibers and delivering a predetermined amount of the loosened springy fibers onto the feed conveyor with the loosened cotton fibers, feeding bales of bi-component bonding fibers through a bale breaker to loosen the compacted fibers and delivering a predetermined amount of bi-component fibers onto the feed conveyor with the loosened cotton and springy fibers, passing the cotton, springy and bi-component fibers through a picker and a fine opener to open further and thoroughly blend the cotton, springy and bi-component fibers, conveying the blend of fibers from the picker and fine opener through a composite web forming means to form a composite web of predetermined width and thickness, and conveying the composite web through an oven while heating the composite web of fibers above the softening temperature of the bi-component fibers but below the melting temperature of the springy fibers to cause the bi-component fibers to adhere to the other fibers and secure the fibers together to form a substantially structurally stable batt of insulation.

44. An automated method according to claim 43 wherein the step of conveying the blend of fibers through a composite web forming means comprises conveying the blend of fibers through at least one card while carding the fibers and forming a carded web and feeding the carded web through at least one cross-lapper while cross-lapping the carded web to form the composite web.

45. An automated method according to claim 43 wherein the step of conveying the blend of fibers through a composite web forming means comprises conveying the blend of fibers through an air lay matt forming means while entraining the fibers in an air stream and depositing the fibers on a conveyor while drawing a vacuum on a perforate drum to form the composite web.

46. An automated method according to claim 43 wherein the step of conveying the blend of fibers through a composite web forming means comprises conveying the blend of fibers through at least one card while carding the fibers and forming a carded web thereof and feeding the carded web through at least one cross-lapper while cross-lapping the carded web to form the composite web.

47. An automated method according to claim 43 wherein the step of conveying the blend of fibers through a composite web forming means comprises conveying the blend of fibers through an air lay matt forming means while entraining the fibers in an air stream and depositing the fibers on a conveyor while drawing a vacuum on a perforate drum to form the composite web.

48. An automated method according to claim 43 including conveying the batt of insulation from the oven while severing the batt into predetermined lengths to form individual batts of insulation.

49. An automated method according to claim 48 including adhesively securing a web of backing material to one surface of the batt of insulation before severing thereof into predetermined lengths.

50. An automated method according to claim 48 including conveying the individual batts of insulation to a folding station and folding the batts about a medial fold line.

51. An automated method according to claim 50 including conveying the folded batts from the folding station to a stacking station and stacking a plurality of folded batts in a superposed relation to form a stack thereof.

52. An automated method according to claim 51 including conveying the stack of folded batts by a conveyor means from the stacking station to a robot transfer station.

53. An automated method according to claim 52 including removing the stack of folded batts from the conveyor means by a robot transfer means and transferring the stack of folded batts into a compression chamber.

54. An automated method according to claim 53 including compressing the stack of folded batts in the compression chamber and delivering the compressed stack therefrom.

55. An automated method according to claim 54 wherein the compressed stack is delivered from the compression chamber to a packaging station and including placing the compressed stack of folded batts in a plastic bag.

56. An automated method according to claim 55 including conveying the plastic bags of compressed stacks of folded batts from the packaging station to a unitizing station while sealing the open ends of the plastic bags to form a complete package thereof.

57. An automated method according to claim 56 including arranging a plurality of packages of the folded batts in juxtaposed relation to form a layer thereof and transferring successive layers of packages to a stacking station to form a stack of superposed layers.

58. An automated method according to claim 57 wherein at least alternate layers of packages transferred to the stacking station are rotated 90° about a vertical axis to vary the orientation of the packages in successive layers in a stack.

59. An automated method according to claim 58 including conveying the stack of packages of folded batts from the stacking station to a wrapping station.

60. An automated method according to claim 59 including wrapping the stack of packages of folded batts with a plastic film.

61. An automated method according to claim 60 including conveying the wrapped stack of packages from the wrapping station to a weighing station and weighing the stack of packages and applying a printed label thereto.

62. An automated method according to claim 48 including conveying the individual batts of insulation to a roll-forming station and rolling the individual batts about a mandrel to form rolls thereof.

63. An automated method according to claim 62 including securing the individual batts in roll-form by winding at least one convolution of tape about the periphery of each roll and adhesively securing the tape about the rolls of batts of insulation.

64. An automated method according to claim 63 including removing the mandrel from the rolls of batts of insulation by a mandrel removing means.

65. An automated method according to claim 64 including conveying the rolls of batts of insulation from the roll-forming station to a packaging station and inserting each roll into a plastic bag.

66. An automated method according to claim 65 including conveying the plastic bags of rolls of batts from the packaging station to a unitizing station while sealing the open ends of the plastic bags to complete the packaging of the rolls in sealed plastic bags.

67. An automated method according to claim 66 including arranging a plurality of packages of the rolls of batts in juxtaposed relation to form successive layers.

68. An automated method according to claim 67 including transferring successive layers of packages by a robot transfer means to a stacking station while placing such successive layers in superposed relation to form a stack thereof.

69. An automated method according to claim 68 including conveying the stack of packages from the stacking station to a wrapping station and wrapping the stack with a plastic film.

70. An automated method according to claim 69 including conveying the wrapped stack of packages from the wrapping station to a weighing station, weighing the stack of packages and applying a printed label thereto.

* * * * *